US008451185B2

(12) United States Patent
Webb

(10) Patent No.: US 8,451,185 B2
(45) **Date of Patent: *May 28, 2013**

(54) MULTI-FEED DIPOLE ANTENNA AND METHOD

(75) Inventor: Spencer L. Webb, Pelham, NH (US)

(73) Assignee: Antennasys, Inc., Pelham, CA (US)

( * ) Notice: Subject to any disclaimer, the term of this patent is extended or adjusted under 35 U.S.C. 154(b) by 608 days.

This patent is subject to a terminal disclaimer.

(21) Appl. No.: 12/728,009

(22) Filed: Mar. 19, 2010

(65) Prior Publication Data

US 2011/0227776 A1 Sep. 22, 2011

Related U.S. Application Data

(66) Continuation of application No. 12/034,838, filed on Feb. 21, 2008, now Pat. No. 7,692,597, Substitute for application No. 60/890,840, filed on Feb. 21, 2007.

(51) Int. Cl.
*H01Q 9/04* (2006.01)
*H01Q 9/16* (2006.01)

(52) U.S. Cl.
USPC ..... 343/790; 343/792; 343/793

(58) Field of Classification Search
USPC ..... 343/790, 792, 793
See application file for complete search history.

(56) References Cited

U.S. PATENT DOCUMENTS

| | | | |
|---|---|---|---|
| 2,619,596 | A | 11/1952 | Kolster |
| 3,000,008 | A | 9/1961 | Pickles |
| 3,836,975 | A | 9/1974 | Cassel |
| 4,087,823 | A | 5/1978 | Faien et al. |
| 4,218,687 | A | 8/1980 | Faigen et al. |
| 4,410,893 | A | 10/1983 | Griffee |
| 4,730,195 | A | 3/1988 | Phillips et al. |
| 5,068,671 | A | 11/1991 | Wicks et al. |
| 5,087,922 | A | 2/1992 | Tang et al. |
| 5,867,130 | A | 2/1999 | Tay et al. |
| 6,054,962 | A | 4/2000 | Ha et al. |

(Continued)

FOREIGN PATENT DOCUMENTS

| | | |
|---|---|---|
| DE | 3703812 | 2/1987 |
| GB | 515 853 | 12/1939 |
| WO | WO 82/04356 | 12/1982 |
| WO | WO 2006/130069 | 12/2006 |

OTHER PUBLICATIONS

European Search Report dated Sep. 29, 2011. (6 pages).

(Continued)

*Primary Examiner* — Jacob Y Choi
*Assistant Examiner* — Hasan Islam
(74) *Attorney, Agent, or Firm* — ARC IP Law, PC; Joseph J. Mayo

(57) ABSTRACT

A multi-feed dipole antenna and method. Provides a volumetrically efficient antenna with wide radiation pattern bandwidth and wide impedance bandwidth that are relatively independent. Driving the antenna at multiple locations provides for a half wavelength dipole antenna with a wider frequency range than any other known fat dipole of similar volume. The apparatus is constructed from brass or any other suitable metal without requiring dielectric loading and without requiring direct coupling on the outside of the tubes. The apparatus utilizes a parasitic center tube with two end tubes that are driven by a collinearly mounted metal rod that is driven from the midpoint. Insulators hold the parasitic tube to the end tubes. The parasitic tube allows for induced currents to flow on the surface of the tube which allow for operation of the dipole over a wide frequency range.

16 Claims, 87 Drawing Sheets

Planar Implementation (to optimize use of a rectangular space v. cylindrical)

U.S. PATENT DOCUMENTS

| | | | |
|---|---|---|---|
| 6,057,804 | A | 5/2000 | Kaegebein |
| 6,346,920 | B2 | 2/2002 | Sharp et al. |
| 6,667,721 | B1 | 12/2003 | Simonds |
| 6,720,934 | B1 | 4/2004 | Price et al. |
| 6,940,463 | B2 | 9/2005 | Ittipiboon et al. |
| 6,975,278 | B2 | 12/2005 | Song et al. |
| 7,006,047 | B2 | 2/2006 | Marsan et al. |
| 7,064,728 | B1 | 6/2006 | Lin |
| 7,158,087 | B2 | 1/2007 | Dai et al. |
| 2002/0186171 | A1 | 12/2002 | Petros |
| 2004/0108962 | A1 | 6/2004 | Churng-Jou et al. |

OTHER PUBLICATIONS

Johnson, "Antenna Engineering Handbook", Third Edition, 1993, pp. 4-1 to 4-23. Mc-Graw-Hill, Inc., New York, USA.

Kraus et al. "Antennas for All Applications", pp. 721-722, Mc-Graw-Hill, Inc. New York, USA, 2002.

International Search report and Written Opnion from PCT/US2008/054591 dated Jul. 7, 2008, 9 pages.

Edward P. Tilton, "V.H.F. Antenna Facts and Fallacies: Part III—The How and Why of Matching Devices", QST, No. 3, Mar. 1964, pp. 29-34, XP001387898.

PRIOR ART

PRIOR ART

PRIOR ART

PRIOR ART

PRIOR ART

PRIOR ART

PRIOR ART

PRIOR ART

PRIOR ART

PRIOR ART

PRIOR ART

PRIOR ART

PRIOR ART

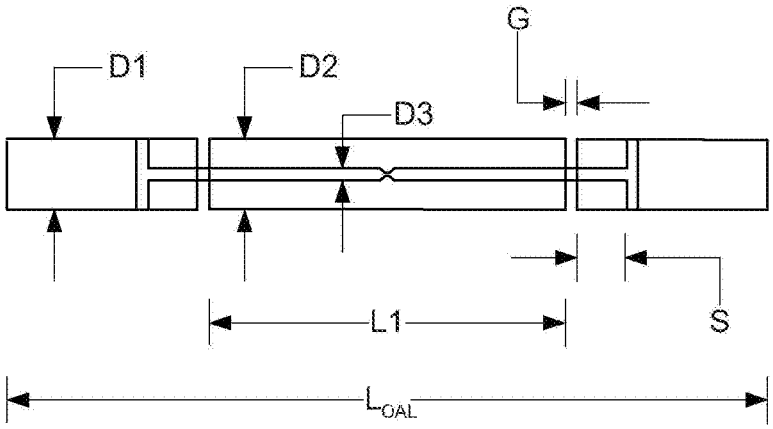
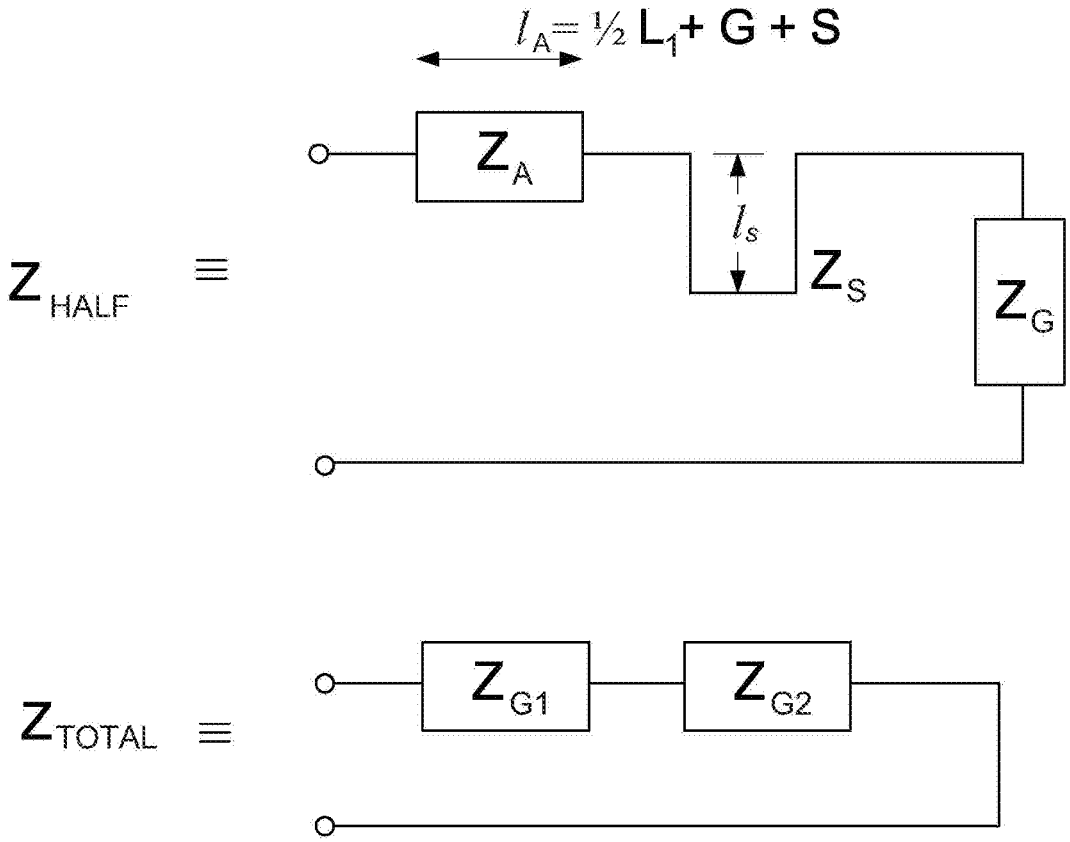
FIG. 66

Planar Implementation (to optimize use of a rectangular space v. cylindrical)

Fig. 75: Overview of the Planar MFD Antenna

Fig. 76: Dimensions of the exemplar Planar MFD Antenna

Fig. 77: Feed point impedance, 100-ohm reference

Fig. 79: Top plates removed to show feedpoint and shorts details

Fig. 80: Additional detail of Fig. 79

Fig. 81: Feedpoint detail showing simulation source

Type = Farfield
Approximation = enabled (kR >> 1)
Monitor = farfield (f=300) [1]
Component = Abs
Output = Directivity
Frequency = 300
Rad. effic. = 1.048
Tot. effic. = 0.9097
Dir. = 2.576 dBi Type = Farfield
Approximation = enabled (kR >> 1)
Monitor = farfield (f=600) [1]
Component = Abs
Output = Directivity
Frequency = 600
Rad. effic. = 1.006
Tot. effic. = 0.7246
Dir. = 3.554 dBi

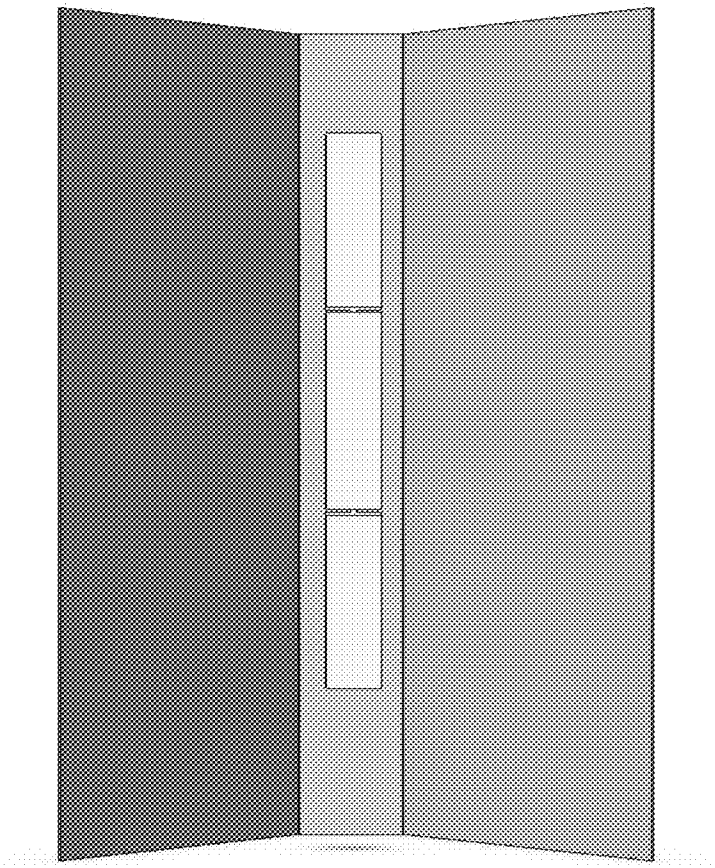
Fig. 85: Front view of corner reflector and planar embodiment

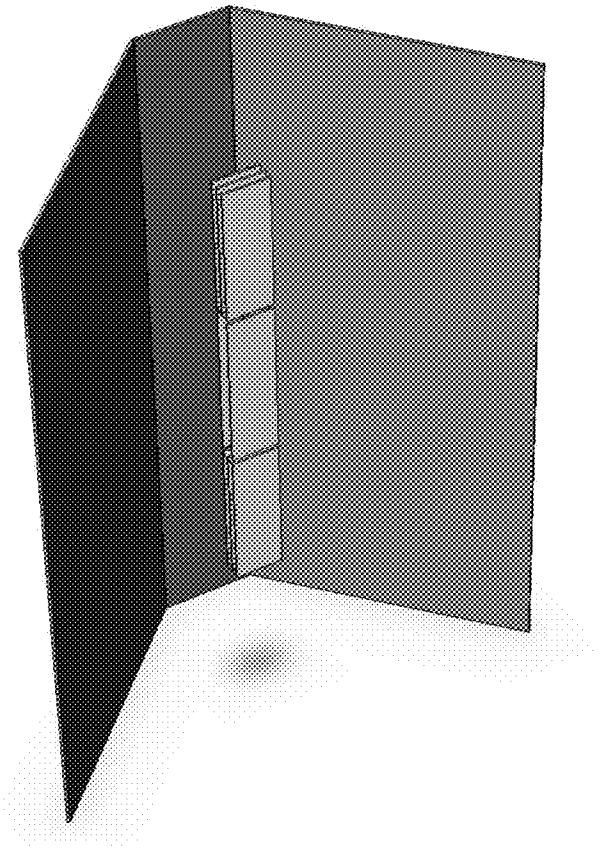
Fig. 86: Perspective view of corner reflector and planar embodiment

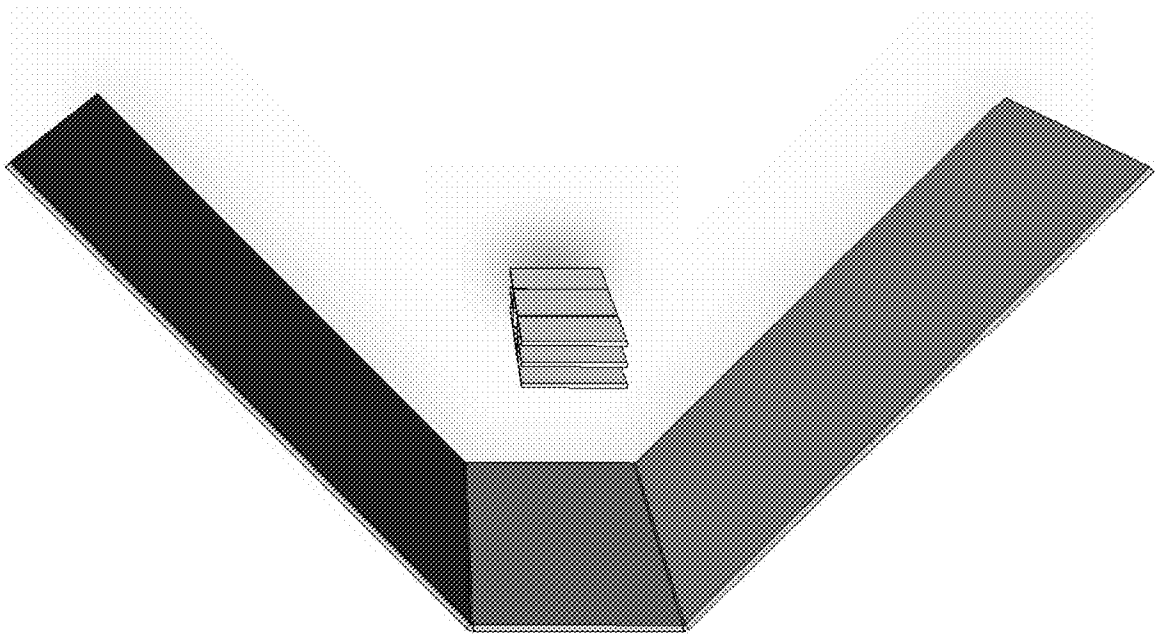
Fig. 87: Top view of corner reflector and planar embodiment

MULTI-FEED DIPOLE ANTENNA AND METHOD

This application is a continuation of Ser. No. 12/034,898, filed Feb. 21, 2008, now U.S. Pat. No. 7,692,597 issued 6 Apr. 2010 which claims the benefit of U.S. Provisional Patent Application Ser. No. 60/890,840, filed 21 Feb. 2007, the specifications of which are both hereby incorporated herein by reference.

BACKGROUND OF THE INVENTION

1. Field of the Invention

Embodiments of the invention described herein pertain to the field of antennas. More particularly, but not by way of limitation, one or more embodiments of the invention enable a multi-feed dipole antenna and method covering a wide frequency band.

2. Description of the Related Art

One of the simplest antennas is a dipole antenna. The length of a typical dipole antenna generally approximates one half-wavelength of a desired transmit/receive frequency. The radiation pattern provided by a dipole antenna is limited when the frequency of the signal at the antenna is high enough to assert harmonic modes in the current distribution. The pattern is said to "bifurcate" at the higher frequencies and results in a pattern that causes side lobes and nulls to appear where they would not appear at lower frequencies.

Dipole antennas are limited in terms of their radiation pattern and impedance bandwidth. Radiation pattern bandwidth is that range of frequencies over which the radiation pattern is substantially constant and is within specifications. The impedance bandwidth is that range of frequencies over which the input impedance is with a certain acceptable ratio of the nominal impedance. This is often described in terms of standing-wave ratio (SWR), where an acceptable maximum SWR may be 2.5:1 or some other value. Generally, radiation pattern bandwidth and impedance bandwidth are the primary considerations for wide band antennas. An antenna with a wider bandwidth than a thin wire dipole antenna is a "fat dipole". Antennas designed for volumetrically compact wide band coverage generally follow the fat dipole approach since biconical wide band antennas take up such a large volume. Once the wire conductors of a dipole antenna are made thicker, the antenna bandwidth increases.

U.S. Pat. No. 3,000,008 to Pickles describes a variant of a fat dipole antenna. Pickles '008 is directed at a narrow-band decoupling mechanism that attempts to maximize current flow on the antenna and not on the support structure of the antenna. The antenna has a half wavelength tube coupled directly to two other shorter tubes that act as chokes, preventing current flow onto the support structure. The feed for the antenna is symmetric. Excitation voltages are directly "applied across the gaps" between the different tube sections. The main problems with this antenna are the presumption of symmetry in the support structure on either side of the antenna. Also, the two feed points (gaps) are at a very high impedance and will present practical difficulties in impedance matching. Further, the Pickles antenna is based upon very narrow-band structures such as quarter wave chokes, and is therefore not a wideband design.

Johnson ISBN 0-07-032381-X in "Antenna Engineering Handbook" provides a thorough background of dipole antennas including cylindrical dipoles, biconical dipoles, folded dipoles and sleeve dipoles. Kraus, et al., ISBN 0-07-232103-2 in "Antennas for all Applications" published by McGraw-Hill Companies, Inc., shows various sleeve dipoles antennas. The antennas described in these references fail to achieve maximum volumetric efficiency. Johnson shows an open-sleeve dipole which does not make efficient use of a cylindrical volume, as the dipole elements are thin after exiting the sleeve. Kraus shows a quarter wave sleeve monopole where the sleeve and the upper radiator are the same diameter, but the interior is not efficiently used for impedance matching. Further, the quarter wave sleeve monopole requires a large ground plane for operation. The present invention is ground plane independent.

U.S. Pat. No. 4,087,823 to Faigen et al., describes another variant of a fat dipole. Specifically, Faigen et al., '823 describes a device that is approximately three quarters of a wavelength long with a central section filled with dielectric. The antenna is driven asymmetrically with lines directly extending across the gaps to drive the various tubes. One problem with this antenna is the use of an asymmetrical feed structure. This may allow the pattern to vary over frequency, limiting the pattern bandwidth. Another problem is the use of heavy and expensive dielectric material to load the inside of the center tube so that it internally operates as a half-wavelength section. For at least the limitations described above there is a need for a multi-feed dipole antenna and method.

BRIEF SUMMARY OF THE INVENTION

One or more embodiments of the invention are directed to a multi-feed dipole antenna and method. The apparatus provides a volumetrically efficient antenna with a very wide pattern bandwidth and impedance bandwidth. Driving the antenna at multiple locations provides for a half wavelength dipole antenna with a wider frequency range than any other known dipole antenna. The apparatus is constructed from brass or any other suitable conductor without requiring a dielectric loading material and without requiring direct coupling on the outside of the tubes. The apparatus utilizes a parasitic center tube with two end tubes that are driven by a collinearly mounted metal rod that is driven from the midpoint. Insulators hold the parasitic tube to the end tubes. The outside of the device radiates or receives electromagnetic energy while the inside of the device efficiently acts as a transmission line to deliver power between the central feedpoint and the outside of the apparatus. The parasitic tube allows for induced currents to flow on the surface of the tube which allow for operation of the multi-feed dipole antenna over a very wide frequency range.

One Embodiment of the invention may be generally constructed from three coaxial metallic tubes of substantially equal diameter. The three coaxial metallic tubes are designated the top tube, center tube and bottom tube. The top tube and bottom tube are coupled with a metal top pin and metal bottom pin tube, the latter through which runs a coaxial cable that acts to transfer signals to the top pin then to the top tube and to the bottom pin tube to the bottom tube. The center tube is mounted in such a way as to parasitically couple to and radiate energy from the top and bottom tubes. Insulators separate the top and bottom tubes from the center tube. Any method of mounting the top, center and bottom tubes together wherein the top and bottom tubes are connected to the top and bottom pins respectively while the center tube is electrically isolated from the top and bottom tube is in keeping with the spirit of the invention. In one or more embodiments, the top tube and bottom tube are coupled with the top pin and bottom pin via a top pin plate and bottom pin plate that are offset from the junction of the center tube by distance S, where S is greater than or equal to zero units of length. In another embodiment, the structure is effectively flattened which produces a planar embodiment that works well when the width of the flattened "tubes" is a quarter wavelength or less. This embodiment is appropriate when the available space is more or less a rectangular prism.

The radiation pattern for embodiments of the invention do not bifurcate over a large range of frequency as the multi-feed dipole drives the antenna from a plurality of positions along the length of the antenna. This allows for a maximum-bandwidth device within the volume in which the antenna is situated.

Methods for manufacturing the antenna include coupling a coaxial cable to a top and bottom pin, coupling a center tube to the top tube and bottom tube via insulators and coupling the top and bottom tube to top and bottom pins conductively via top and bottom pin plates at offsets of zero or more units of measure from the junction of the center tube. The coaxial feed line may include one or more exterior ferrite beads to provide for decoupling of the antenna current from the outer surface of the feed line. The coaxial feed line may also include a quarter-wavelength transmission line transformer which may take the form of an electrical quarter-wavelength of 75-ohm coax between the antenna feed point and the 50-ohm transmission line departing the antenna. A non-conductive connection sleeve may be utilized to provide for a more stable interface between the top pin and bottom pin. Support caps may be utilized to provide support for the pins, and o-rings may be utilized between support caps at the tube junctions. Tube caps may be utilized to keep material out of the inner portions of the tubes. A tube mounting rod may be utilized to mount a rod to the antenna which allows for external mounting. The entire apparatus may be mounted inside a non-conductive tube for example to make the apparatus more durable. In doing so, a mounting rod may be utilized in the top tube for example that couples with the top pin to provide rigidity.

One use for a wide band antenna as enabled herein relates to cellular radio systems. Cellular towers are very expensive to operate. Many different carriers wish to utilize the same tower, and generally use one antenna per sector per band. An antenna that can provide multiple bands of operation due to large bandwidth enables multiple carriers to share the same antenna. Further, radio services which are not now anticipated may be served by extant antennas, for example via embodiments of the invention, on towers without the need to employ personnel to climb the tower, install new antennas and feedlines and incur all the expenses related thereto. In one or more embodiments of the invention, coupling an embodiment of the invention with at least one cell phone transmitter source enables more efficient utilization of tower antennas. For example, embodiments of the invention enable use of PCS and GSM services using the same antenna without the need to add a separate antenna on a tower.

Another need for the present invention relates to high power transmitters that benefit from operation over large frequency bands. Presently, there is an important application that falls under this description: wideband jamming transmitters utilized to defeat remotely-controlled improvised explosive devices (IEDs). These jammers must operate over all known cellular telephone bands, as well as other bands where remote control devices operate. Embodiments of the invention provide for extremely wideband operation, and most importantly, do so with great efficiency since these embodiments do not utilize dielectric loading materials nor resistive materials that sacrifice power in the interest of wide impedance bandwidth. The present invention may be made of perfect electrical conductor (PEC), and still display its wideband characteristics.

BRIEF DESCRIPTION OF THE DRAWINGS

The above and other aspects, features and advantages of the invention will be more apparent from the following more particular description thereof, presented in conjunction with the following drawings wherein:

FIG. 66 shows a side drawing with annotations depicting the various dimensions of the MFD and on the bottom of the page a circuit equivalent of the MFD.

FIG. 85 shows a front view of a corner reflector with the planar embodiment of FIG. 75.

FIG. 86 shows a perspective view of a corner reflector with the planar embodiment of FIG. 75.

FIG. 87 shows a top view of a corner reflector with the planar embodiment of FIG. 75.

DETAILED DESCRIPTION

A multi-feed antenna and method will now be described. In the following exemplary description numerous specific details are set forth in order to provide a more thorough understanding of embodiments of the invention. It will be apparent, however, to an artisan of ordinary skill that the present invention may be practiced without incorporating all aspects of the specific details described herein. In other instances, specific features, quantities, or measurements well known to those of ordinary skill in the art have not been described in detail so as not to obscure the invention. Readers should note that although examples of the invention are set forth herein, the claims, and the full scope of any equivalents, are what define the metes and bounds of the invention.

One or more embodiments of the invention are directed to a multi-feed dipole antenna and method. The antenna provides wide radiation pattern bandwidth and wide impedance bandwidth. Driving the dipole at multiple locations provides for a half wavelength dipole which outperforms larger devices over a similar frequency range. The apparatus is constructed from brass or any other suitable metal without requiring dielectric loading and without requiring direct coupling on the outside of the tubes. The apparatus utilizes a parasitic center tube with two end tubes that are driven by a collinearly mounted metal rod that is driven from the midpoint. Insulators hold the parasitic tube to the end tubes. The parasitic tube allows for induced currents to flow on the surface of the tube which allow for operation of the dipole over a wide frequency range.

Figure 1:
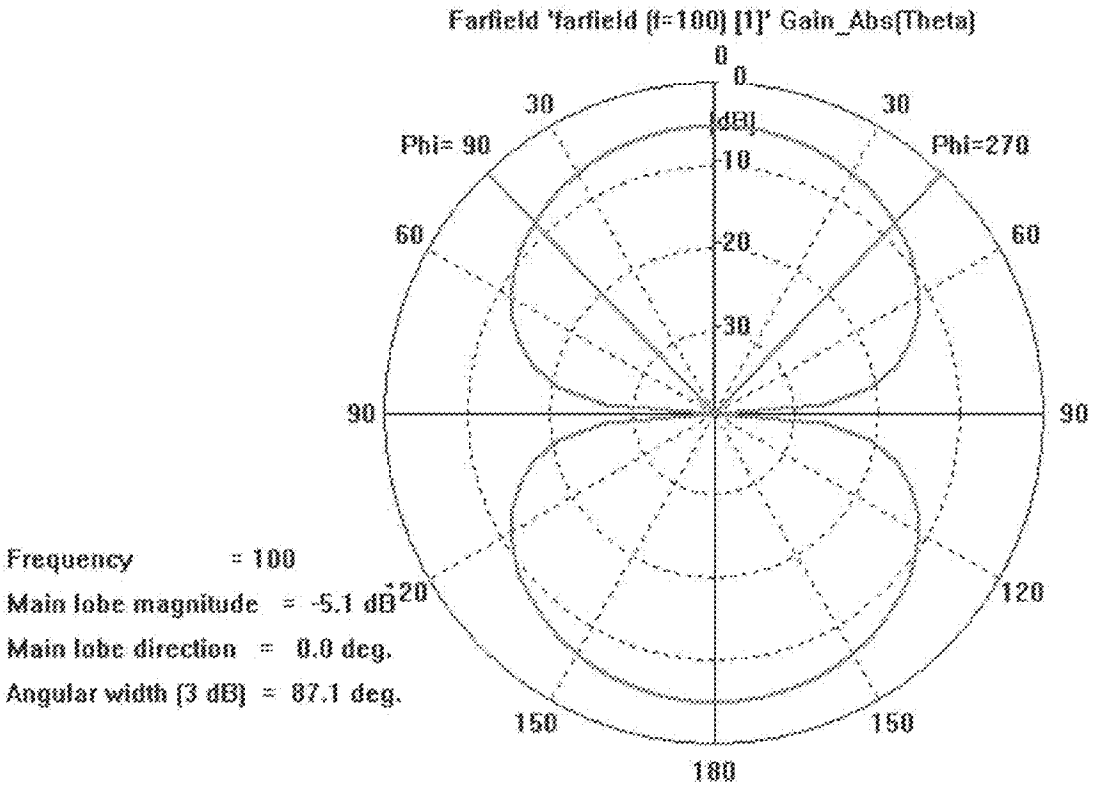
FIG. 1 is a polar radiation pattern for a 1.75-in. diameter, approximately 26-in. long fat dipole ("basic dipole") at 100 MHz.
Figure 2:
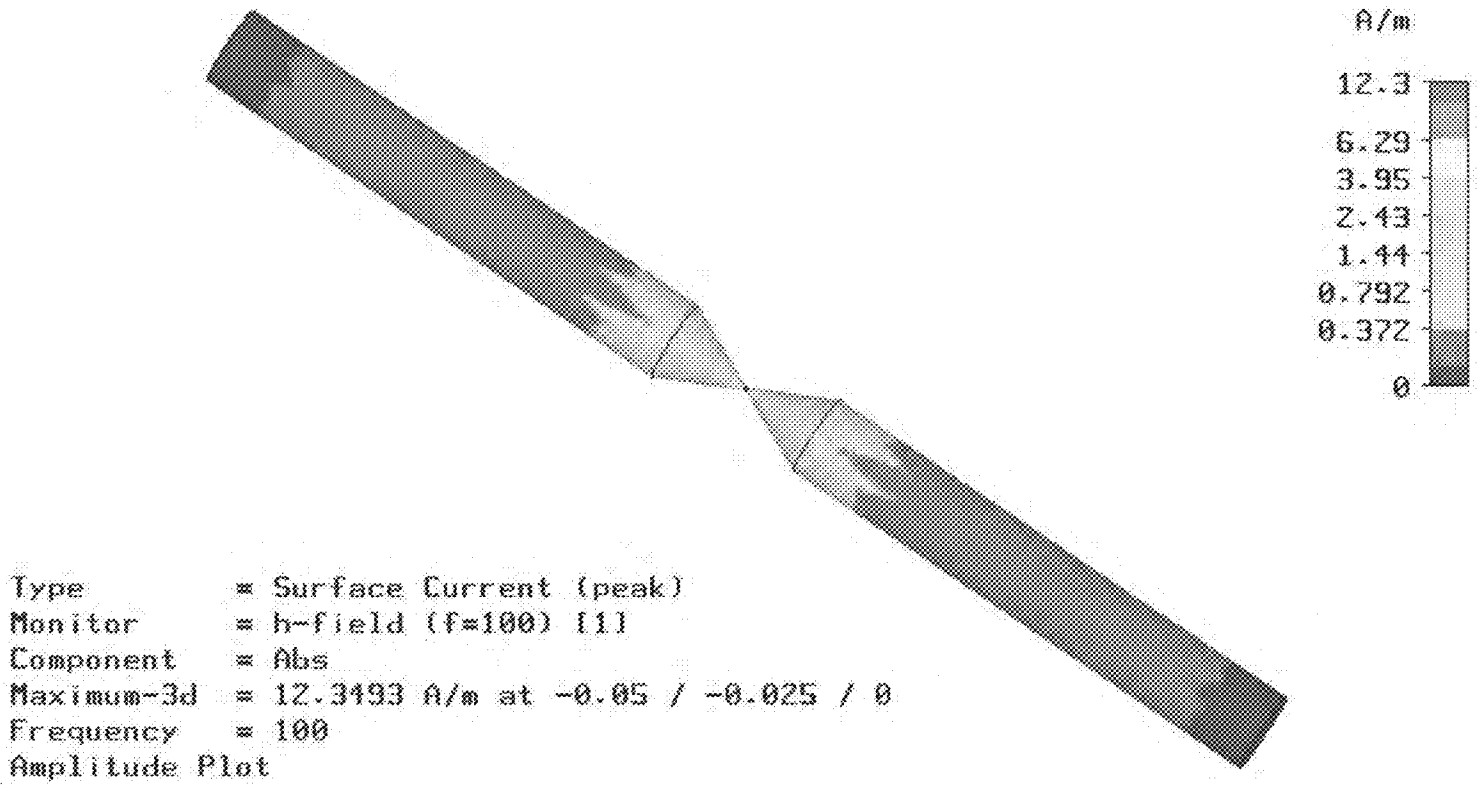
FIG. 2 is a basic dipole surface current plot at 100 MHz.
Figure 3:
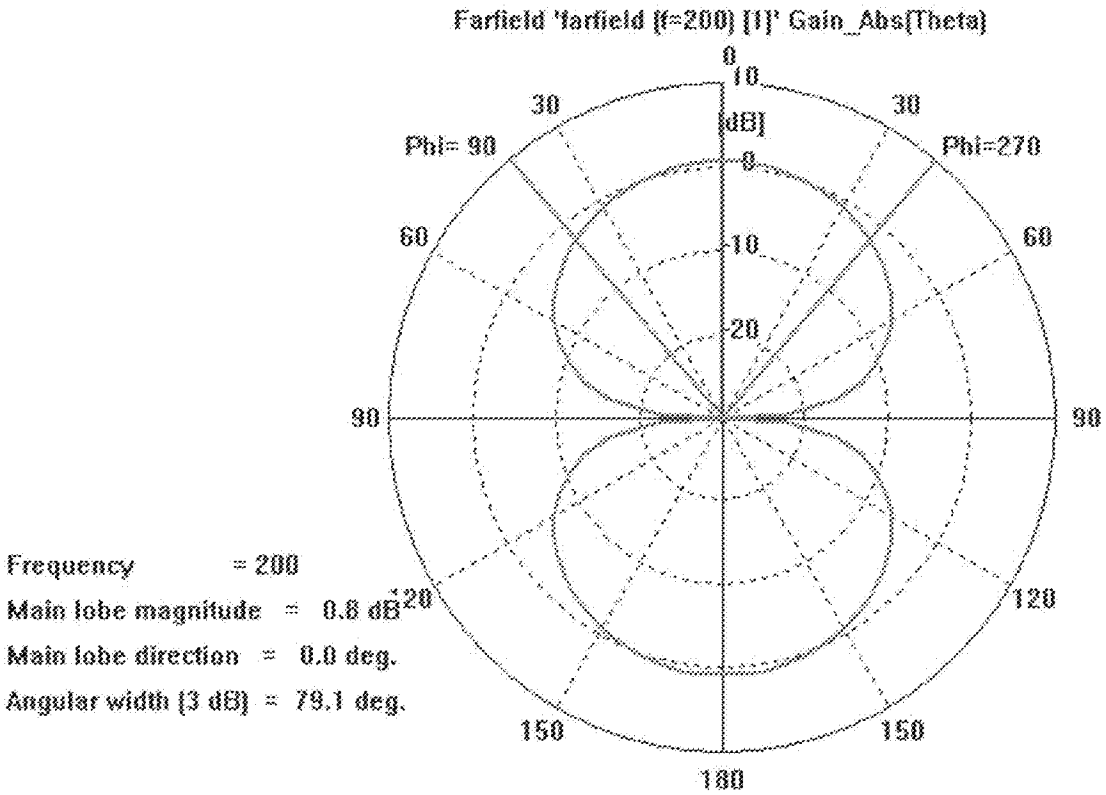
FIG. 3 is a polar radiation pattern for a basic dipole at 200 MHz.
Figure 4:
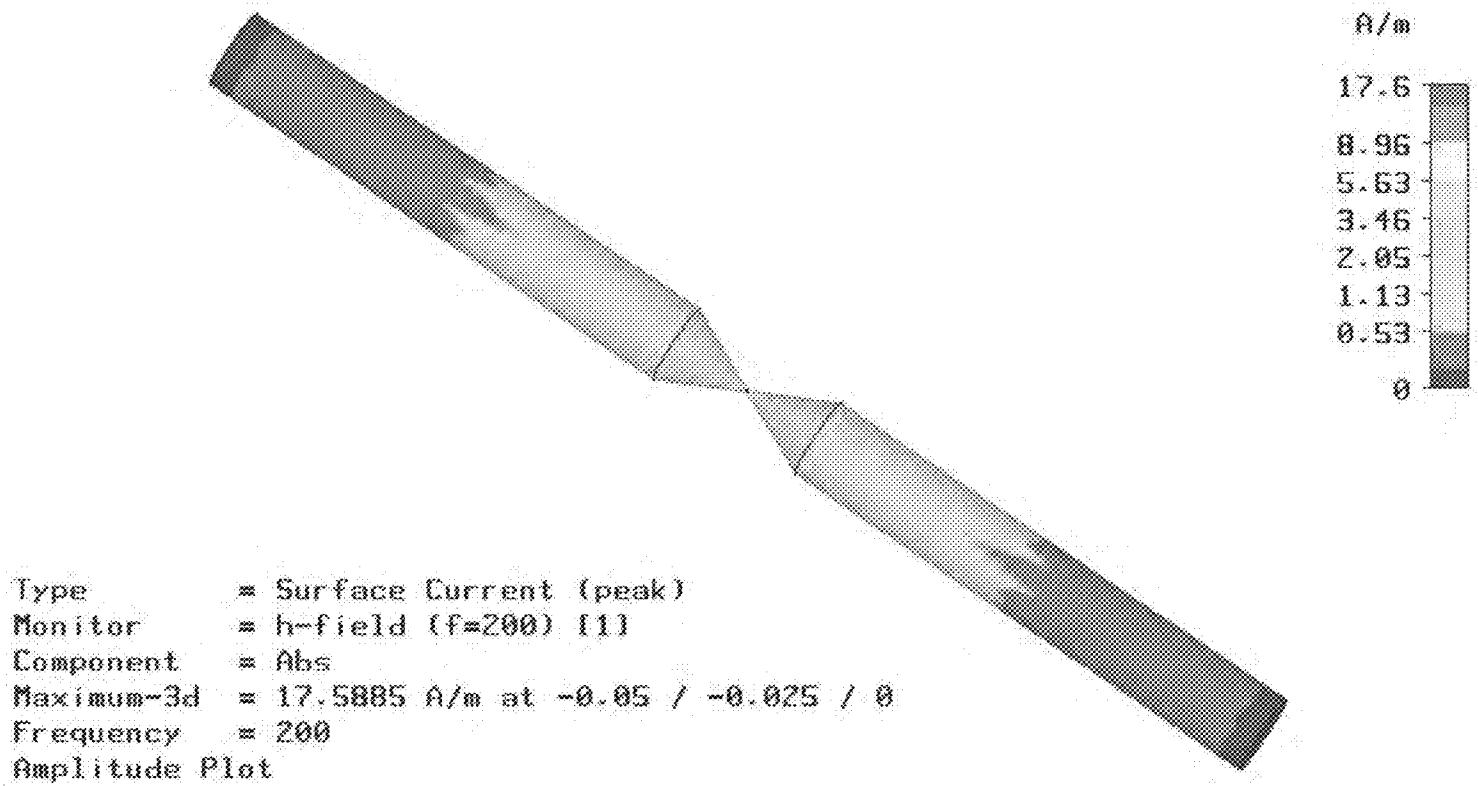
FIG. 4 is a basic dipole surface current plot at 200 MHz.
Figure 5:
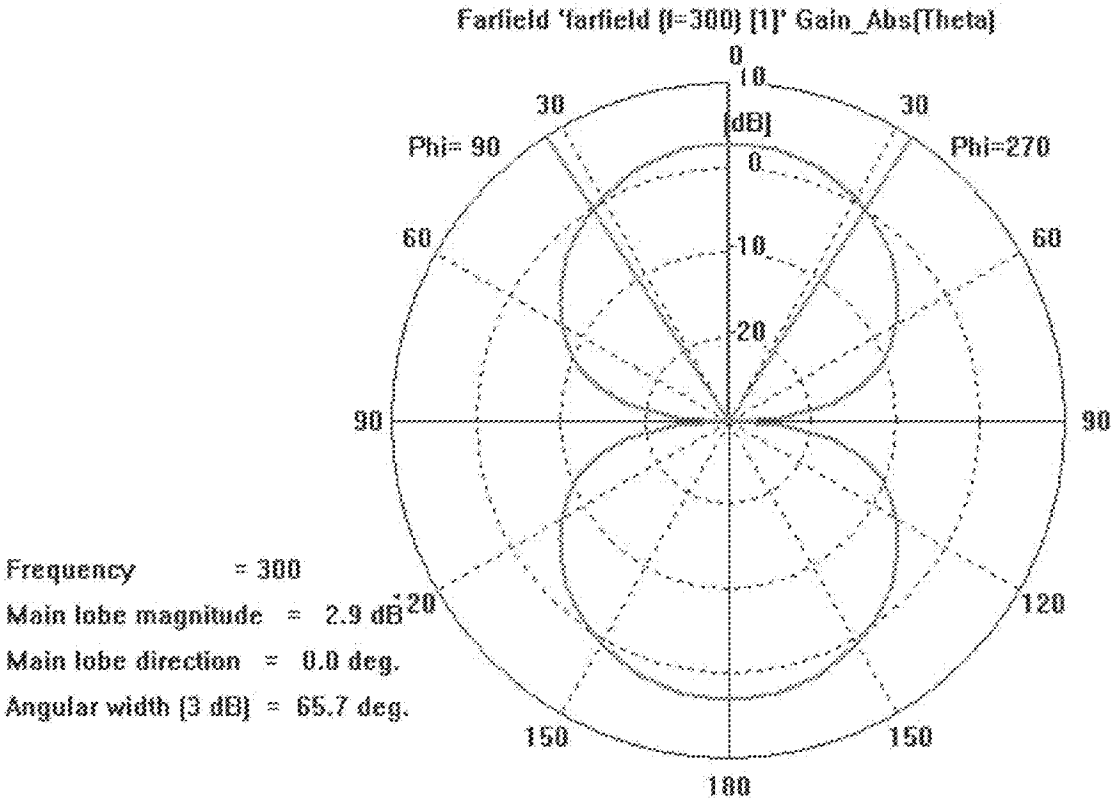
FIG. 5 is a polar radiation pattern for a basic dipole at 300 MHz.
Figure 6:
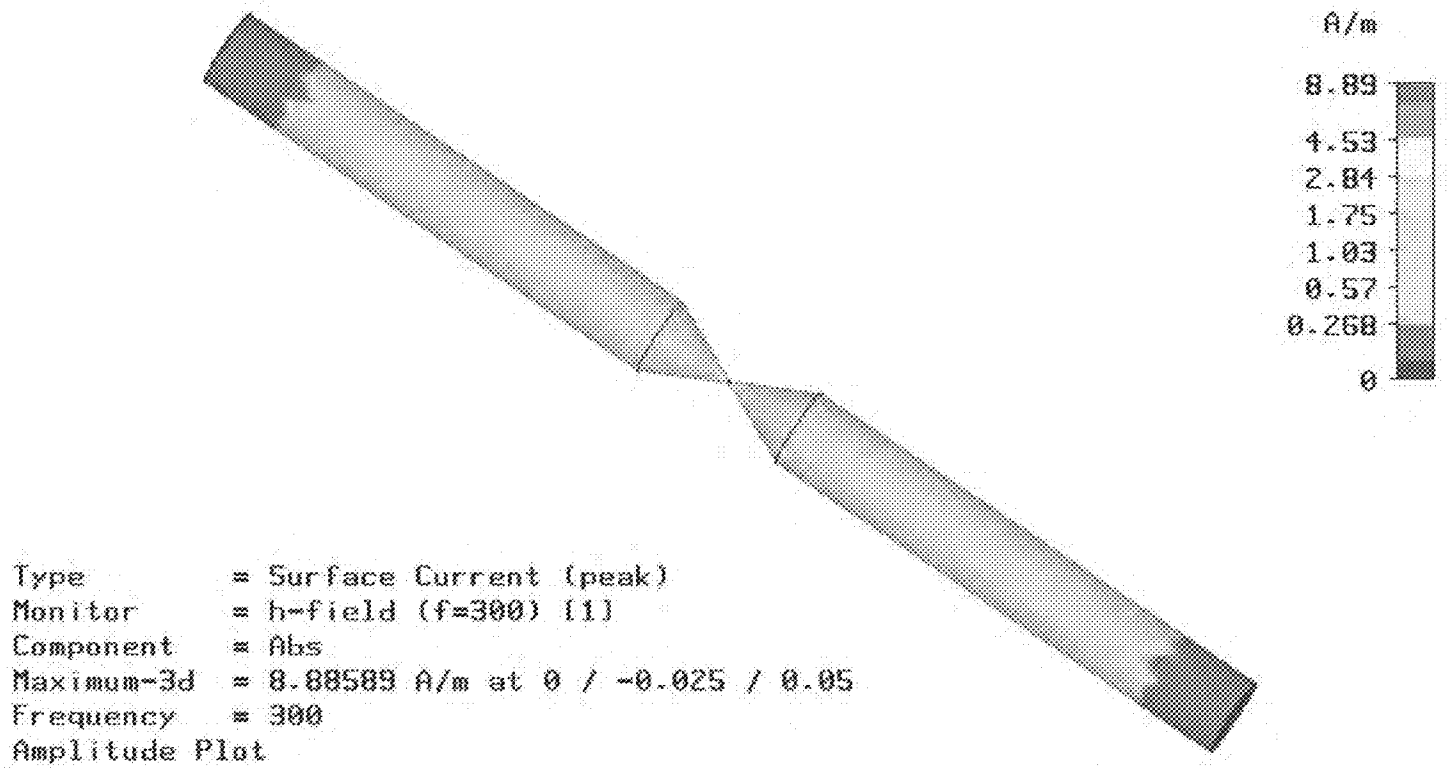
FIG. 6 is a basic dipole surface current plot at 300 MHz.
Figure 7:
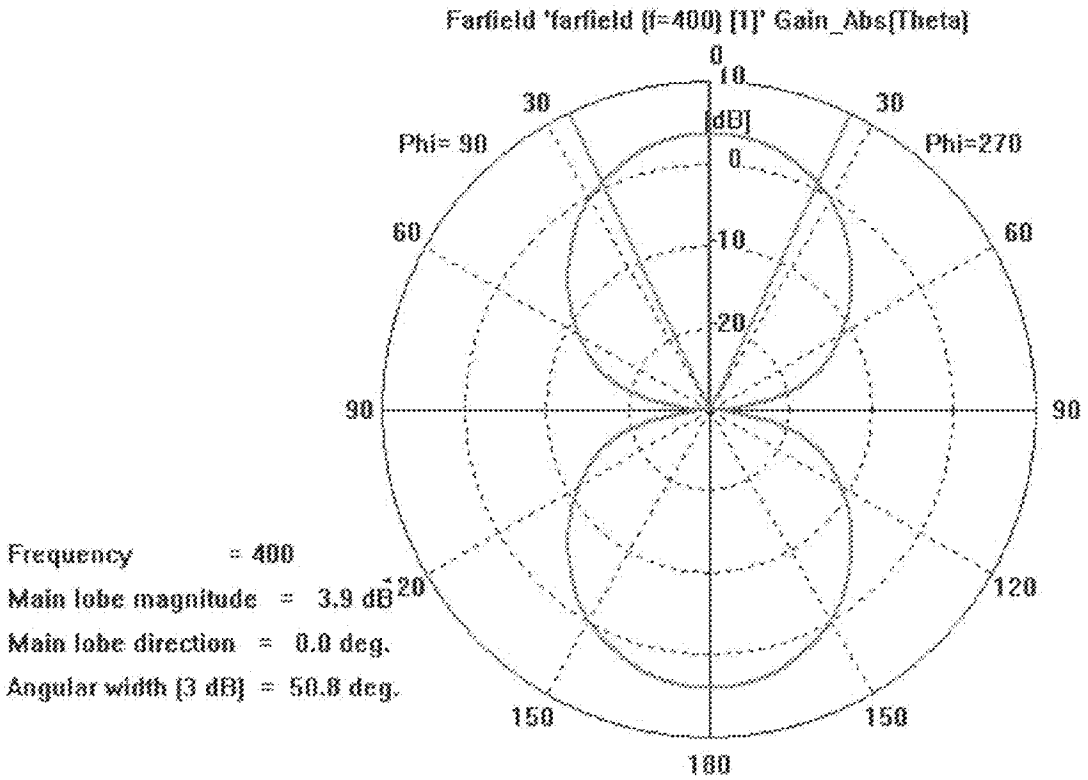
FIG. 7 is a polar radiation pattern for a basic dipole at 400 MHz.
Figure 8:
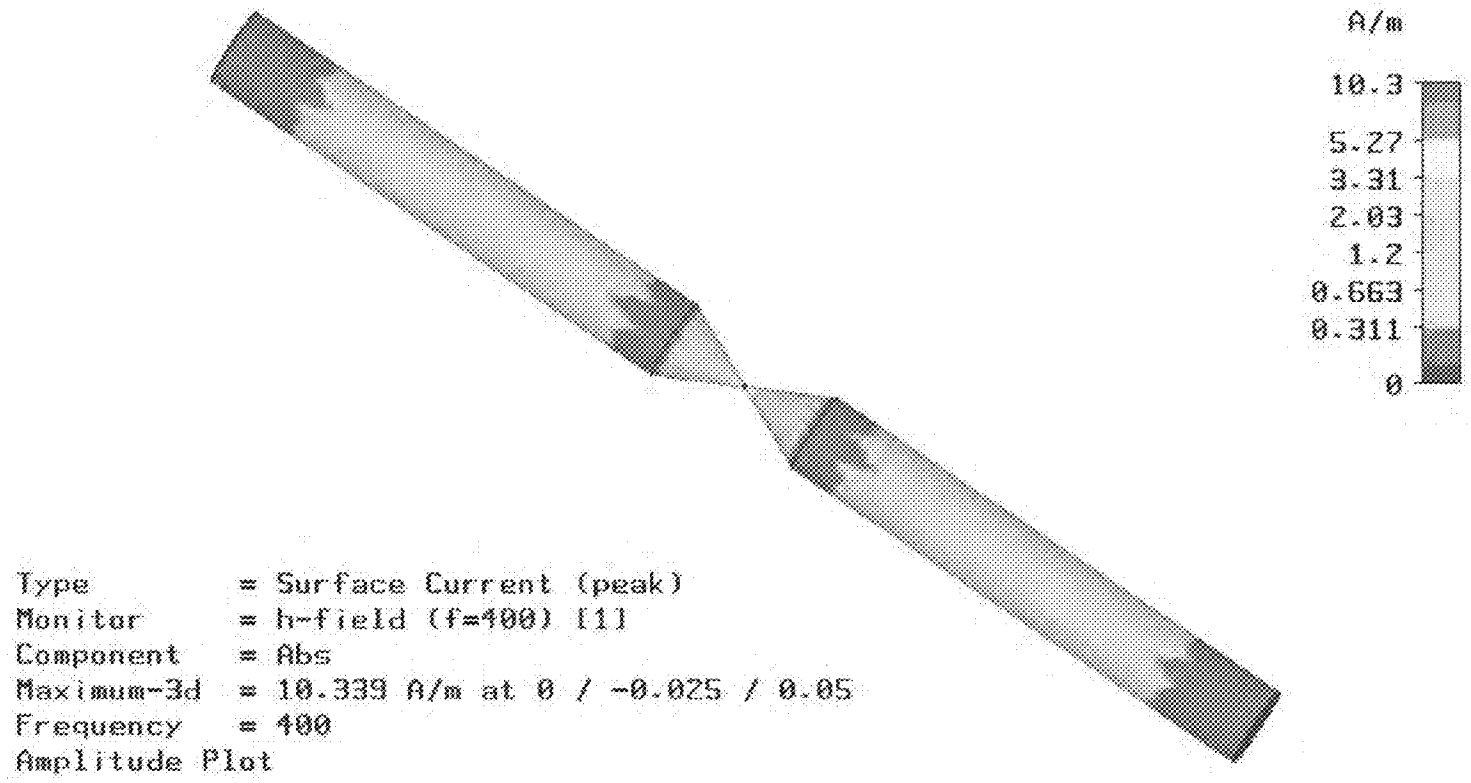
FIG. 8 is a basic dipole surface current plot at 400 MHz.
Figure 9:
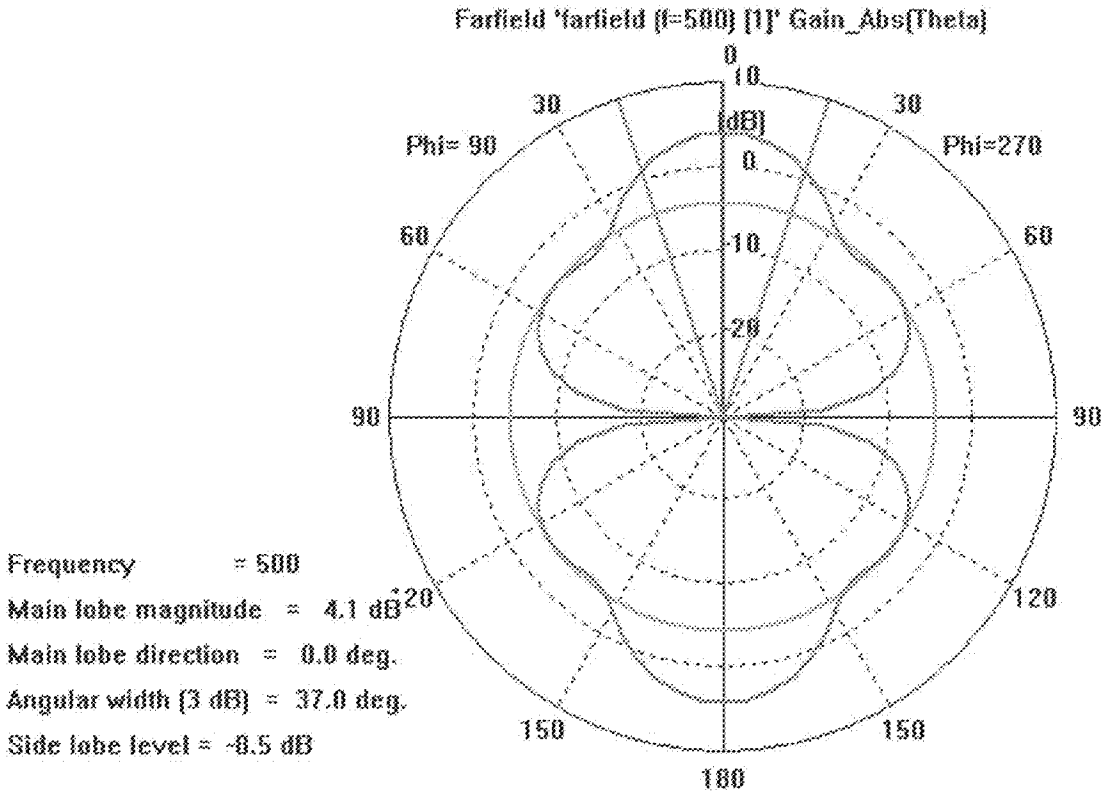
FIG. 9 is a polar radiation pattern for a basic dipole at 500 MHz.
Figure 10:
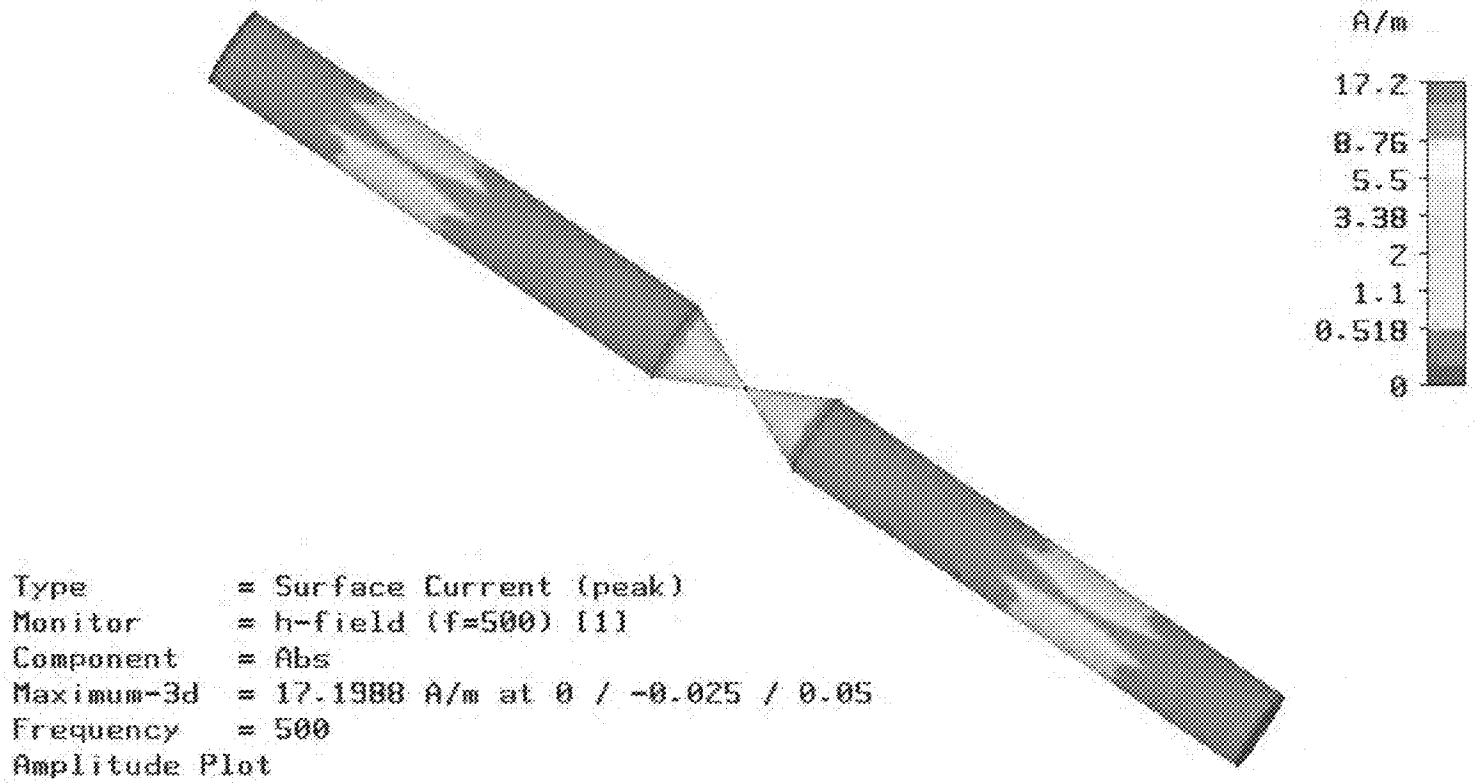
FIG. 10 is a basic dipole surface current plot at 500 MHz.
Figure 11:
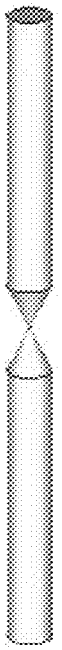
FIG. 11 is a basic dipole three-dimensional drawing.
Figure 12:
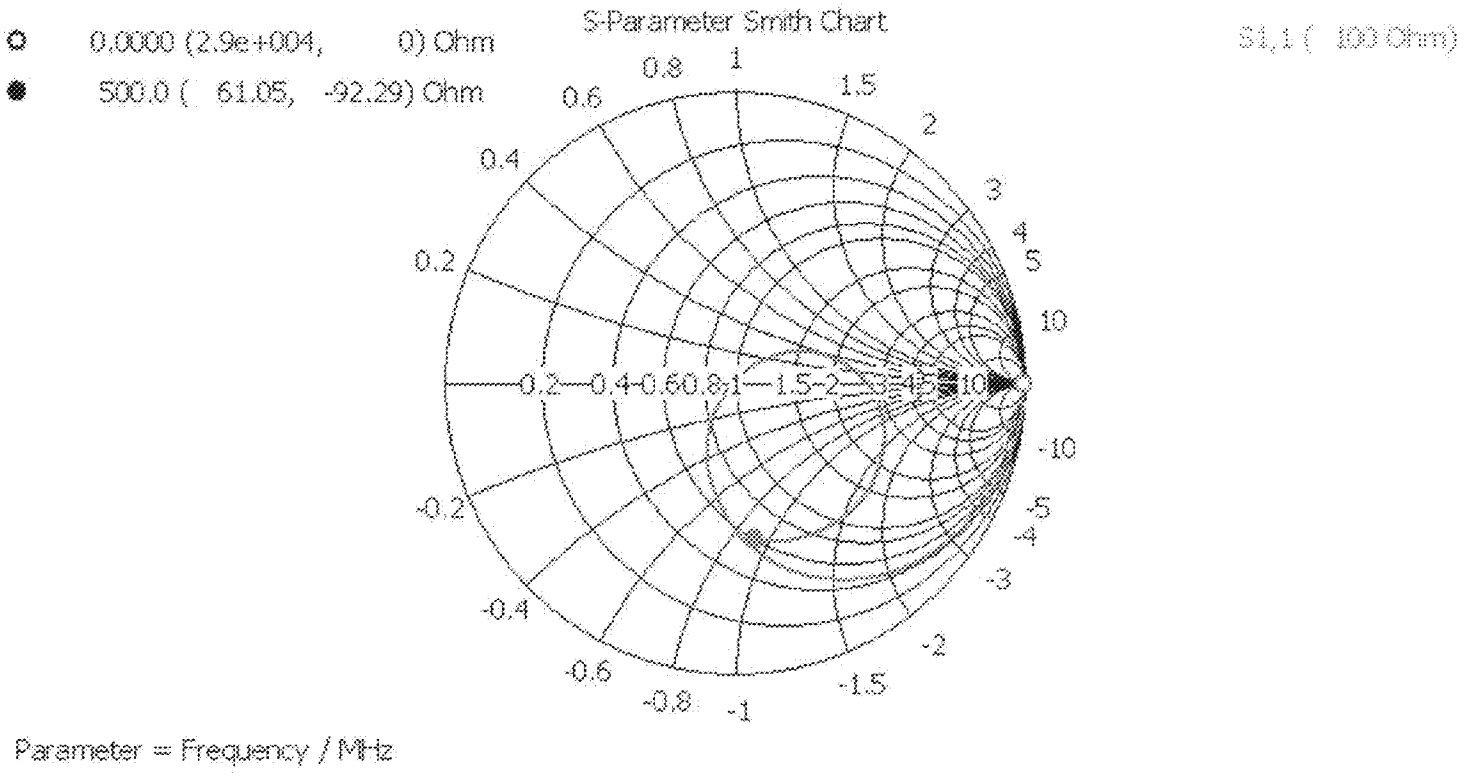
FIG. 12 is a basic dipole input impedance Smith Chart referred to 100 ohms.
Figure 13:
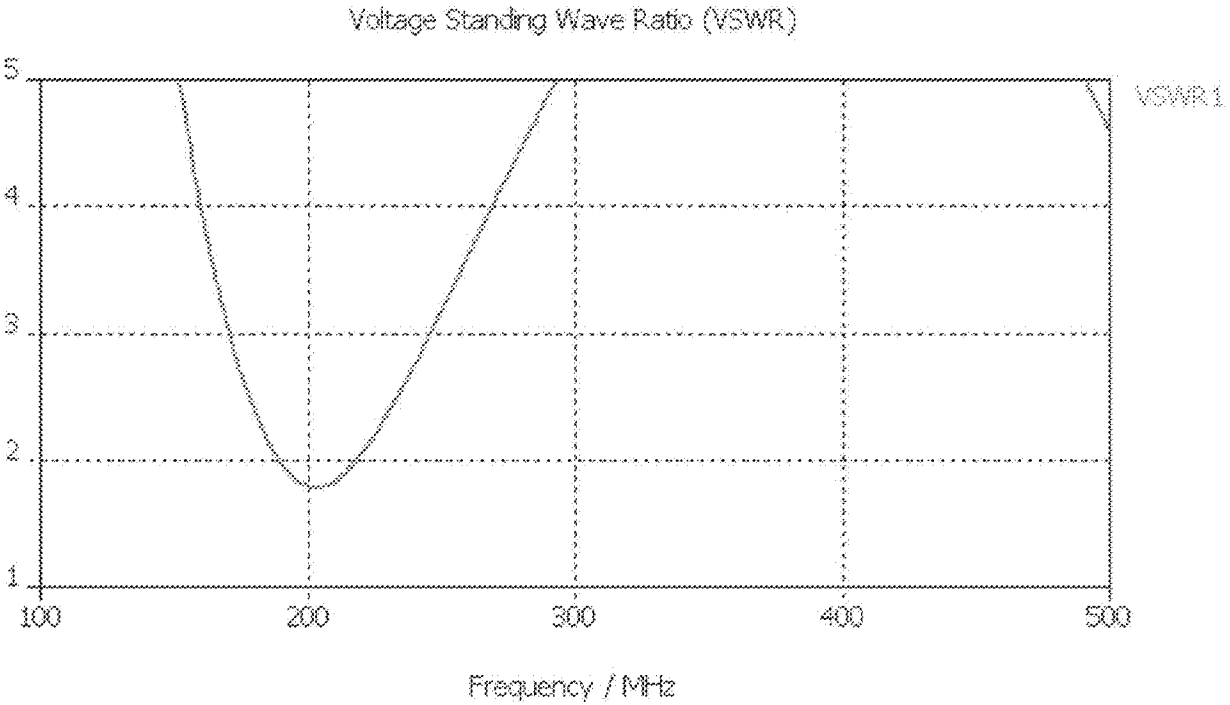
FIG. 13 is a basic dipole standing wave ratio plot referenced to 50 ohms.

FIG. 1 is a polar radiation pattern for a 1.75-in. diameter, approximately 26-in. long dipole ("basic dipole") at 100 MHz. This is an example of a basic related art device. FIG. 2 is a basic dipole surface current plot at 100 MHz. FIG. 3 is a polar radiation pattern for a basic dipole at 200 MHz. FIG. 4 is a basic dipole surface current plot at 200 MHz. FIG. 5 is a polar radiation pattern for a basic dipole at 300 MHz. FIG. 6 is a basic dipole surface current plot at 300 MHz. FIG. 7 is a polar radiation pattern for a basic dipole at 400 MHz. FIG. 8 is a basic dipole surface current plot at 400 MHz. FIG. 9 is a polar radiation pattern for a basic dipole at 500 MHz. FIG. 10 is a basic dipole surface current plot at 500 MHz. FIG. 11 is a basic dipole three-dimensional drawing. FIG. 12 is a basic dipole input impedance Smith Chart referred to 100 ohms. FIG. 13 is a basic dipole standing wave ratio plot referenced to 50 ohms.

Figure 14:
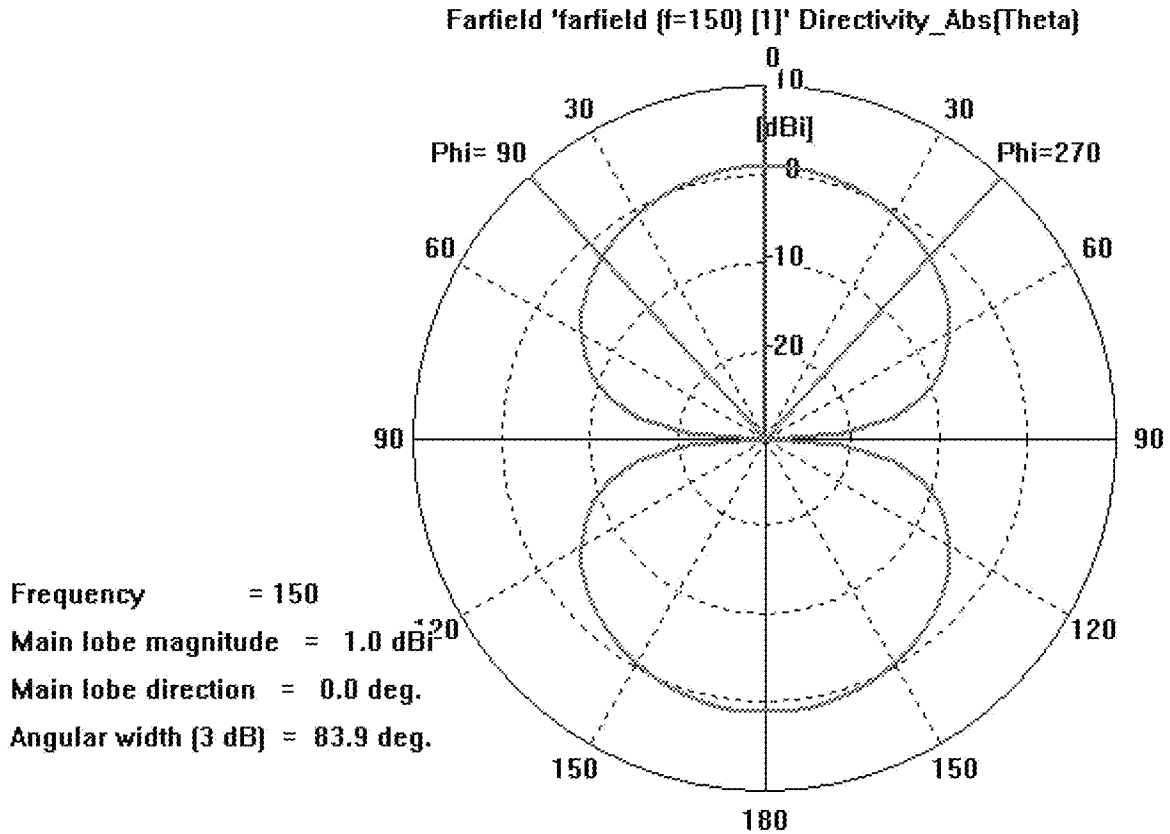
FIG. 14 is a 1.75-in. diameter, approximately 26-in. long multi-feed dipole (MFD) polar pattern at 150 MHz.
Figure 15:
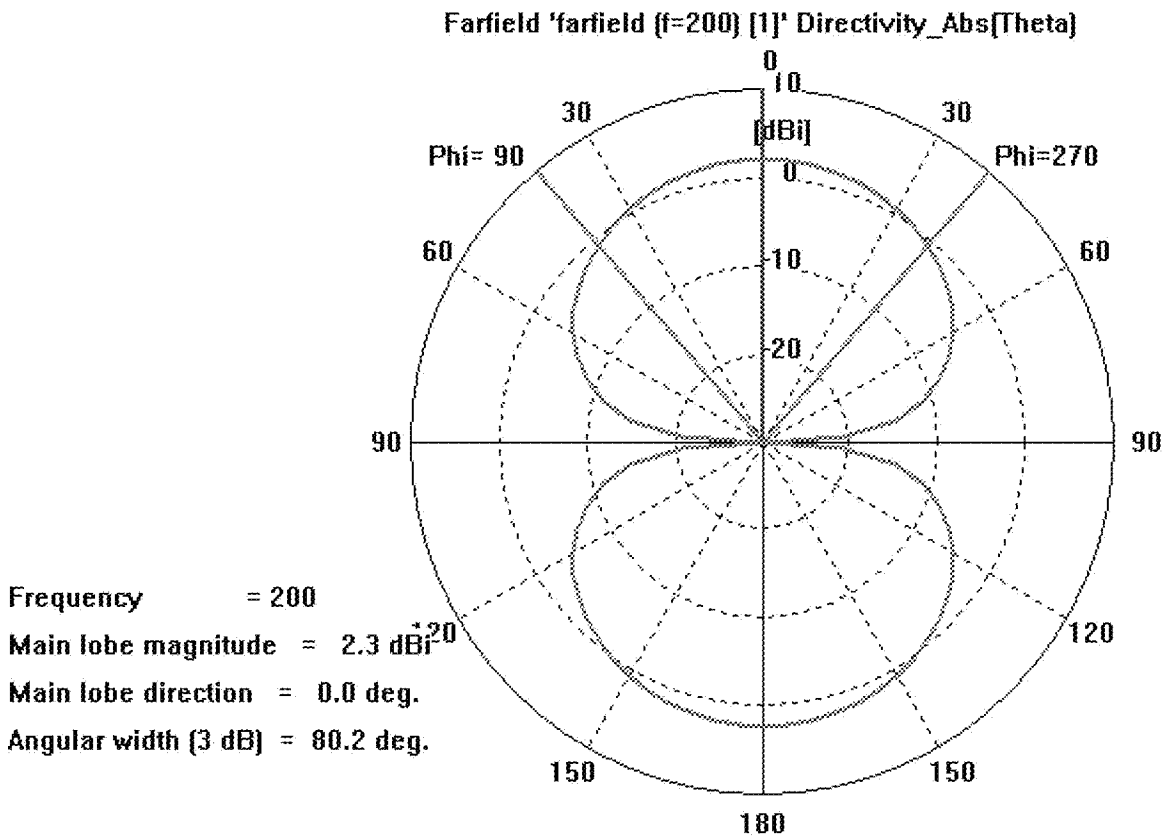
FIG. 15 is a polar radiation pattern for a multi-feed dipole embodiment at 200 MHz.
Figure 16:
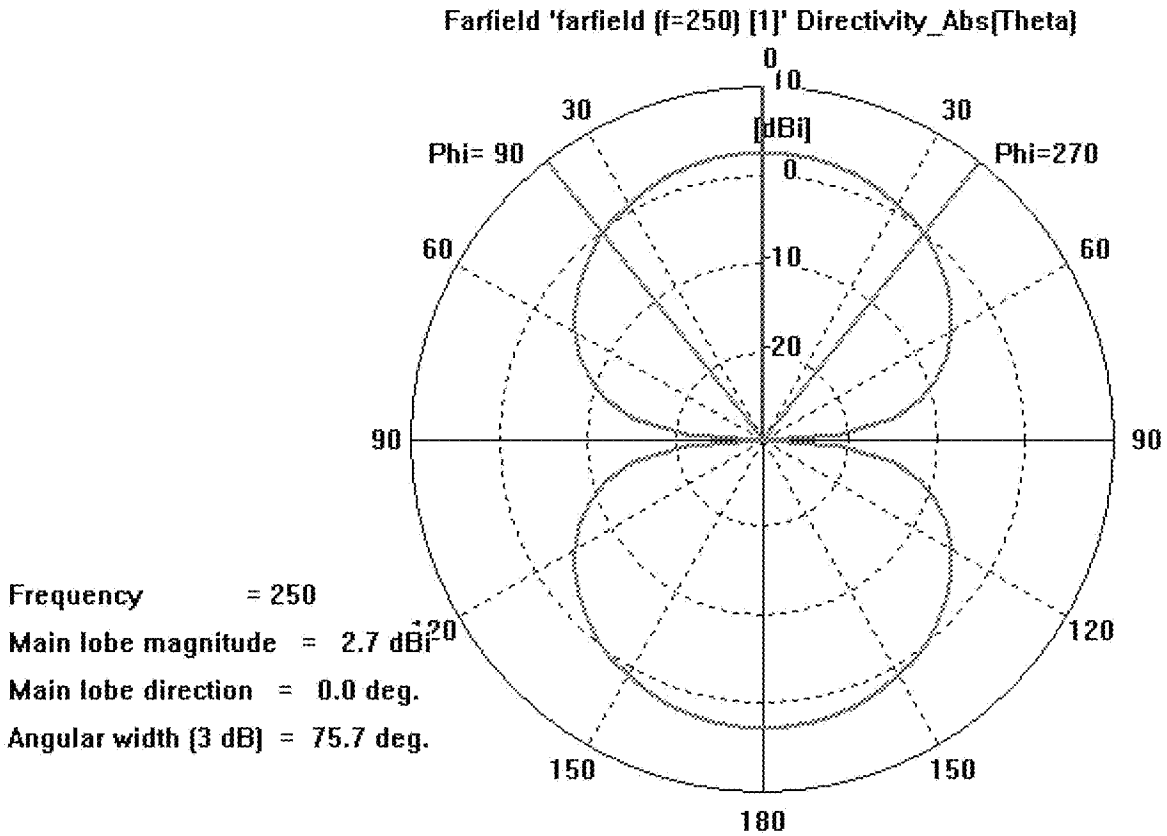
FIG. 16 is a polar radiation pattern for a multi-feed dipole embodiment at 250 MHz.
Figure 17:
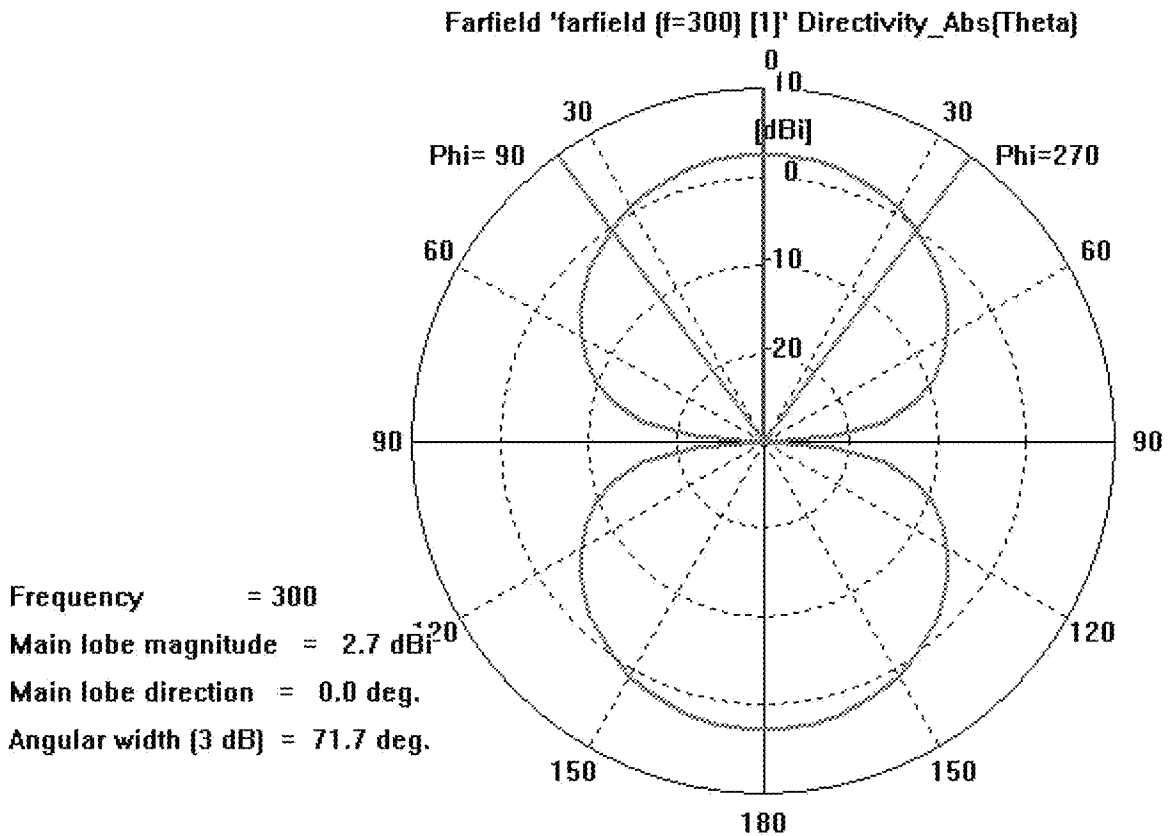
FIG. 17 is a polar radiation pattern for a multi-feed dipole embodiment at 300 MHz.
Figure 18:
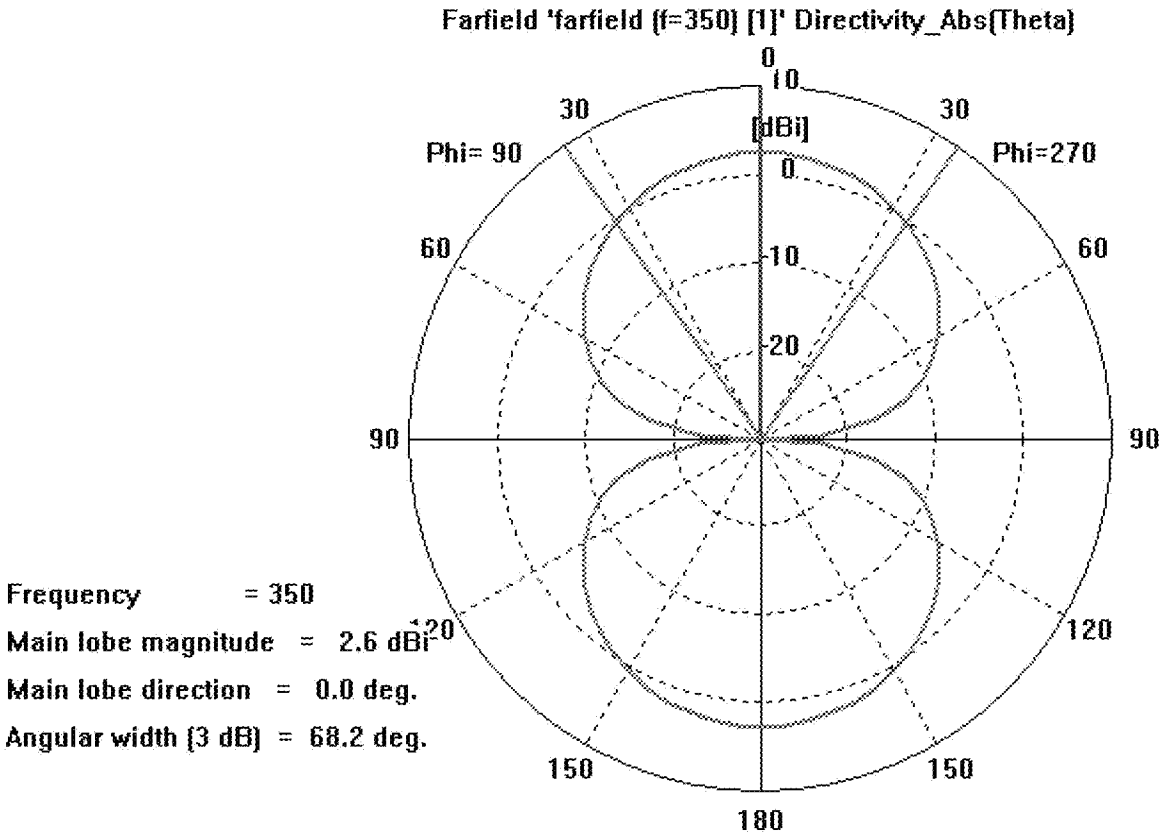
FIG. 18 is a polar radiation pattern for a multi-feed dipole embodiment at 350 MHz.
Figure 19:
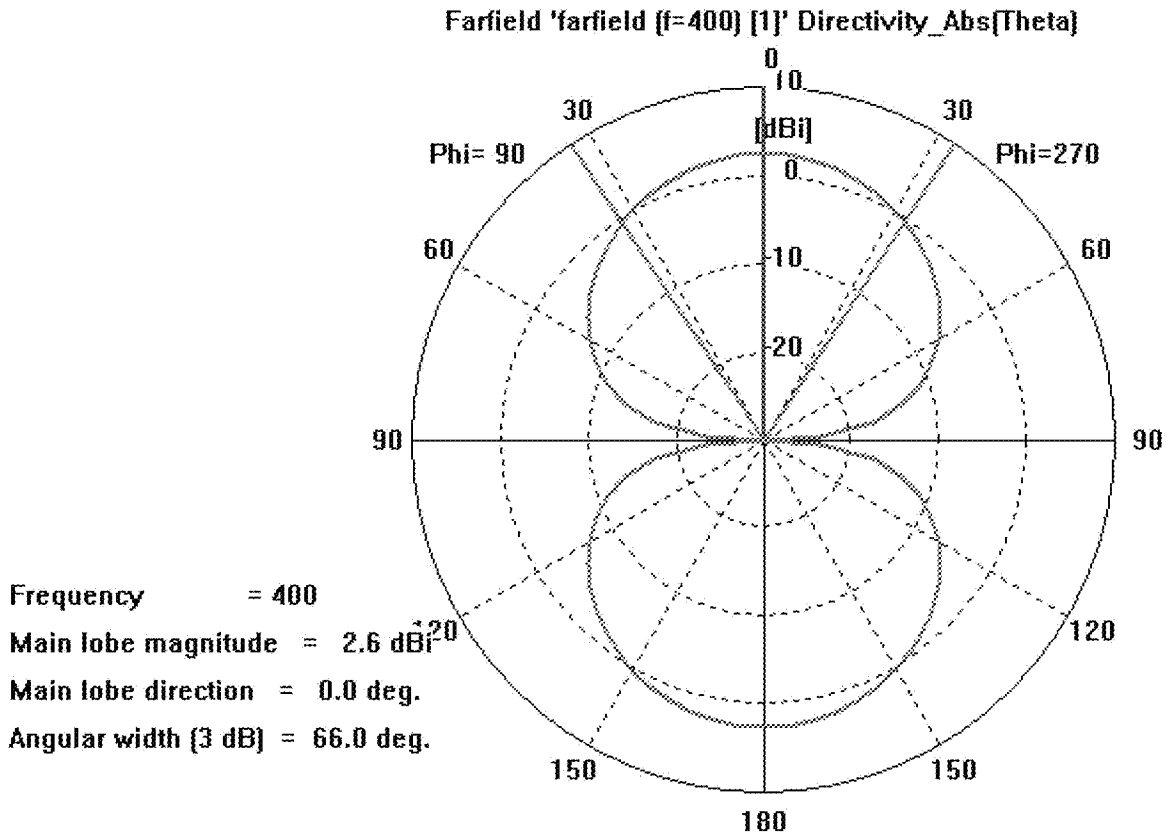
FIG. 19 is a polar radiation pattern for a multi-feed dipole embodiment at 400 MHz.
Figure 20:
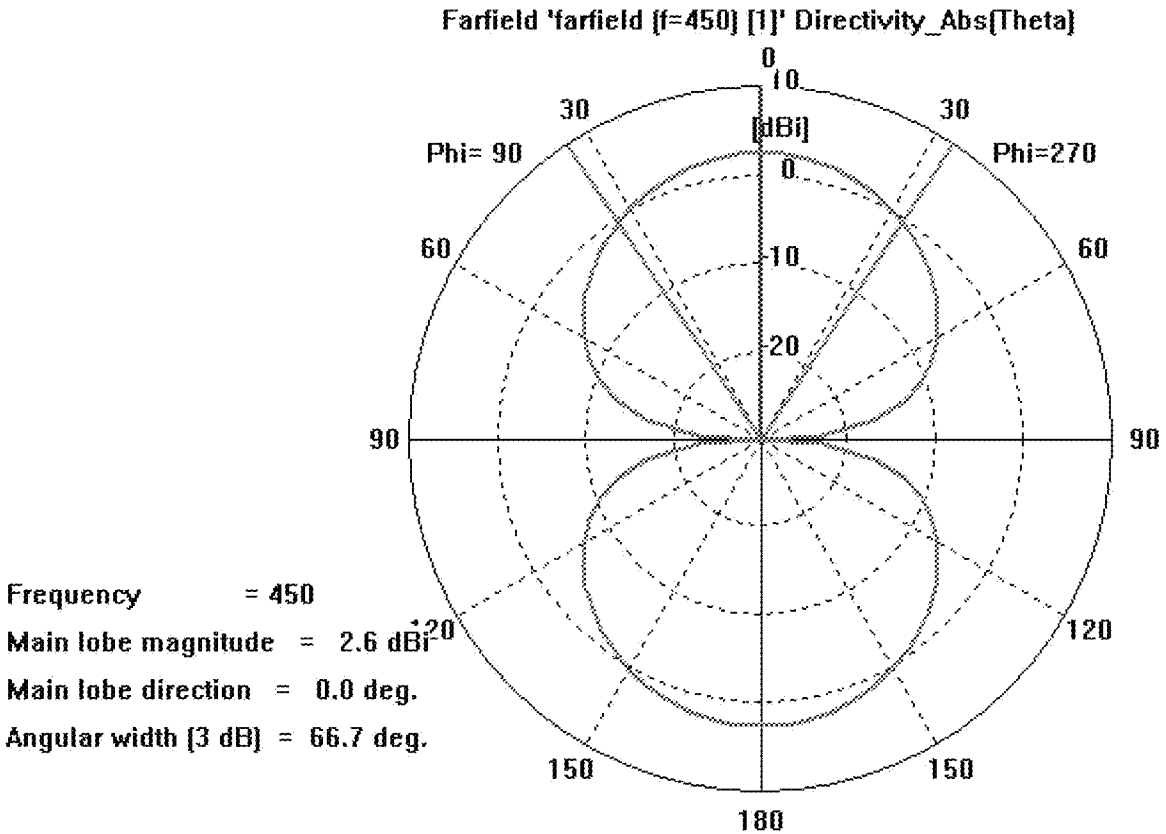
FIG. 20 is a polar radiation pattern for a multi-feed dipole embodiment at 450 MHz.

FIG. 14 is a 1.75-in. diameter, approximately 26-in. long multi-feed dipole (MFD) polar pattern at 150 MHz. This is referred to herein as the first embodiment of the invention. FIG. 15 is a polar radiation pattern for a multi-feed dipole embodiment at 200 MHz. FIG. 16 is a polar radiation pattern for a multi-feed dipole embodiment at 250 MHz. FIG. 17 is a polar radiation pattern for a multi-feed dipole embodiment at 300 MHz. FIG. 18 is a polar radiation pattern for a multi-feed dipole embodiment at 350 MHz. FIG. 19 is a polar radiation pattern for a multi-feed dipole embodiment at 400 MHz. FIG. 20 is a polar radiation pattern for a multi-feed dipole embodiment at 450 MHz.

Figure 21:
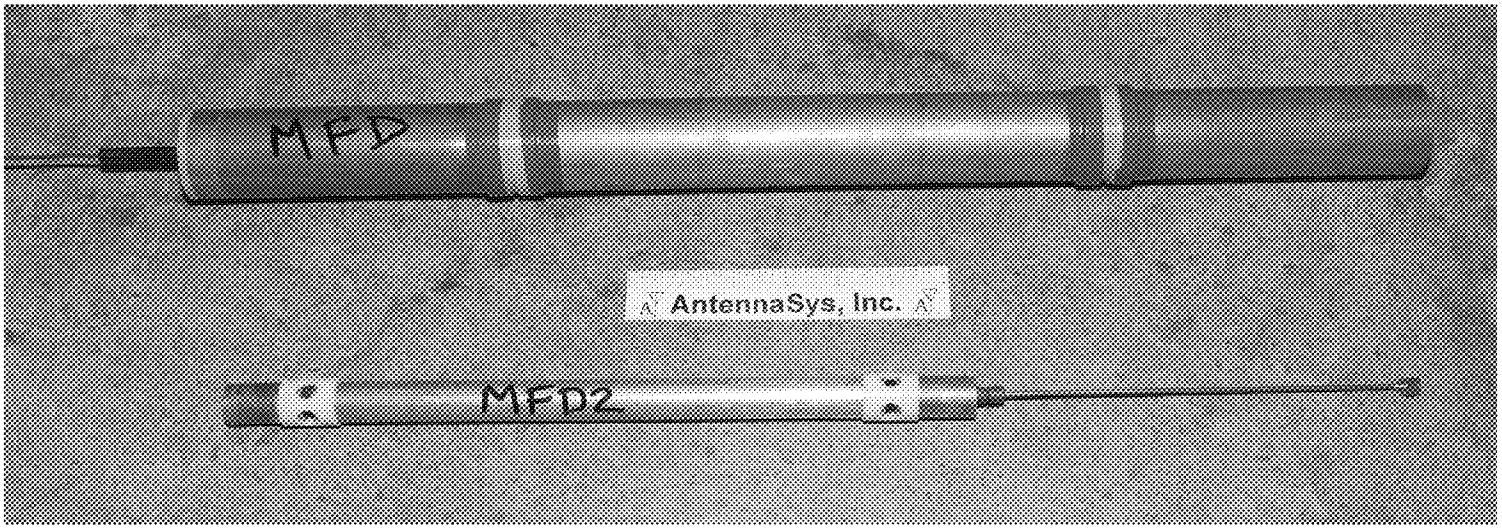
FIG. 21 is a picture of two implementations of the invention, the Multi-Feed. embodiment (MFD) (top) and the Multi-Feed 2 (MFD2) (bottom).
Figure 73:
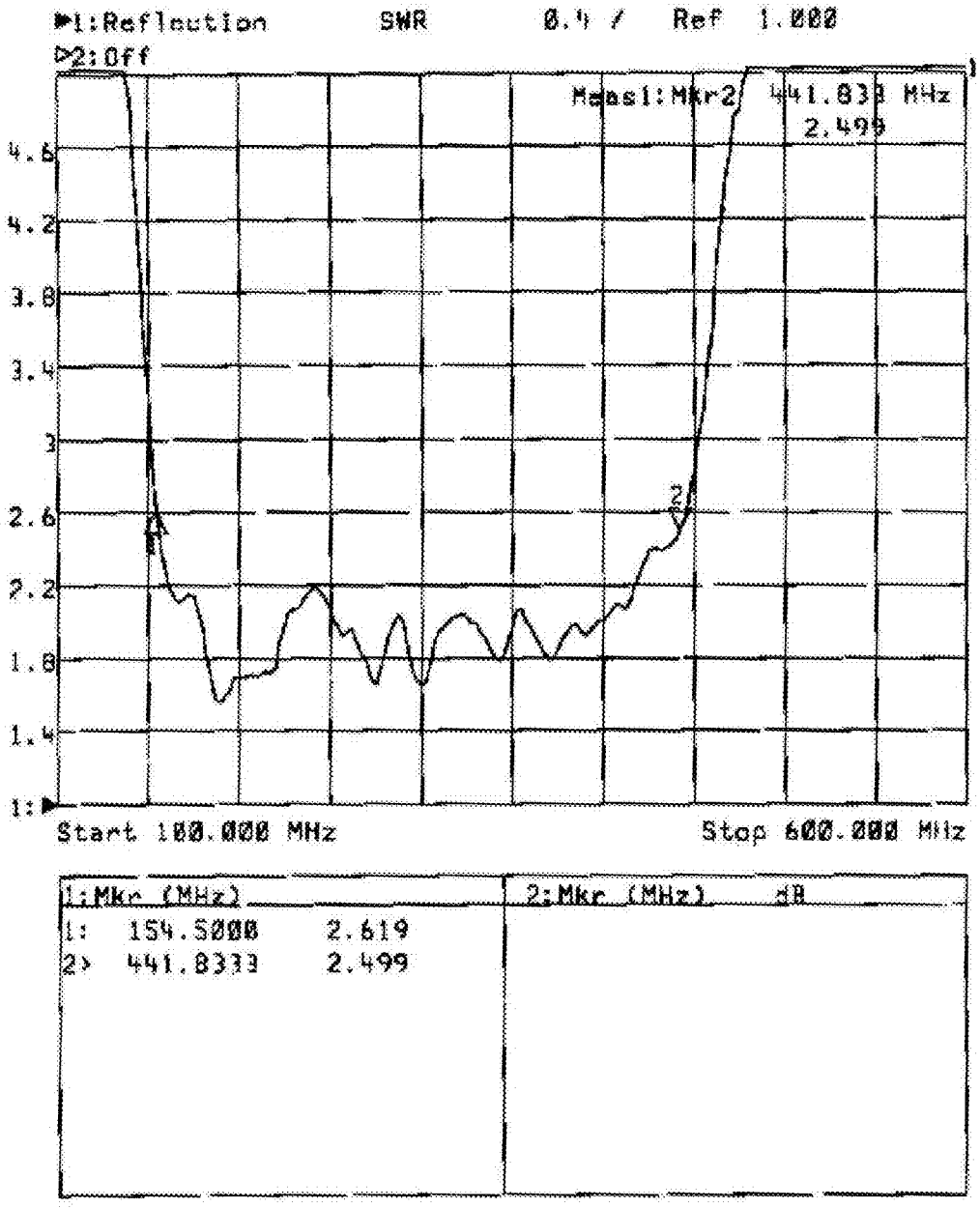
FIG. 73 shows actual performance measurement of the voltage standing wave ratio of the MFD showing operation below an SWR of 2.5:1 from approximately 155 MHz to 442 MHz.
Figure 74:
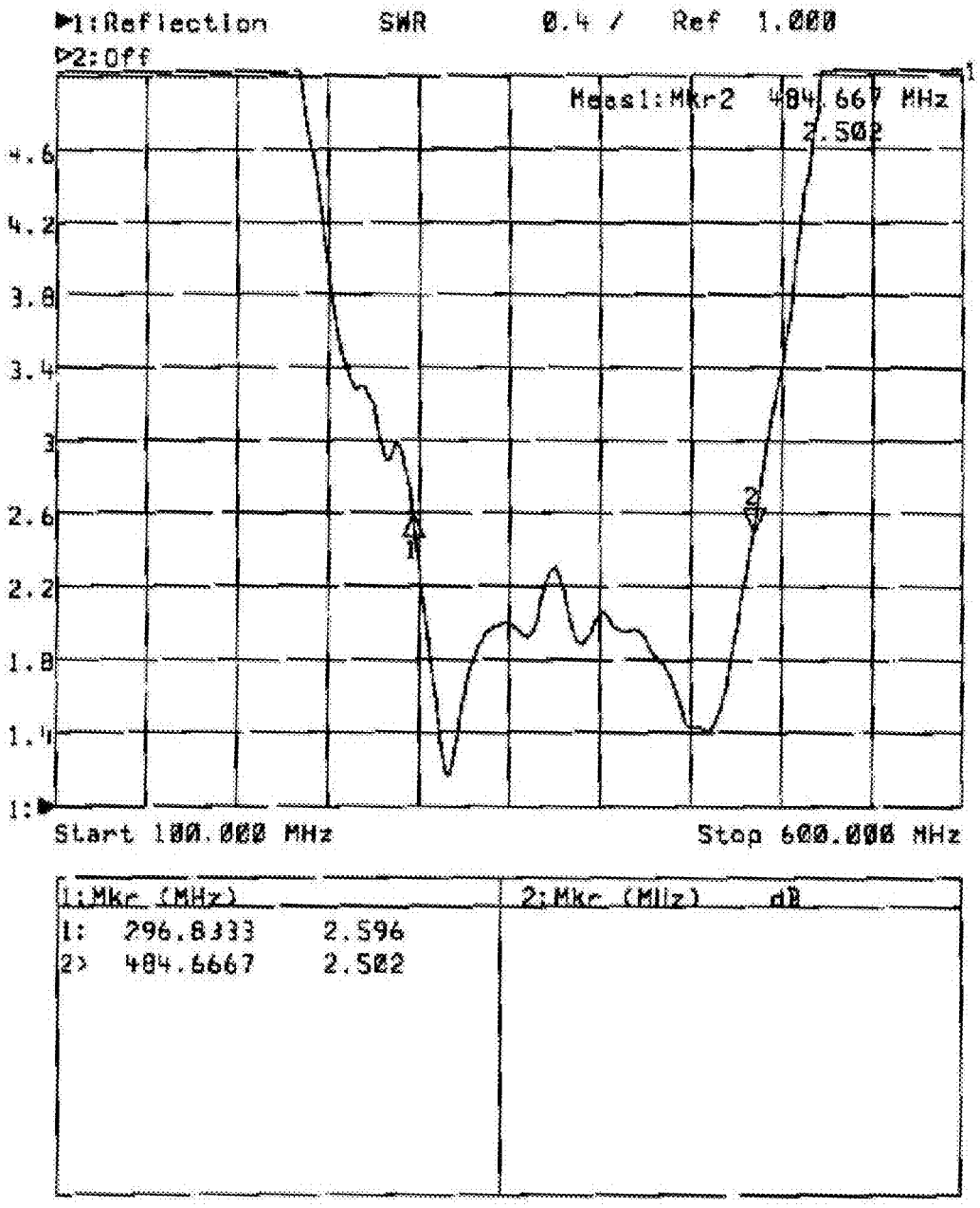
FIG. 74 shows actual performance measurement of the voltage standing wave ratio of the MFD 2 showing operation below an SWR of 2.5:1 from approximately 296 MHz to 485 MHz.

FIG. 21 is a picture of two implementations of the invention, the Multi-Feed embodiment (MFD) (top) and the Multi-Feed 2 (MFD2) (bottom) where "MFD" stands for "Multi-Feed Dipole". Embodiments "MFD" and "MFD2" are roughly one half wavelength long at the lower end of the usable design frequency range. MFD is designed to be housed in a 2-inch outer-diameter FR-4 fiberglass radome with a wall thickness of 0.062-in. The location of the feed gaps on MFD are chosen to optimize the pattern bandwidth and impedance bandwidth over a frequency range of approximately 156 to 430 MHz, about a 2.8:1 frequency ratio. Similarly, MFD2 is designed to be housed in a 1-inch outer-diameter FR-4 fiberglass radome with a wall thickness of 0.062-in. The location of the feed gaps on MFD2 are chosen to optimize the pattern bandwidth and impedance bandwidth over a frequency range of approximately 276 to 474 MHz, about a 1.7:1 frequency ratio. MFD and MFD2 both utilize ferrite beads as a wide-band decoupling method. See FIGS. 73 and 74 for actual performance data recorded from the MFD and MFD 2 embodiments.

Figure 22:
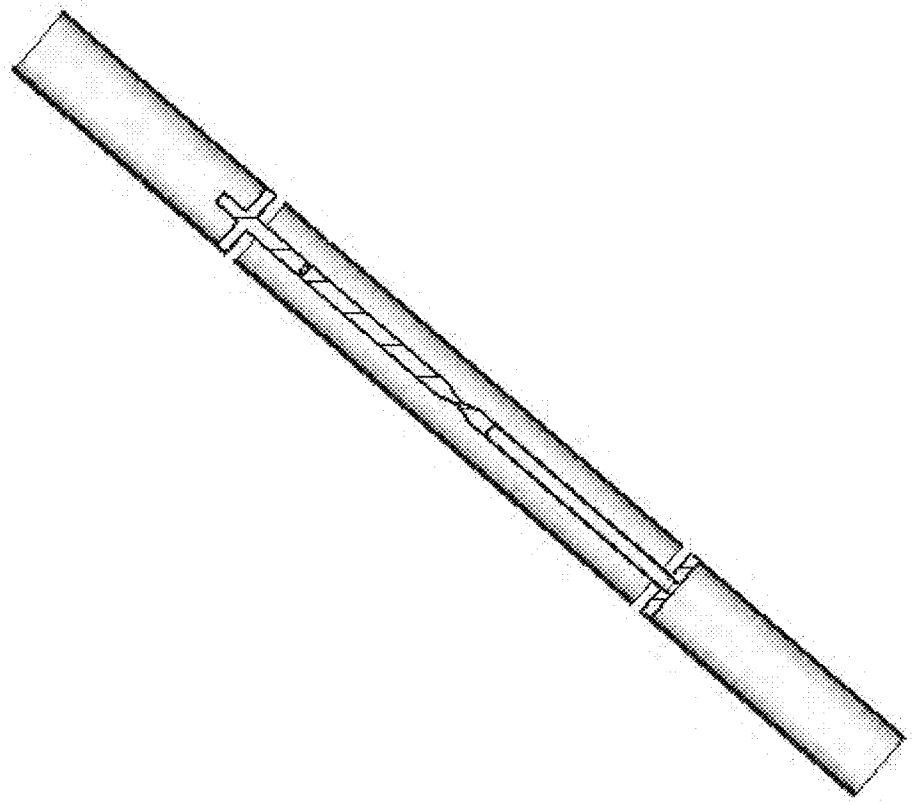
FIG. 22 is a cross section view of the Multi-Feed Dipole (MFD) shown in FIG. 23.
Figure 23:
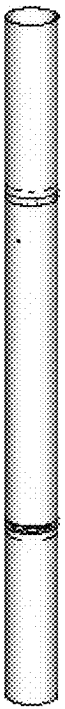
FIG. 23 is an exterior view of the Multi-Feed Dipole (MFD).

FIG. 22 is a cross section view of the Multi-Feed Dipole (MFD) shown in FIG. 23. FIG. 23 is an exterior view of the Multi-Feed Dipole (MFD).

Figure 24:
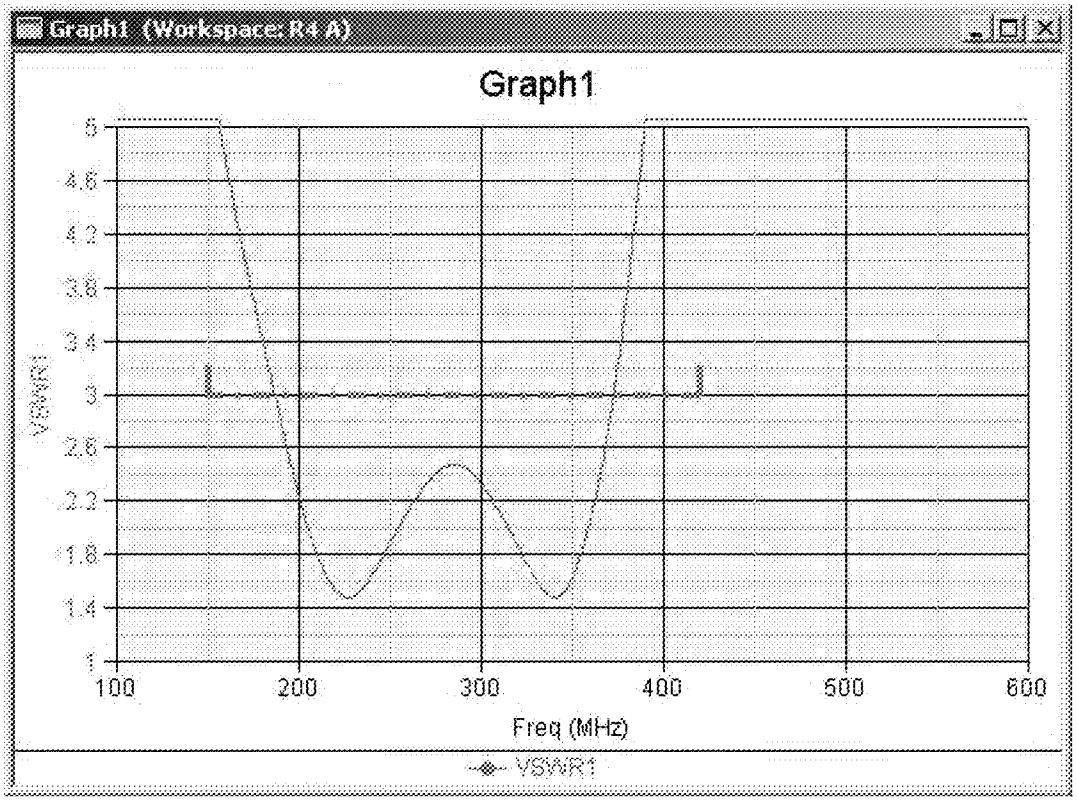
FIG. 24 is a voltage standing wave ratio chart for the MFD with an integral 75-ohm quarter-wave matching transformer.
Figure 25:
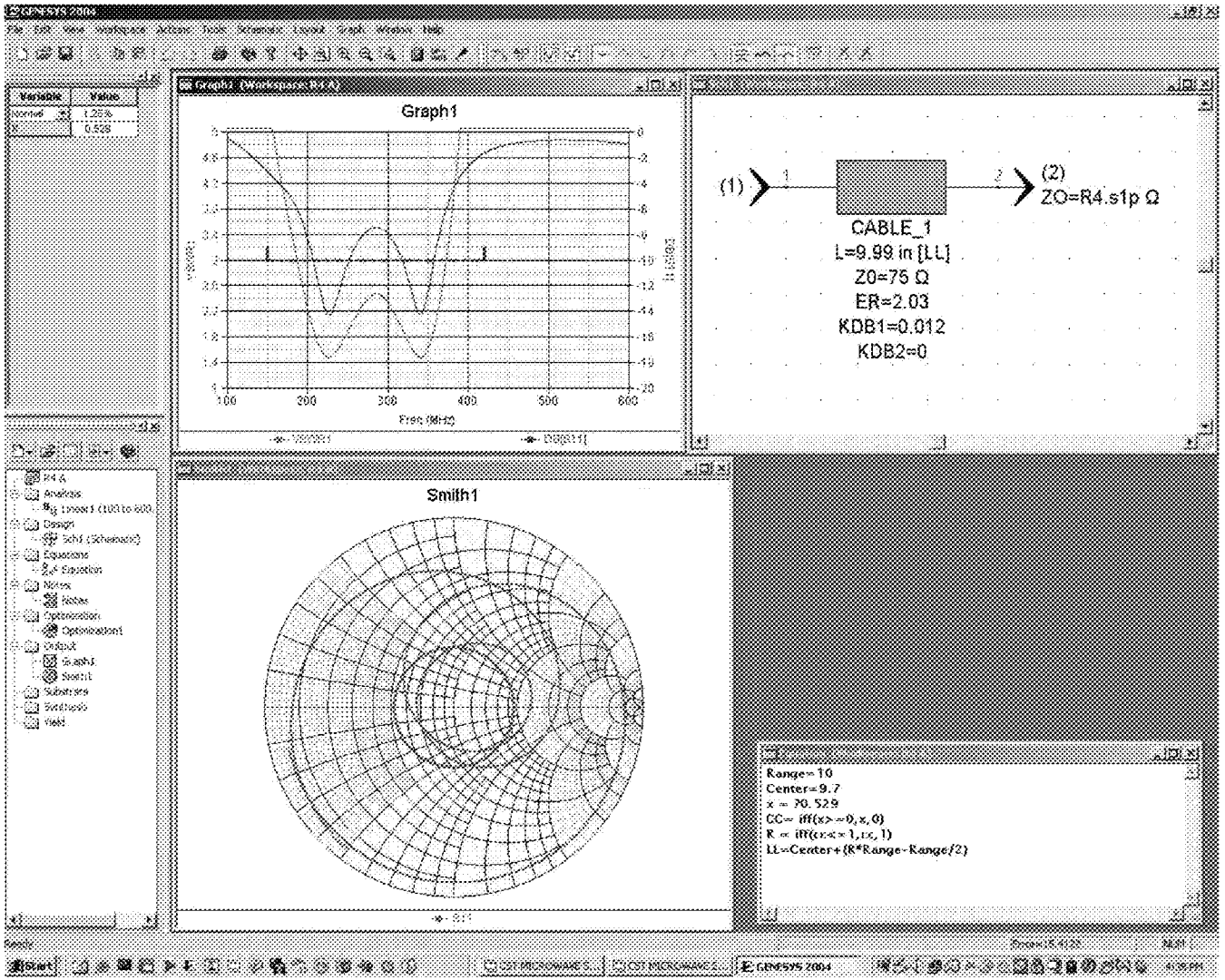
FIG. 25 is a view of the GENESYS simulation tool showing VSWR and S11 plots (red & blue), a Smith chart and a circuit diagram for the quarter-wave matching section in the MFD.

FIG. 24 is a voltage standing wave ratio chart for the MFD with an integral 75-ohm quarter-wave matching transformer. FIG. 24 shows an SWR plot of the input impedance of MFD after the integral 75-ohm quarter-wave matching section is included. FIG. 25 shows a screen shot of GENESYS simulation software used to optimize this matching section. In the upper right a transmission line section ("CABLE_1") is connected between port 1, the input port, and port 2, the output port which is the simulated impedance at the feed point of MFD. The resulting impedance transformation is depicted in the Smith Chart and the graph.

Figure 26:
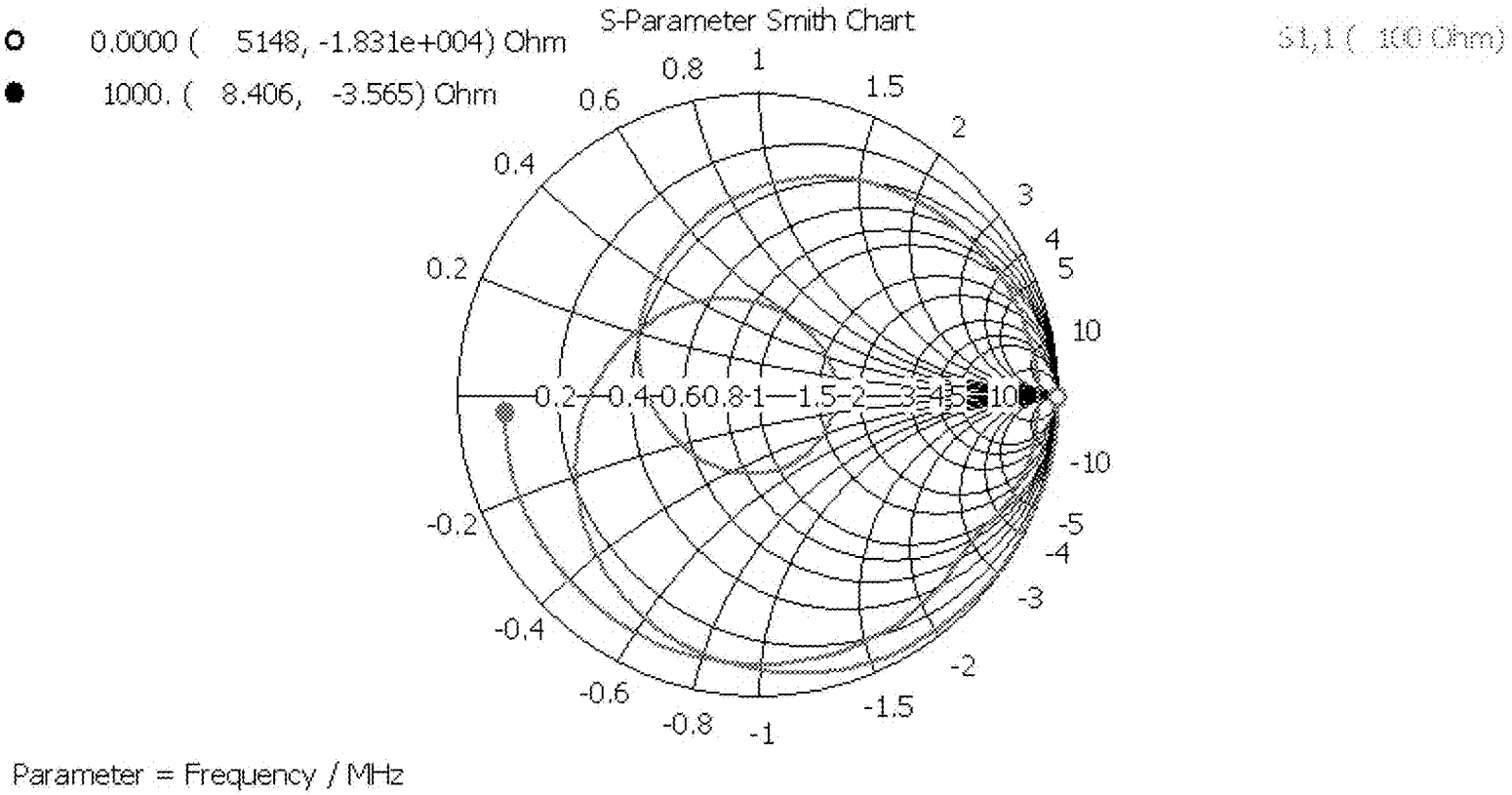
FIG. 26 is a MFD input impedance Smith Chart referred to 100 ohms.
Figure 27:
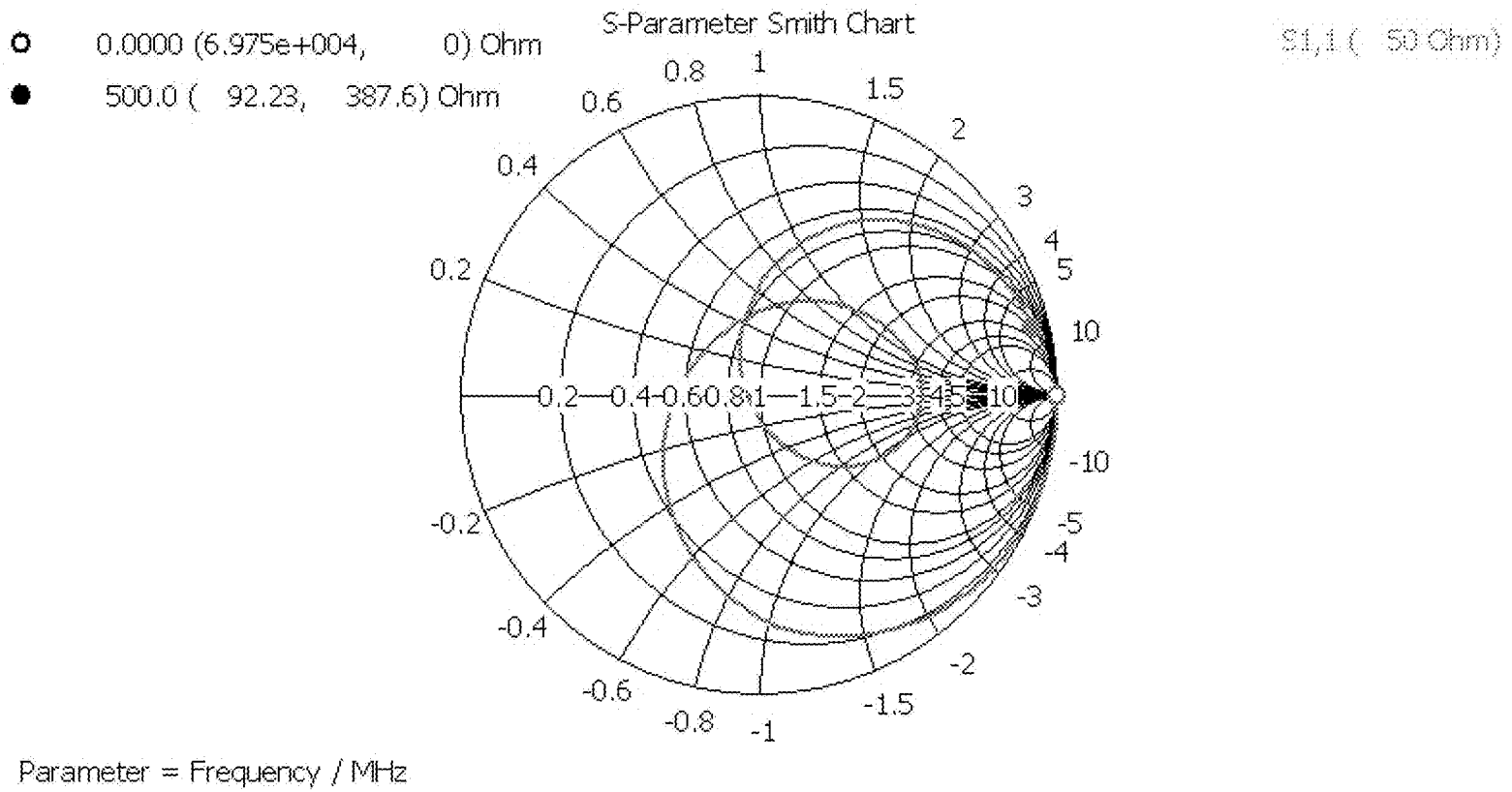
FIG. 27 is a MFD input impedance Smith Chart referred to 50 ohms.

FIG. 26 shows a Smith Chart referenced to 100 ohms, depicting the impedance locus of the feed point of MFD. This shows that the antenna is optimally feed with a 100-ohm source. FIG. 27 shows the same impedance plotted on a Smith Chart referenced to 50 ohms. This is the basis for incorporating the quarter-wave transmission line transformer mentioned above.

Figure 28:
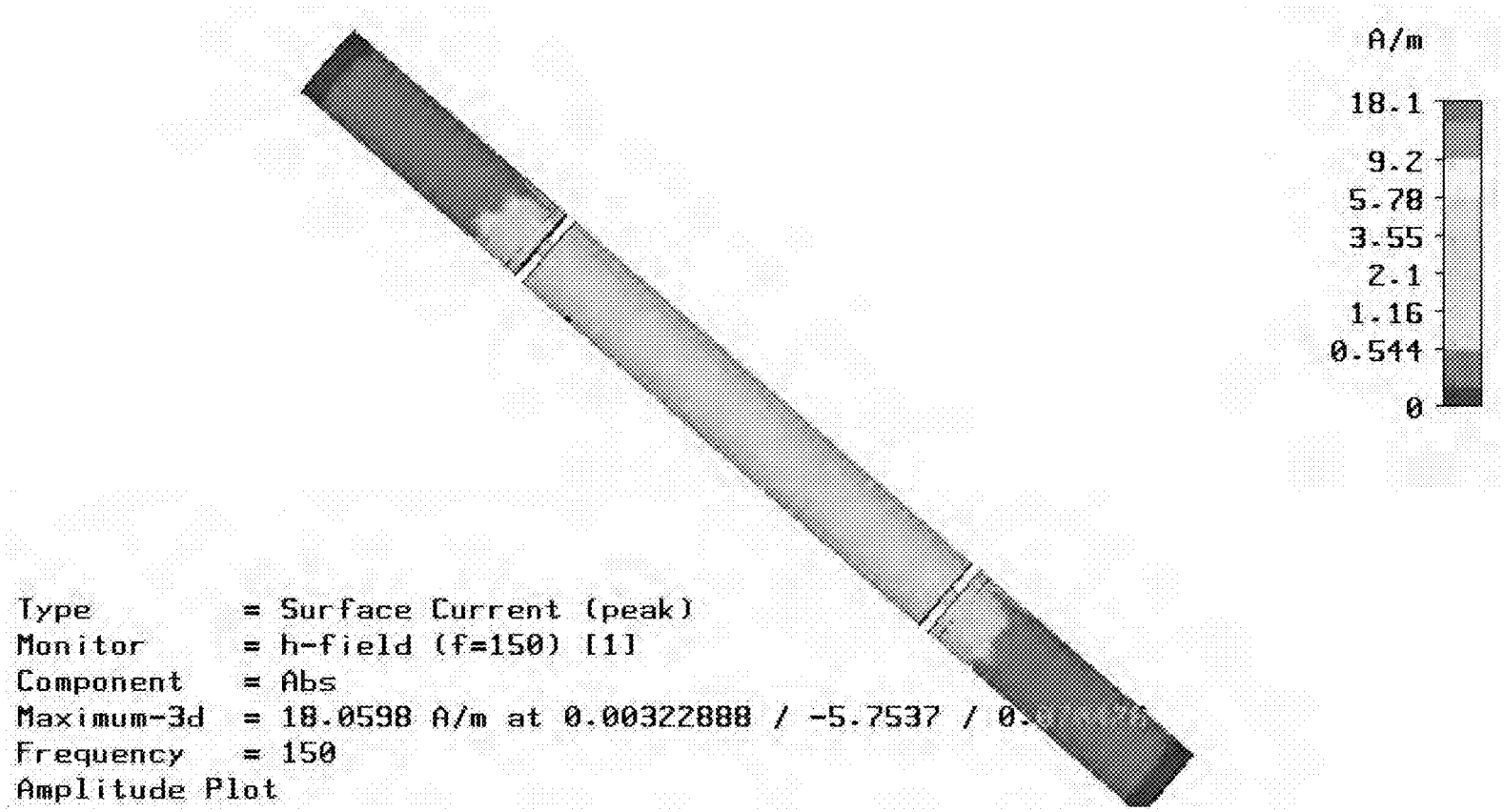
FIG. 28 is a MFD surface current plot at 150 MHz.
Figure 29:
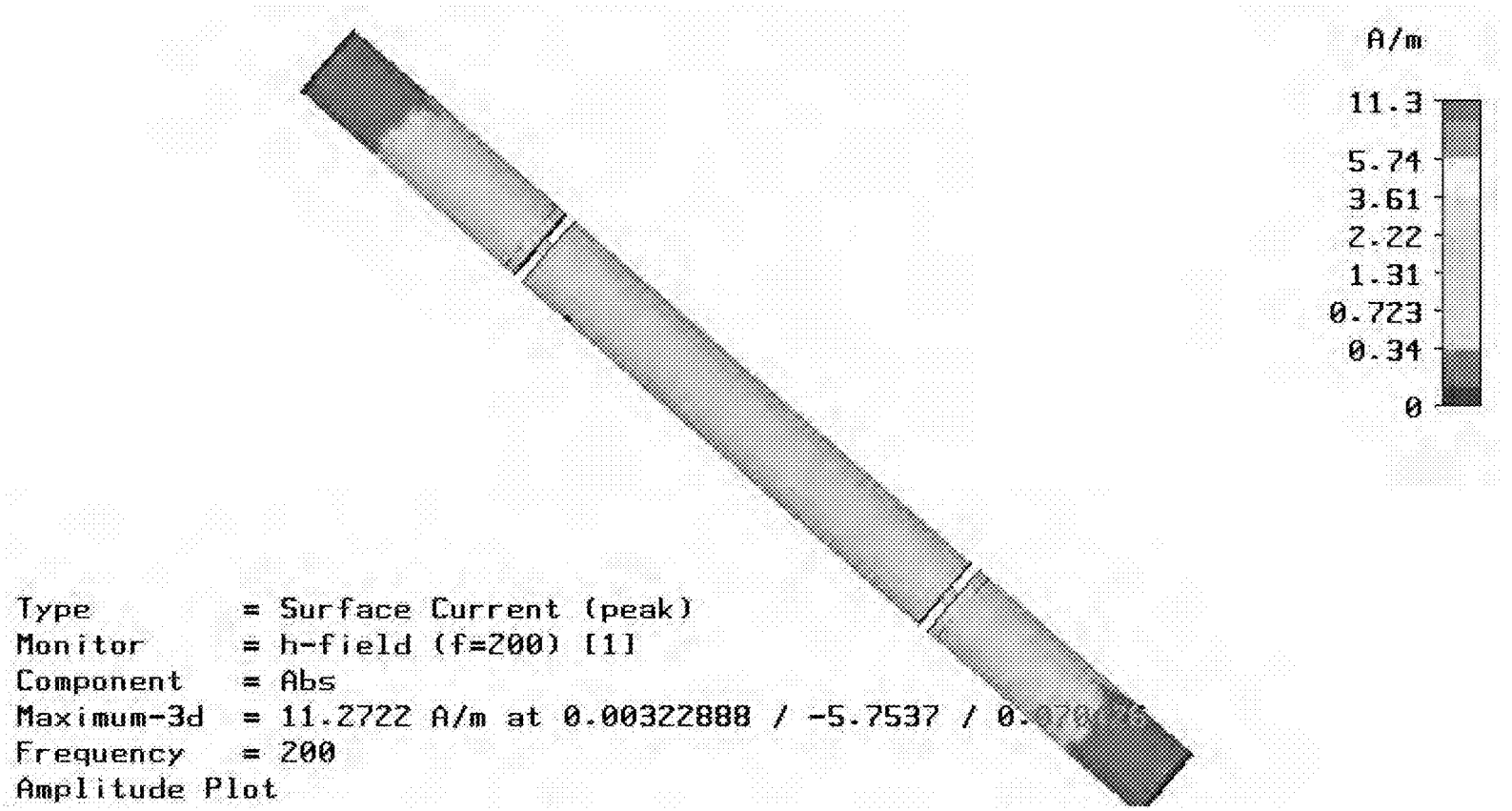
FIG. 29 is a MFD surface current plot at 200 MHz.
Figure 30:
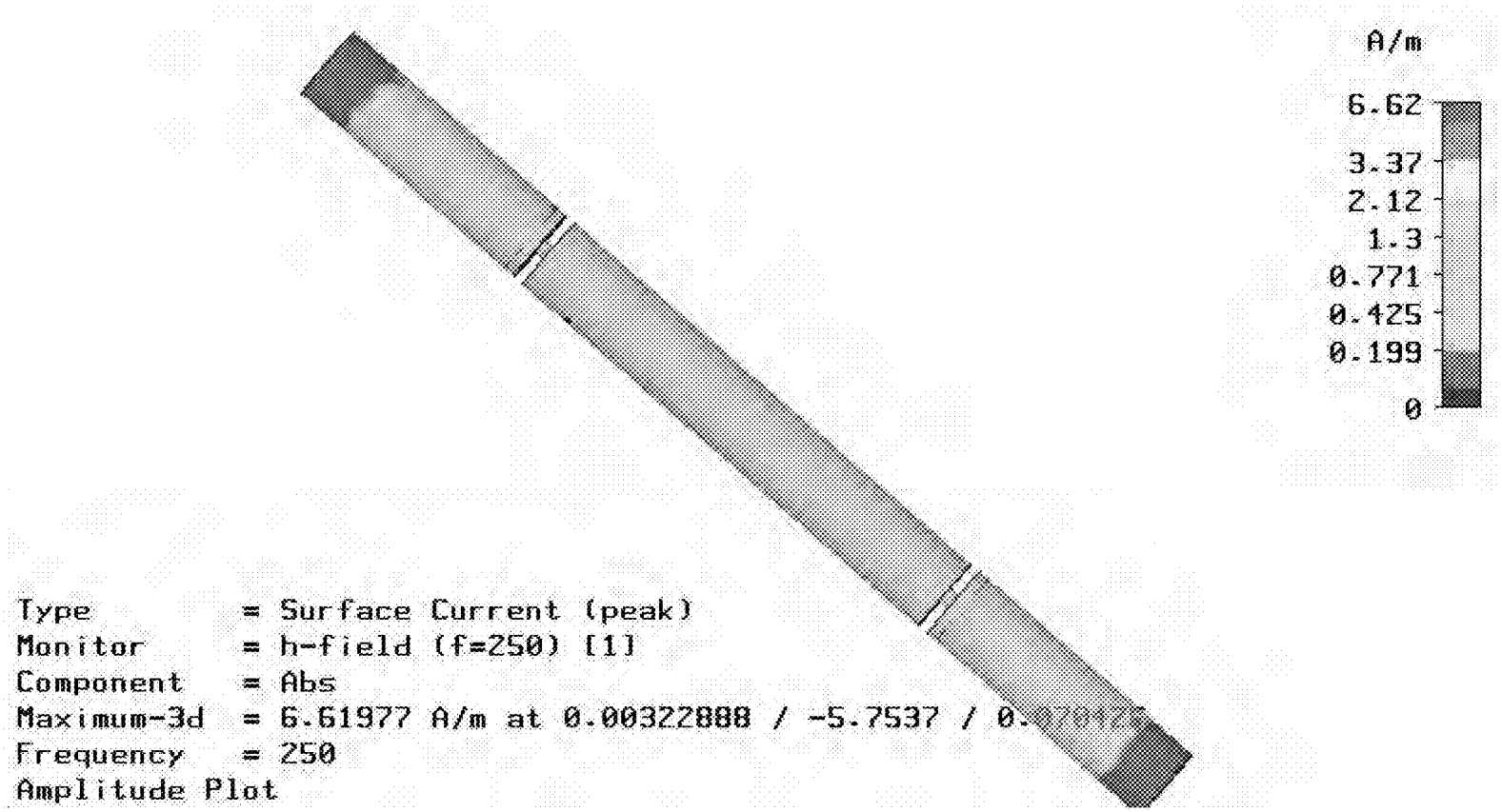
FIG. 30 is a MFD surface current plot at 250 MHz.
Figure 31:
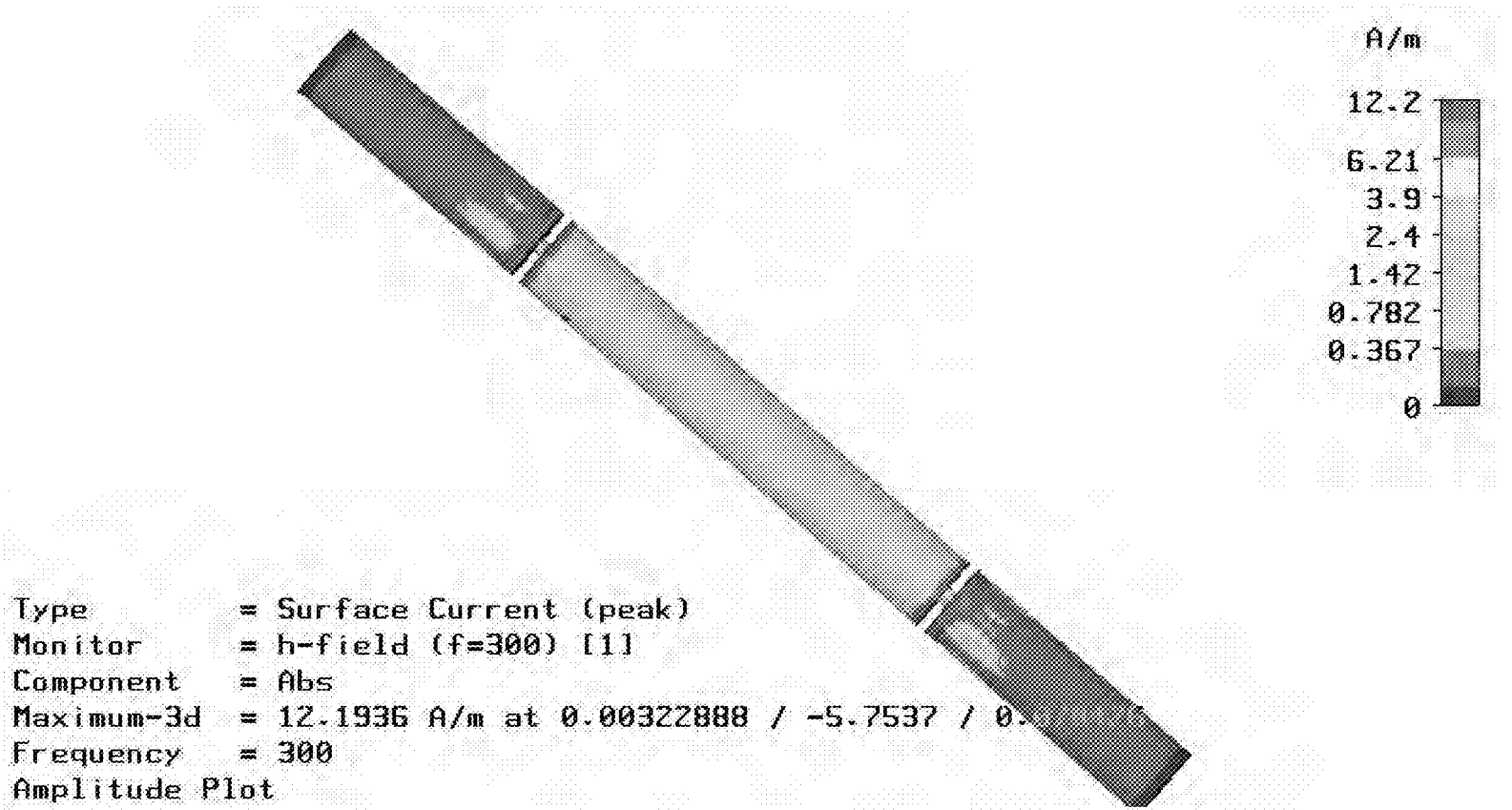
FIG. 31 is a MFD surface current plot at 300 MHz.
Figure 32:
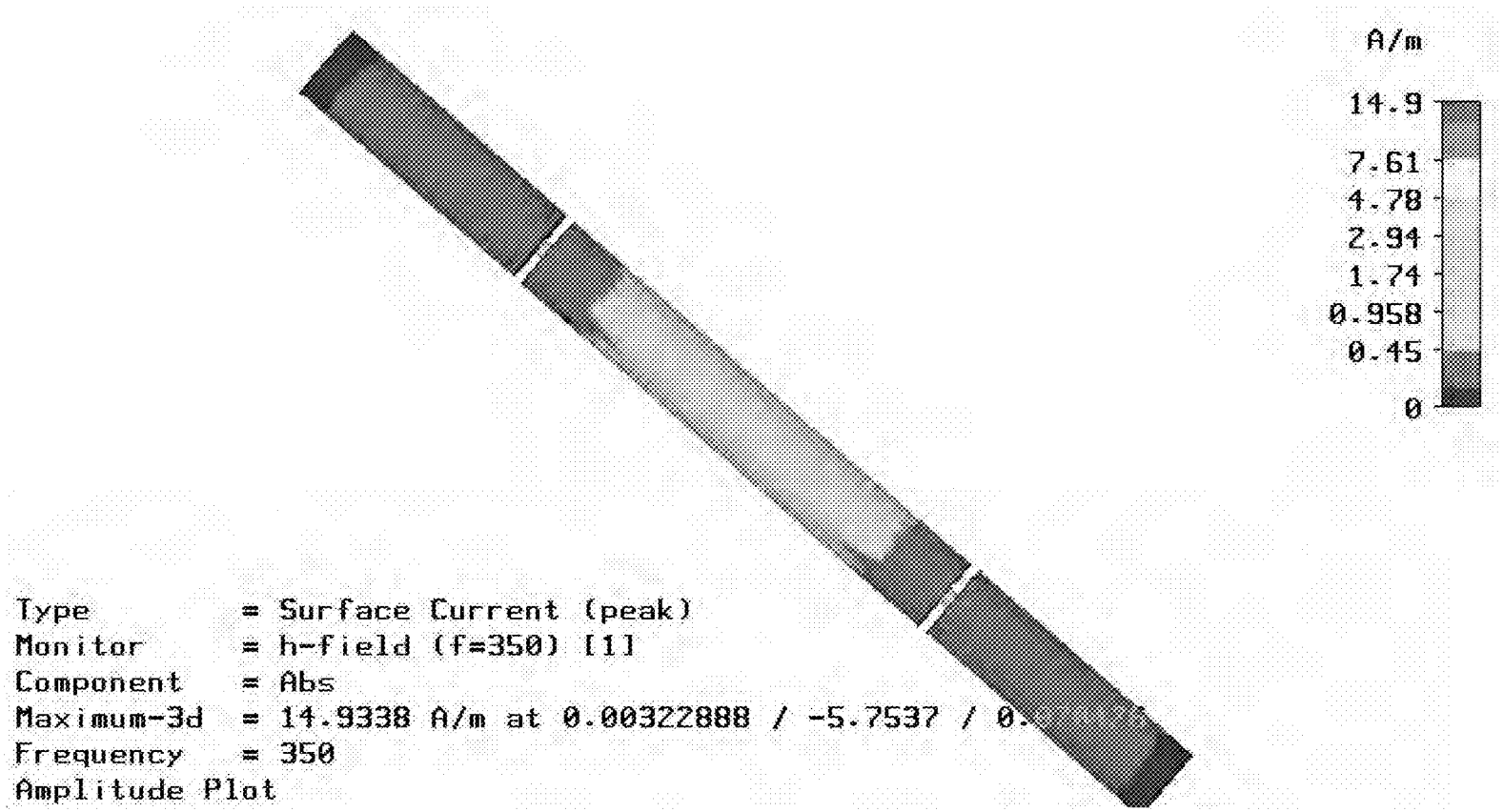
FIG. 32 is a MFD surface current plot at 350 MHz.
Figure 33:
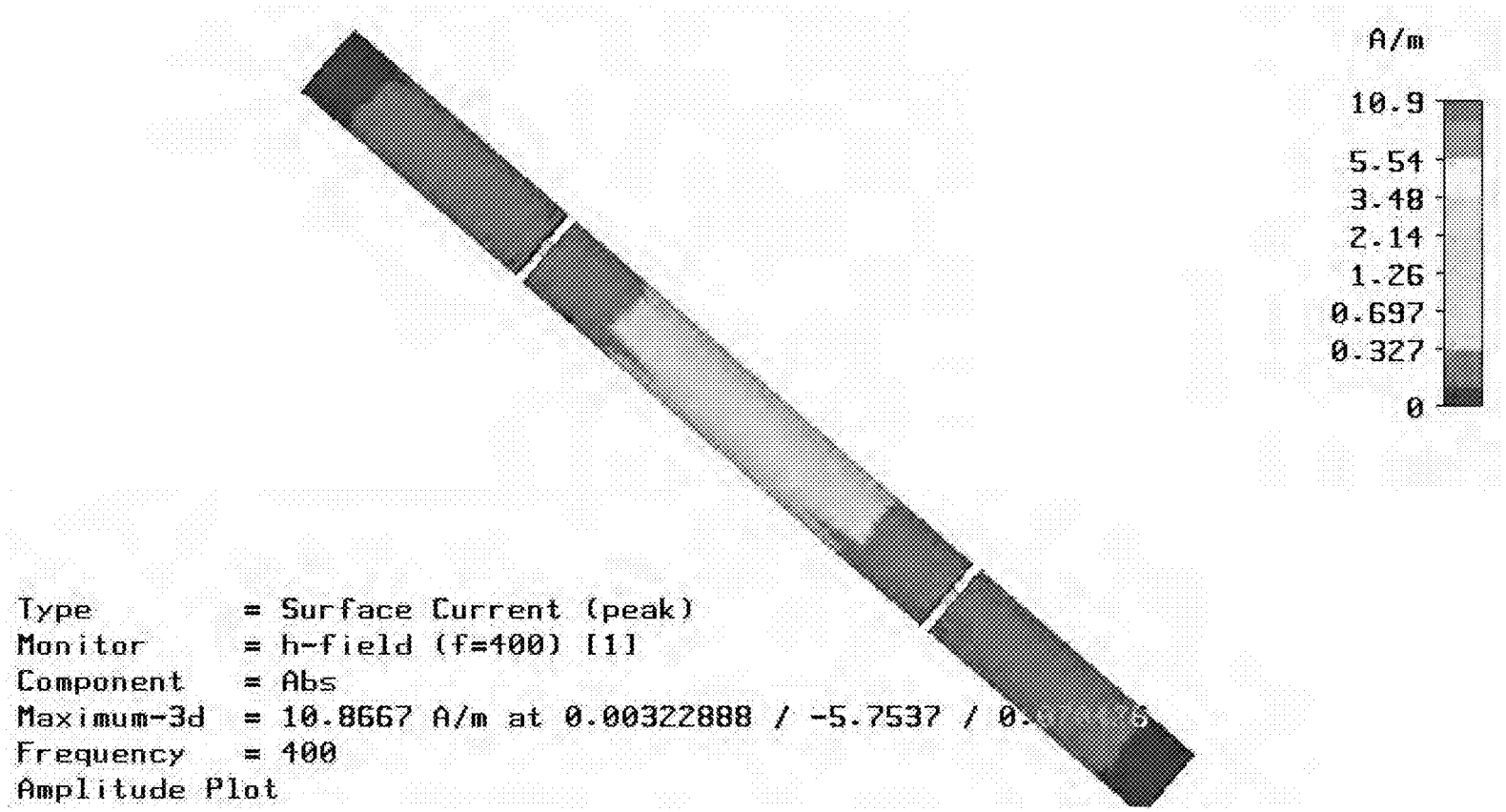
FIG. 33 is a MFD surface current plot at 400 MHz.
Figure 34:
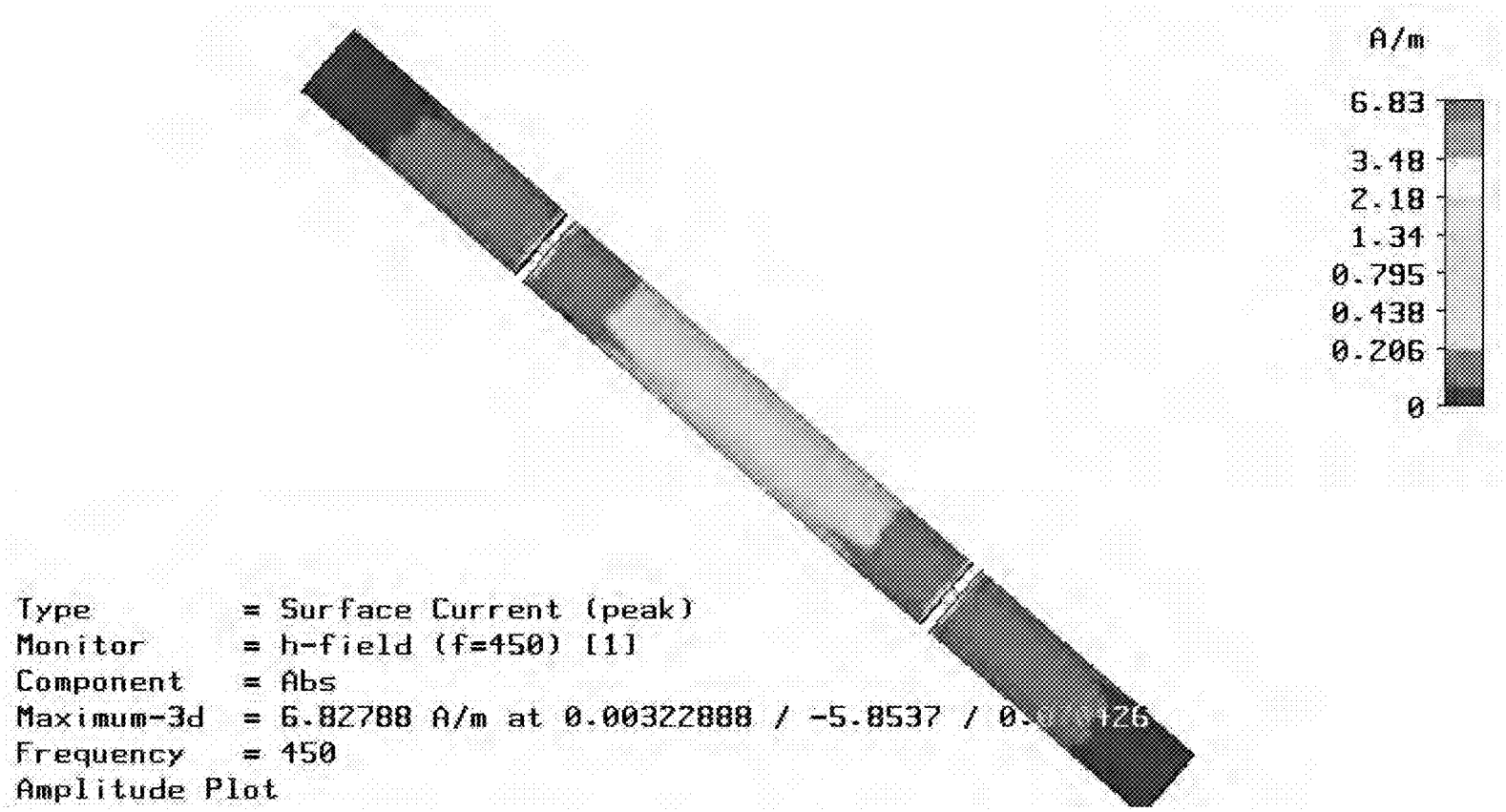
FIG. 34 is a MFD surface current plot at 450 MHz.
Figure 35:
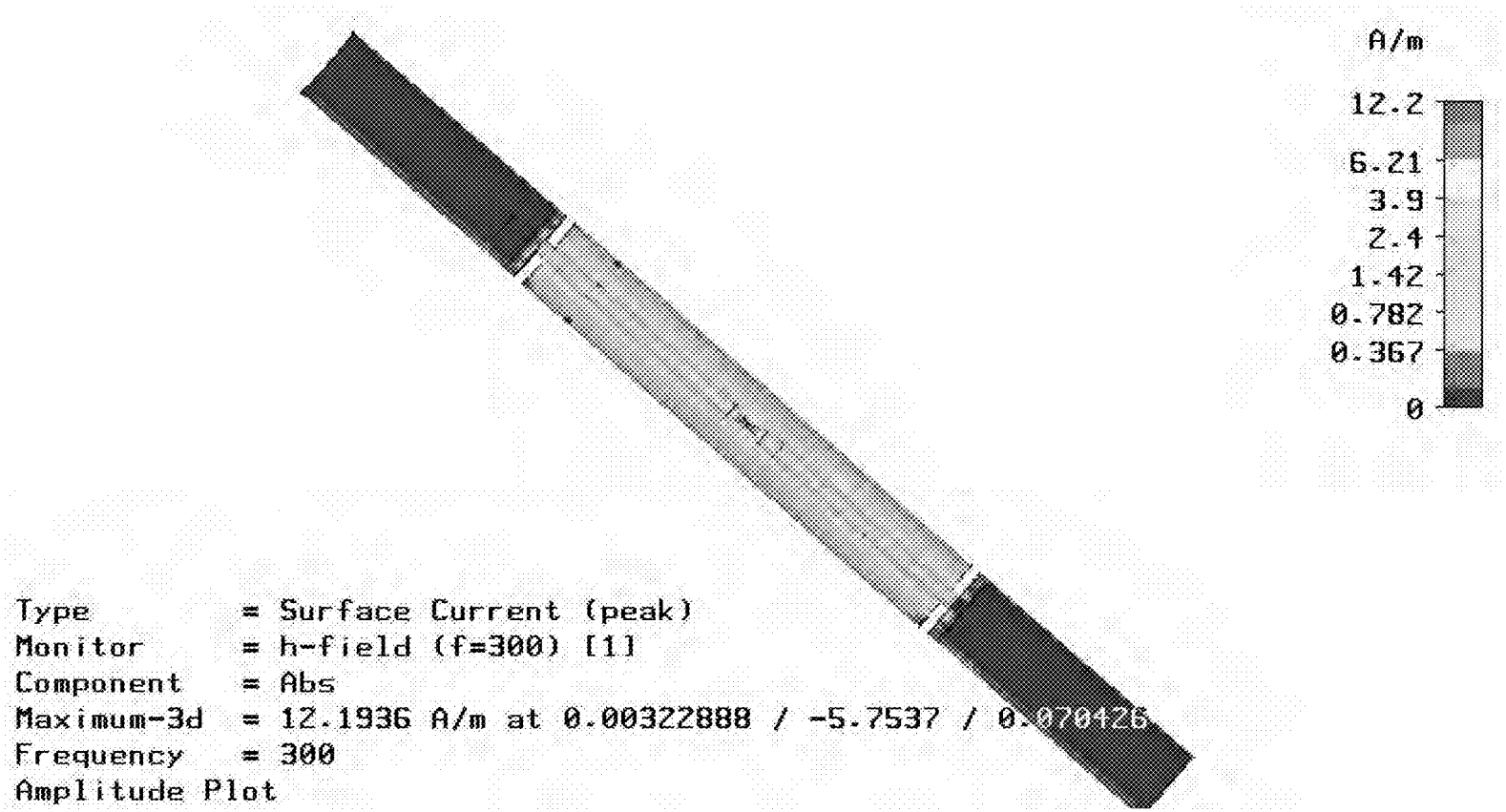
FIG. 35 is a MFD cross section current plot at 300 MHz.
Figure 36:
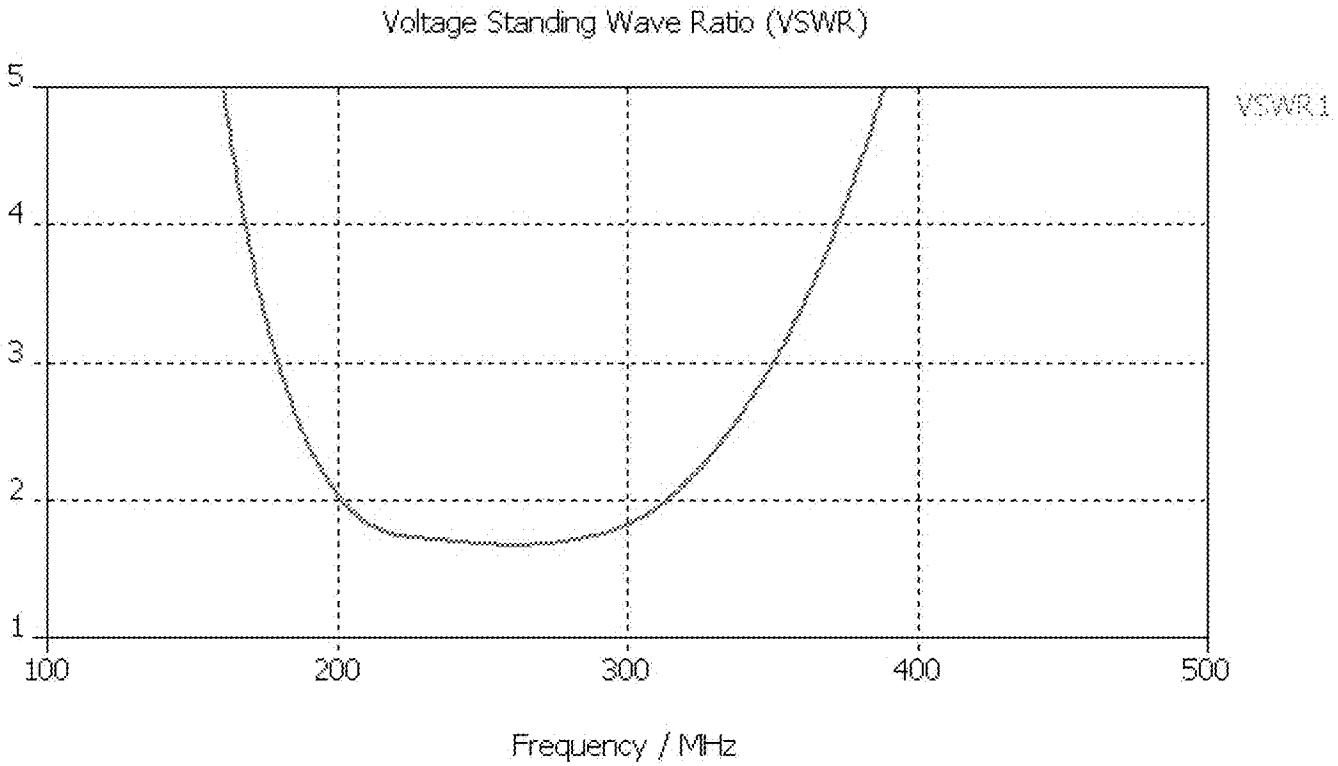
FIG. 36 is a voltage standing wave ratio chart for the MFD at 100 Ohms.
Figure 37:
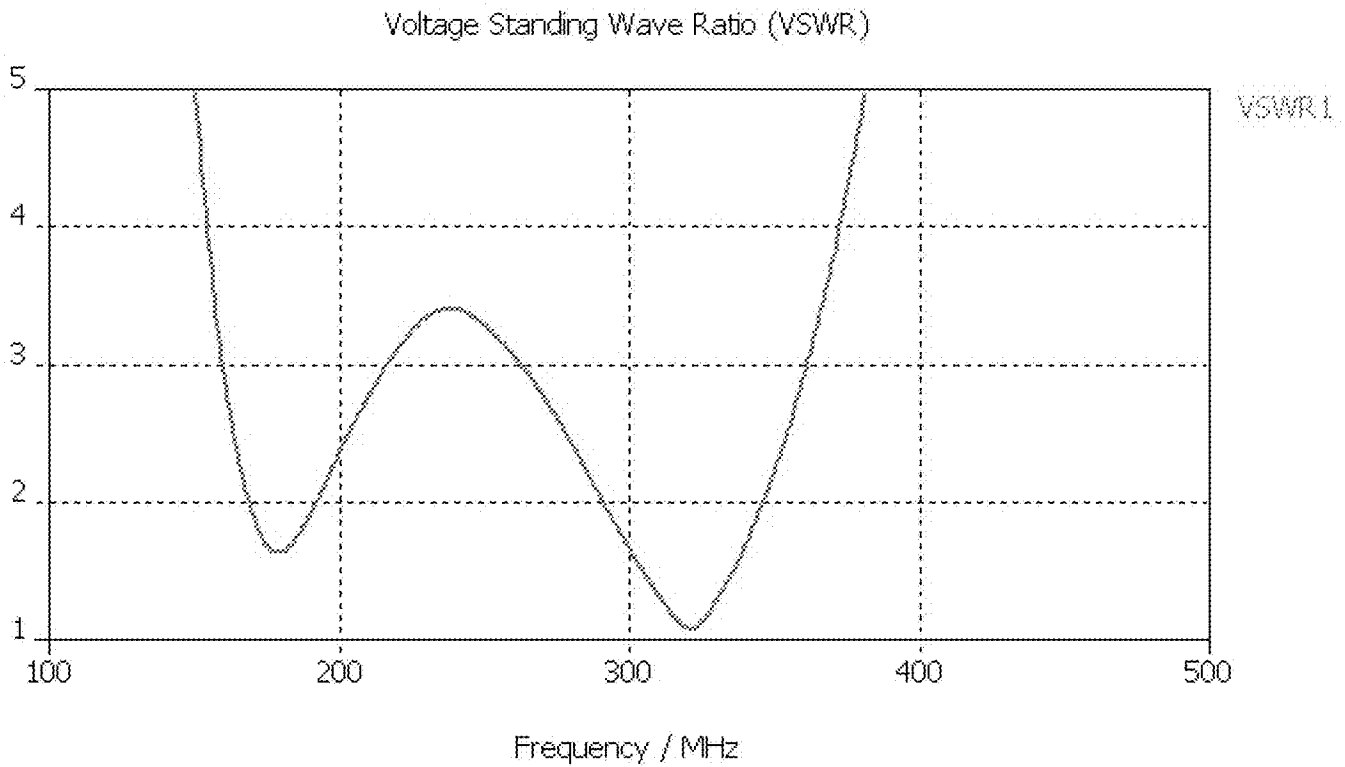
FIG. 37 is a voltage standing wave ratio chart for the MFD at 50 Ohms.

FIG. 28 is a MFD surface current plot at 150 MHz. FIG. 29 is a MFD surface current plot at 200 MHz. FIG. 30 is a MFD surface current plot at 250 MHz. FIG. 31 is a MFD surface current plot at 300 MHz. FIG. 32 is a MFD surface current plot at 350 MHz. FIG. 33 is a MFD surface current plot at 400 MHz. FIG. 34 is a MFD surface current plot at 450 MHz. FIG. 35 is a MFD cross section current plot at 300 MHz. FIG. 36 is a voltage standing wave ratio chart for the MFD at 100 Ohms. FIG. 37 is a voltage standing wave ratio chart for the MFD at 50 Ohms.

Figure 38:
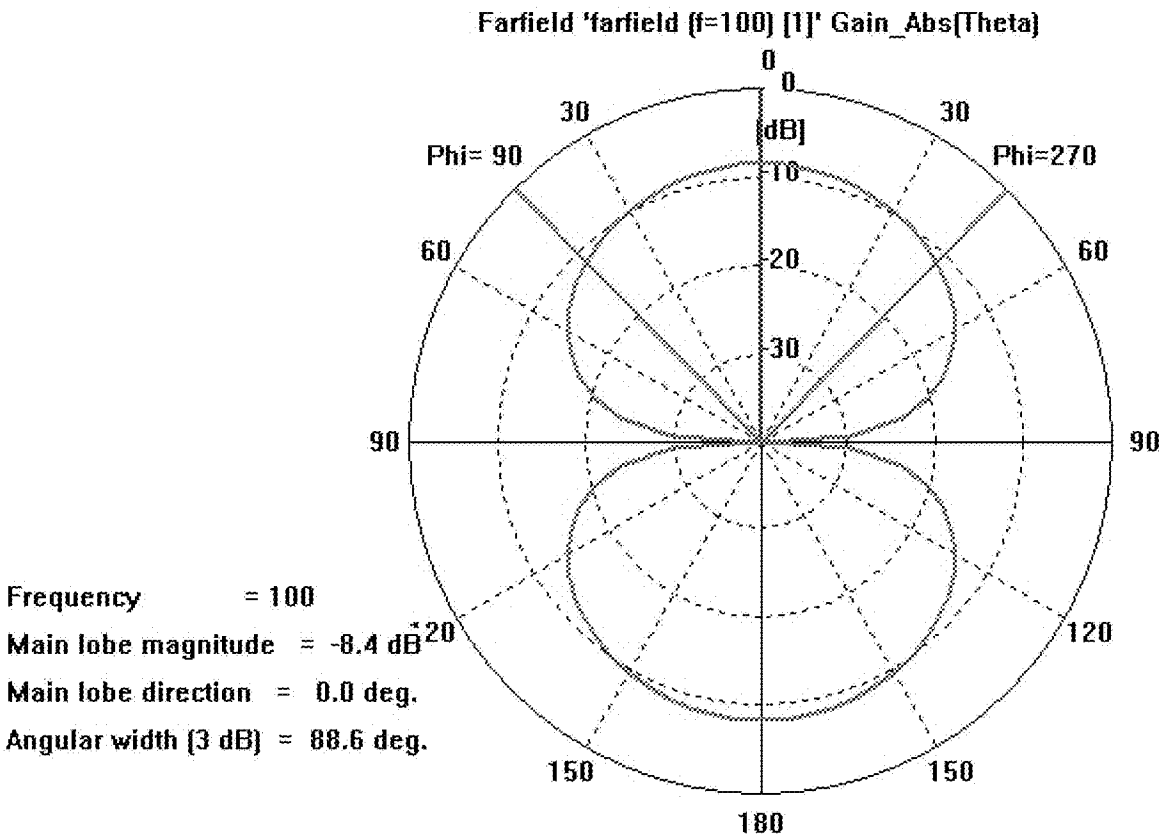
FIG. 38 is a polar radiation pattern for a multi-feed dipole embodiment 2 at 100 MHz.
Figure 39:
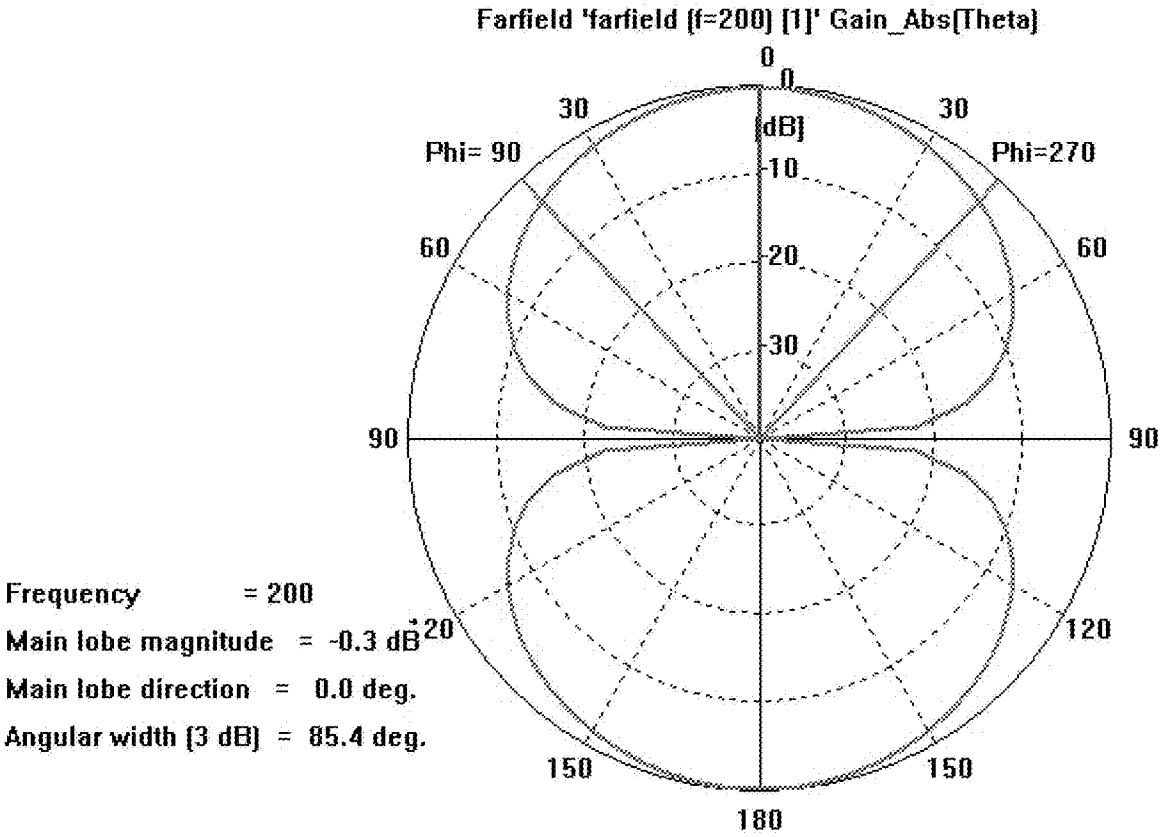
FIG. 39 is a polar radiation pattern for a multi-feed dipole embodiment 2 at 200 MHz.
Figure 40:
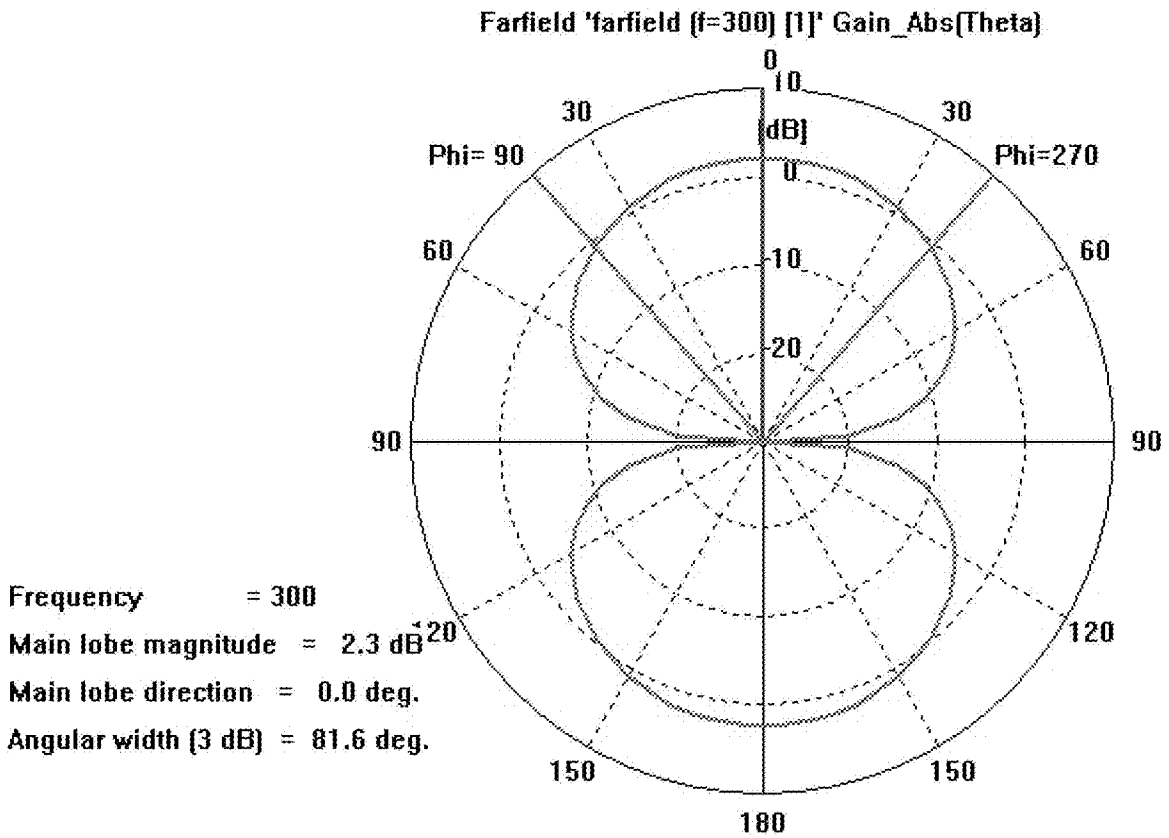
FIG. 40 is a polar radiation pattern for a multi-feed dipole embodiment 2 at 300 MHz.
Figure 41:
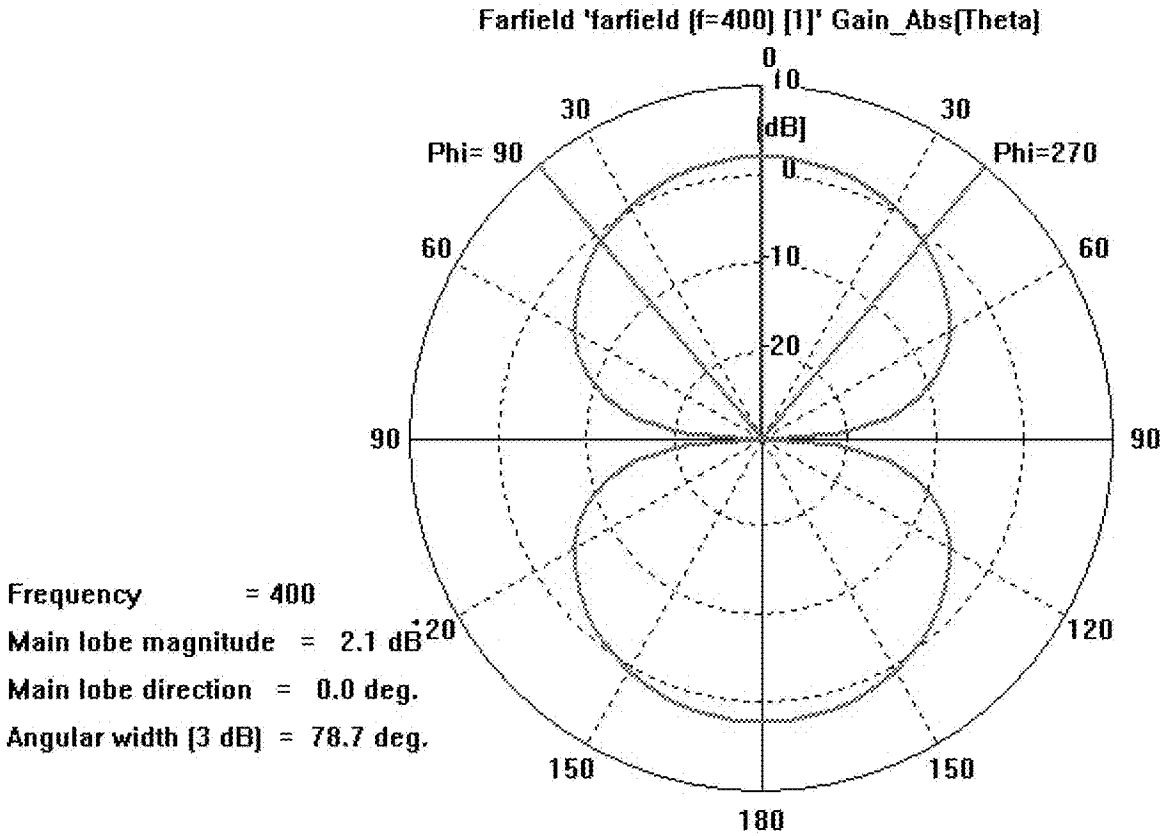
FIG. 41 is a polar radiation pattern for a multi-feed dipole embodiment 2 at 400 MHz.
Figure 42:
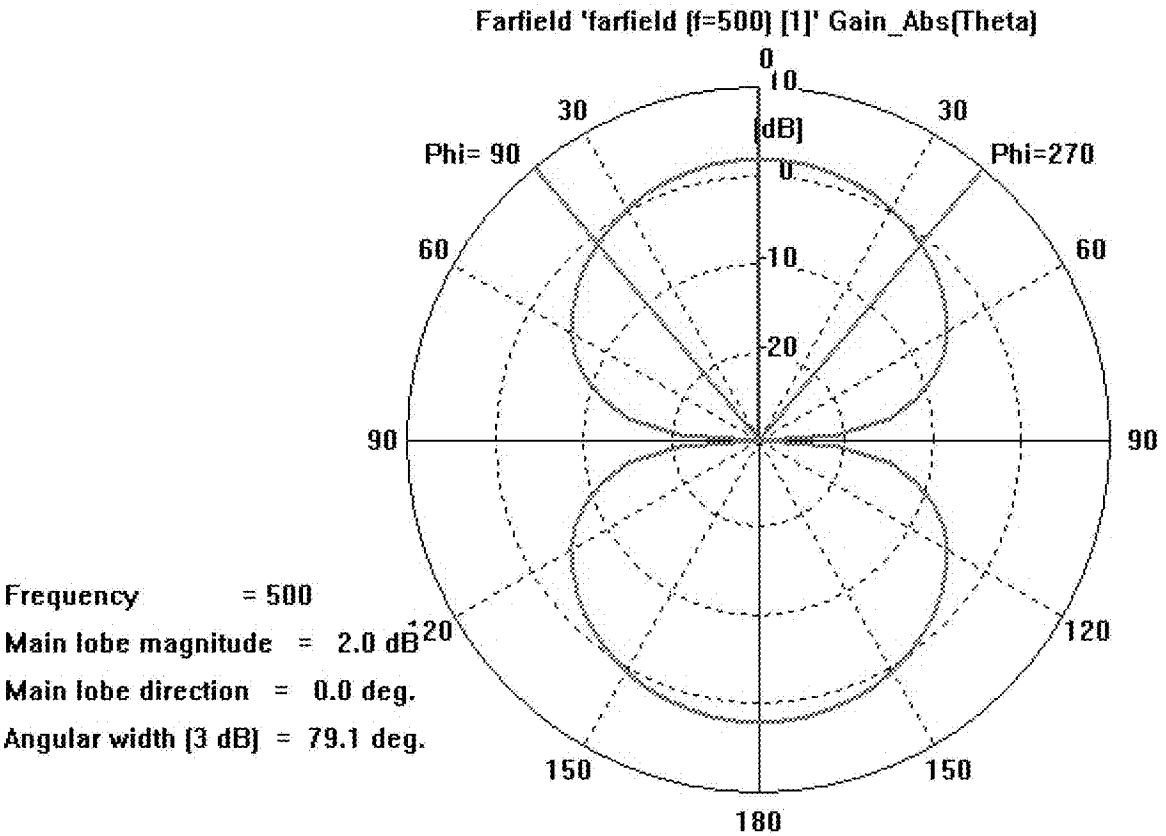
FIG. 42 is a polar radiation pattern for a multi-feed dipole embodiment 2 at 500 MHz.
Figure 43:
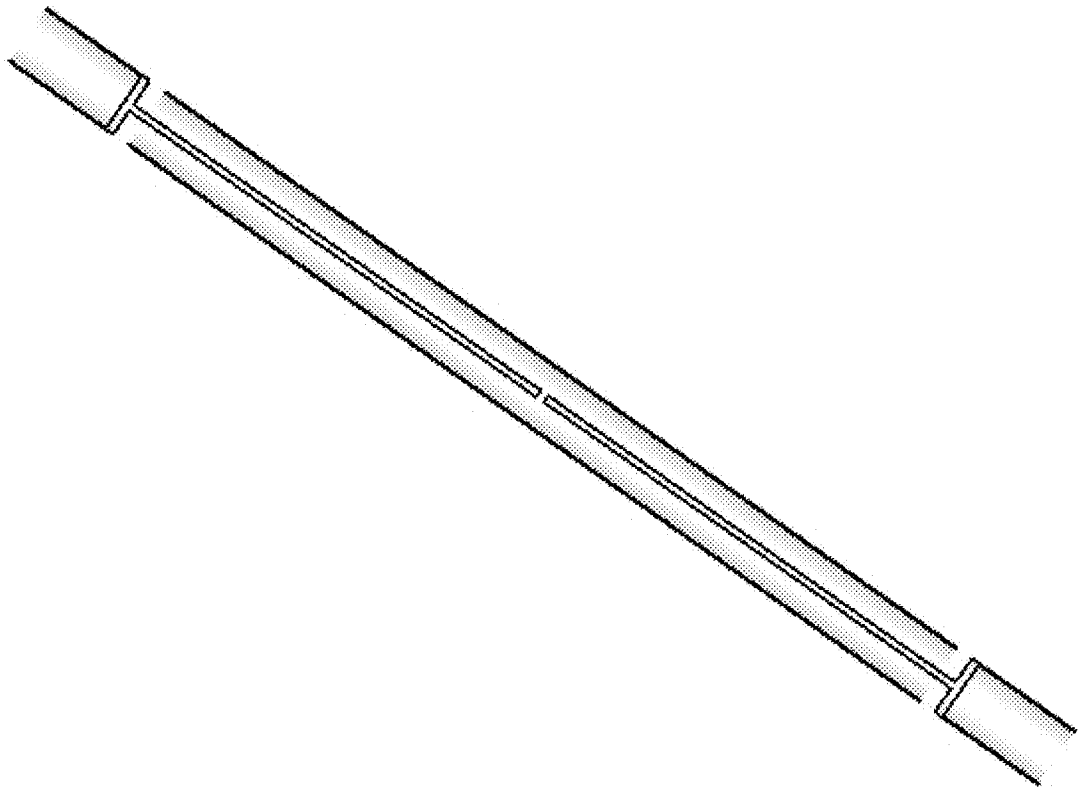
FIG. 43 is a cross section of the multi-feed embodiment 2.
Figure 44:
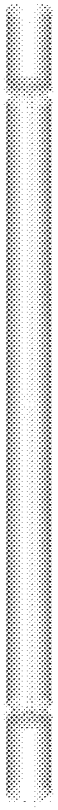
FIG. 44 is a side view of the multi-feed embodiment 2.
Figure 45:
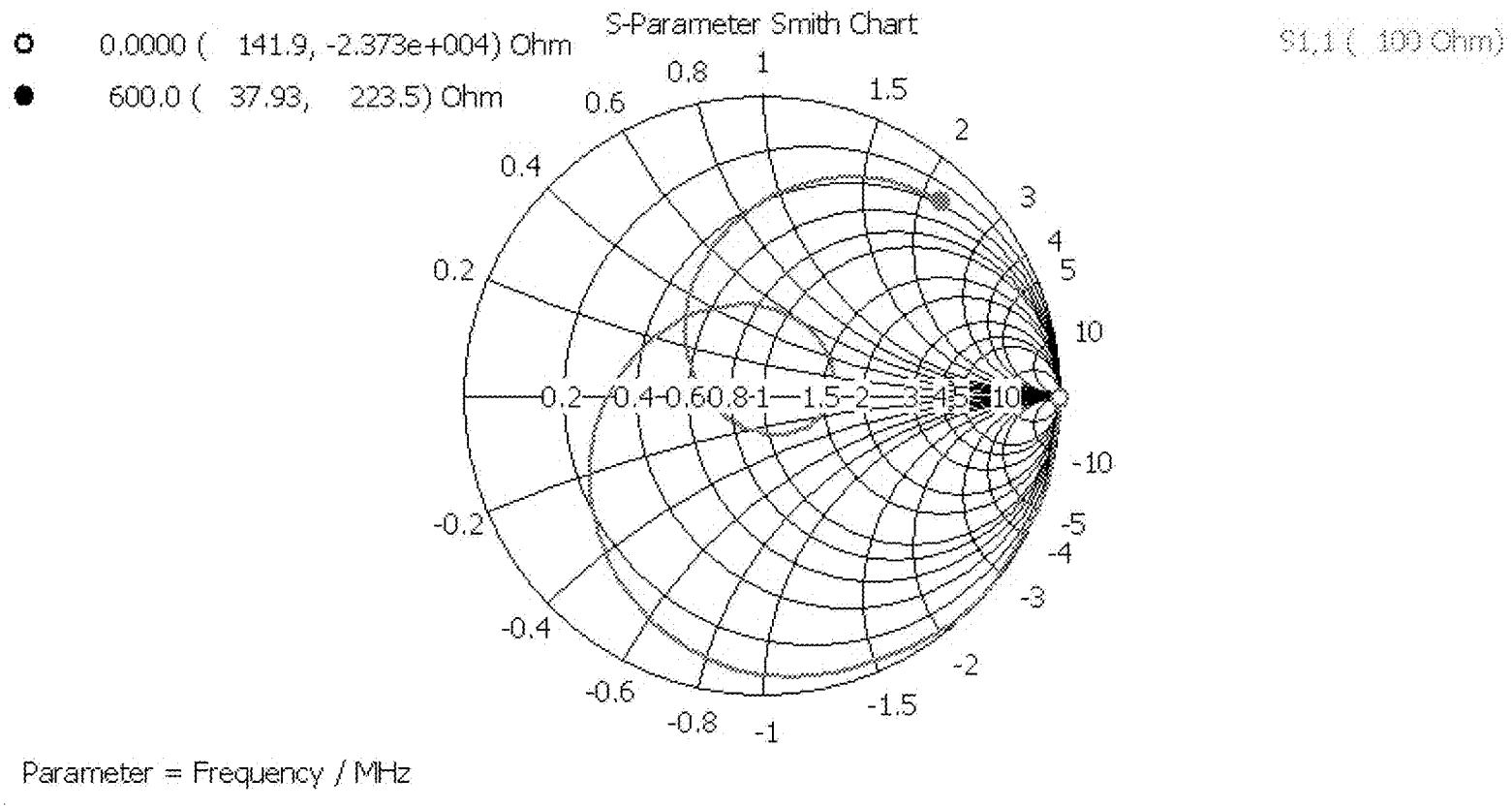
FIG. 45 is a MFD 2 input impedance Smith Chart referred to 100 ohms.
Figure 46:
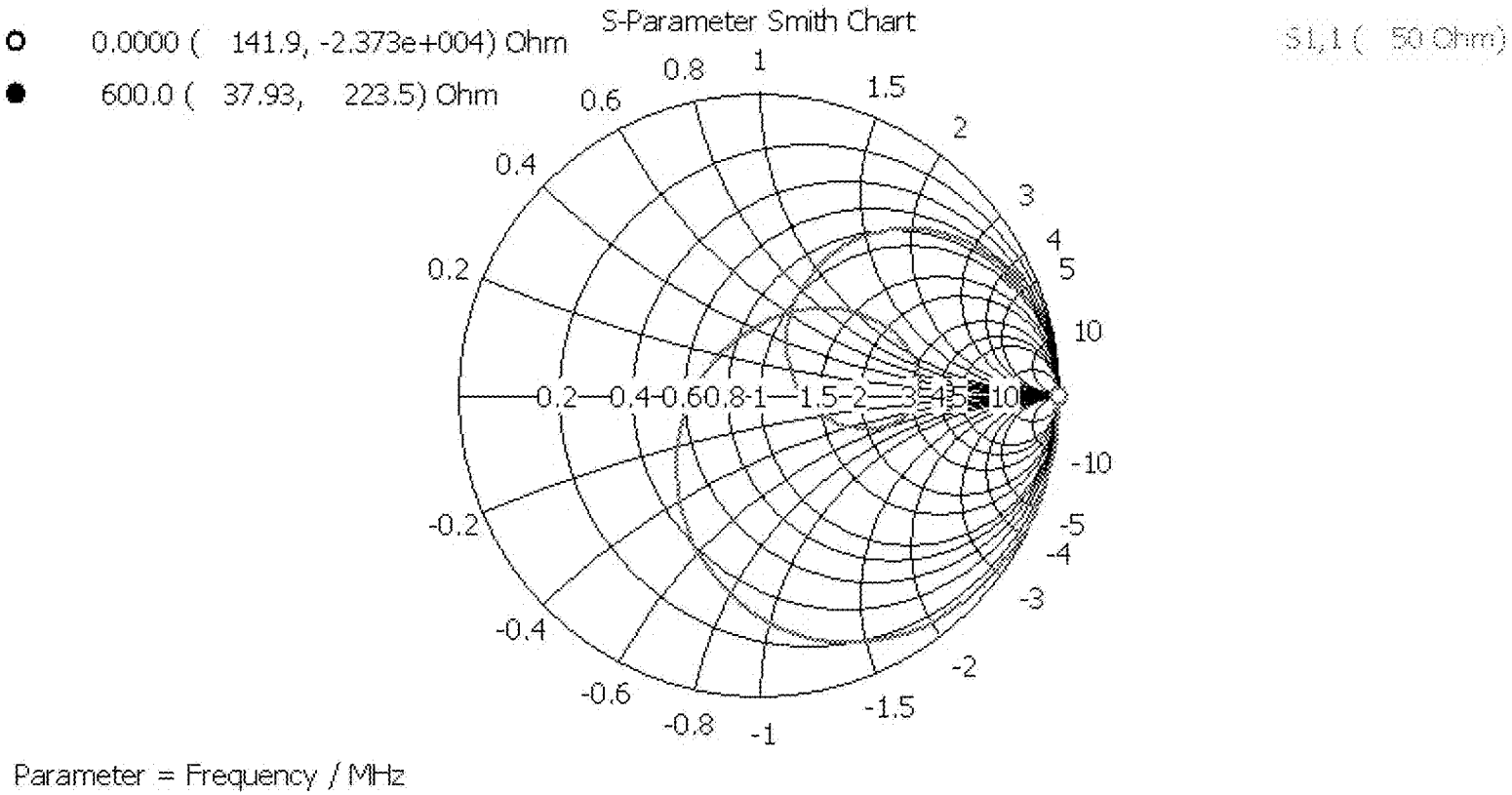
FIG. 46 is a MFD 2 input impedance Smith Chart referred to 50 ohms.
Figure 47:
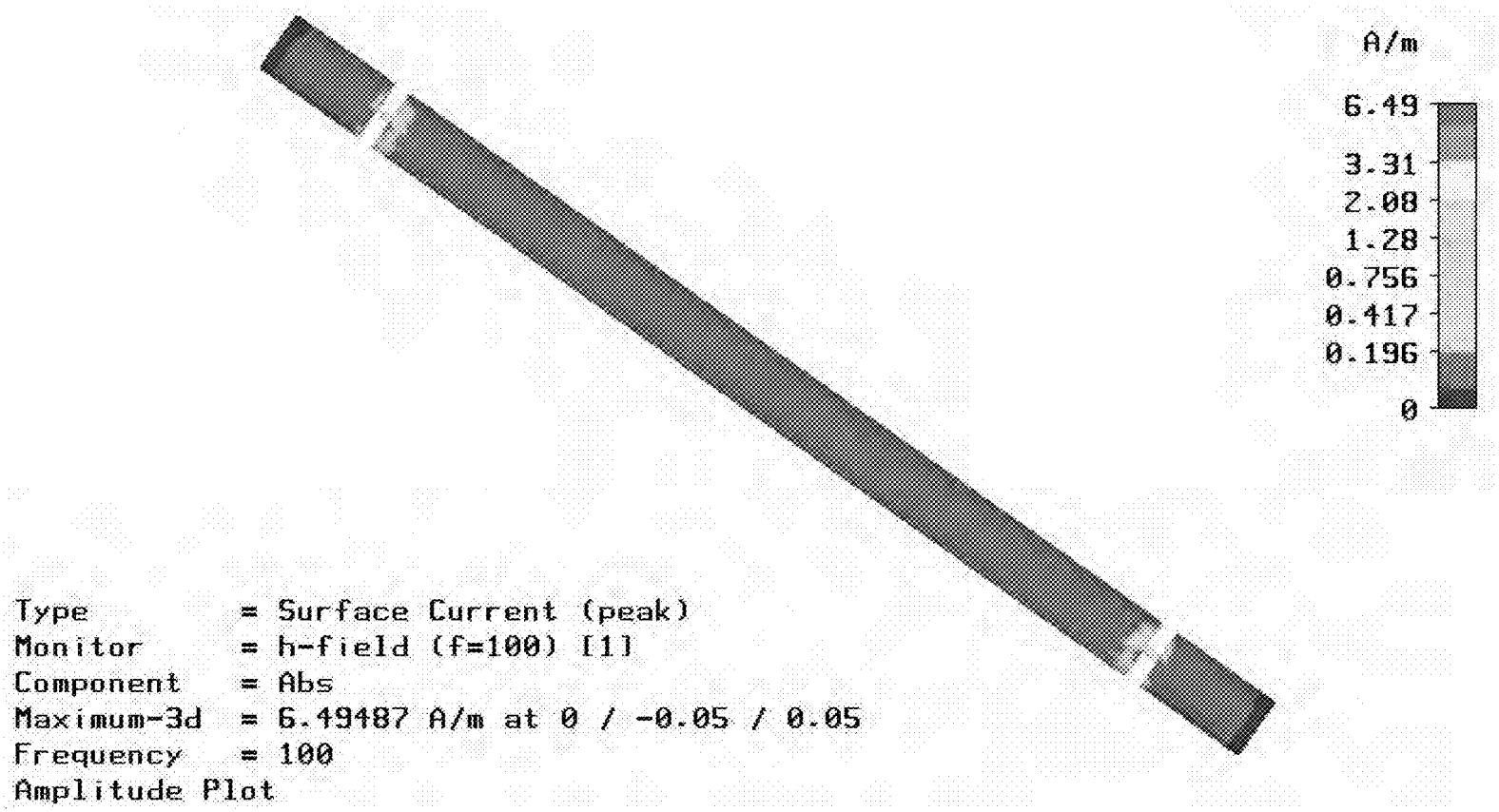
FIG. 47 is a MFD 2 surface current plot at 100 MHz.
Figure 48:
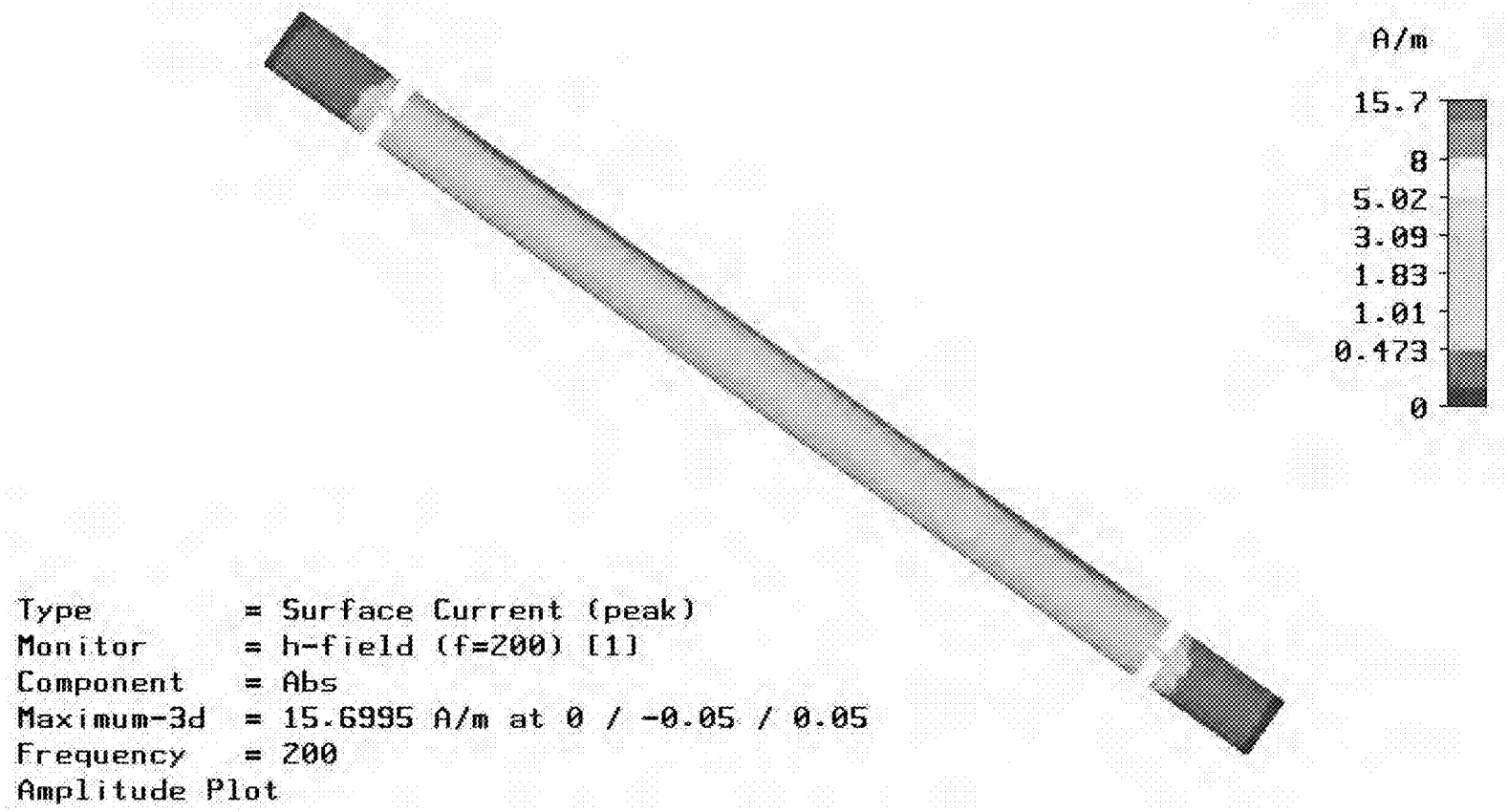
FIG. 48 is a MFD 2 surface current plot at 200 MHz.
Figure 49:
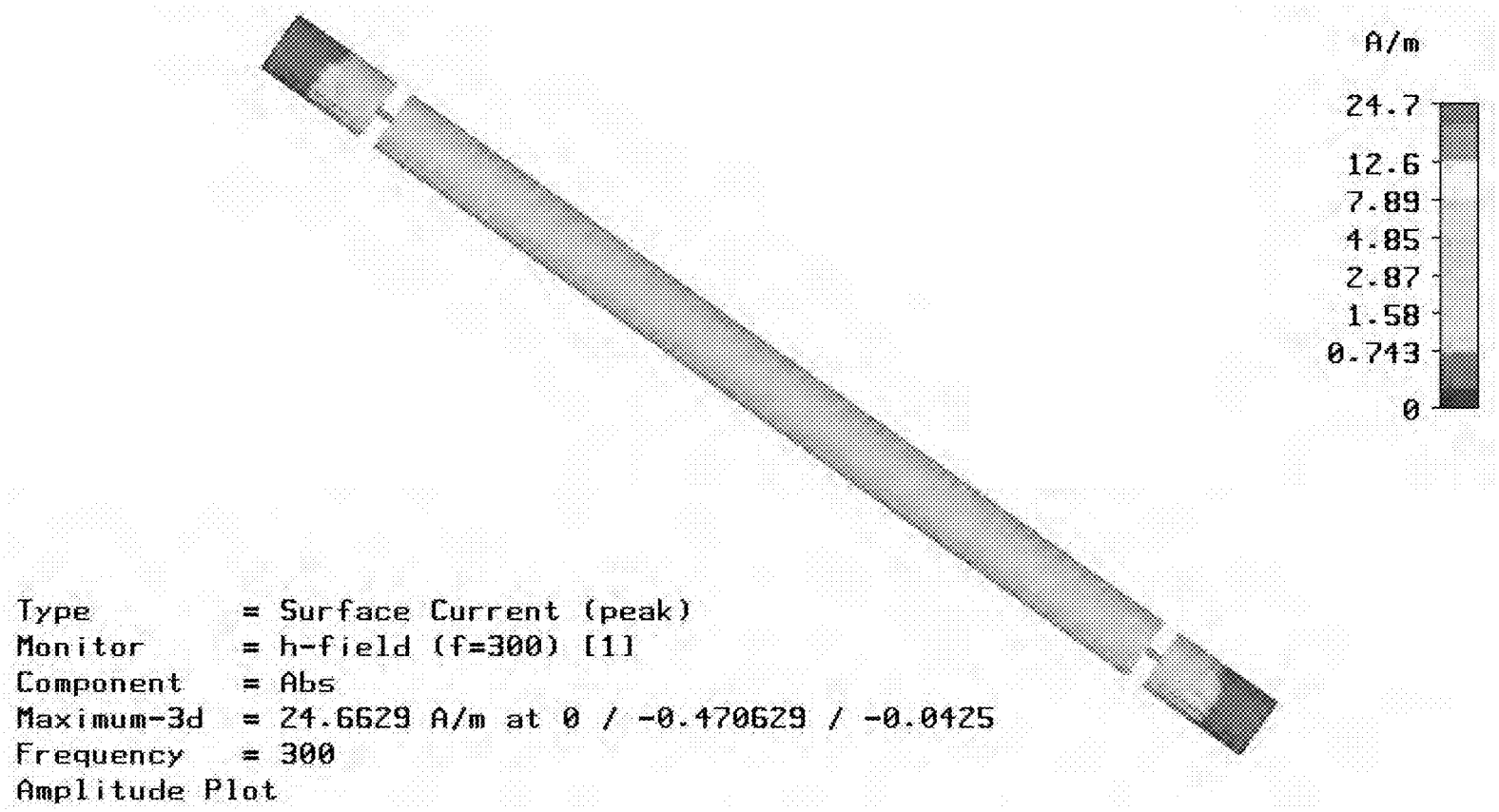
FIG. 49 is a MFD 2 surface current plot at 300 MHz.
Figure 50:
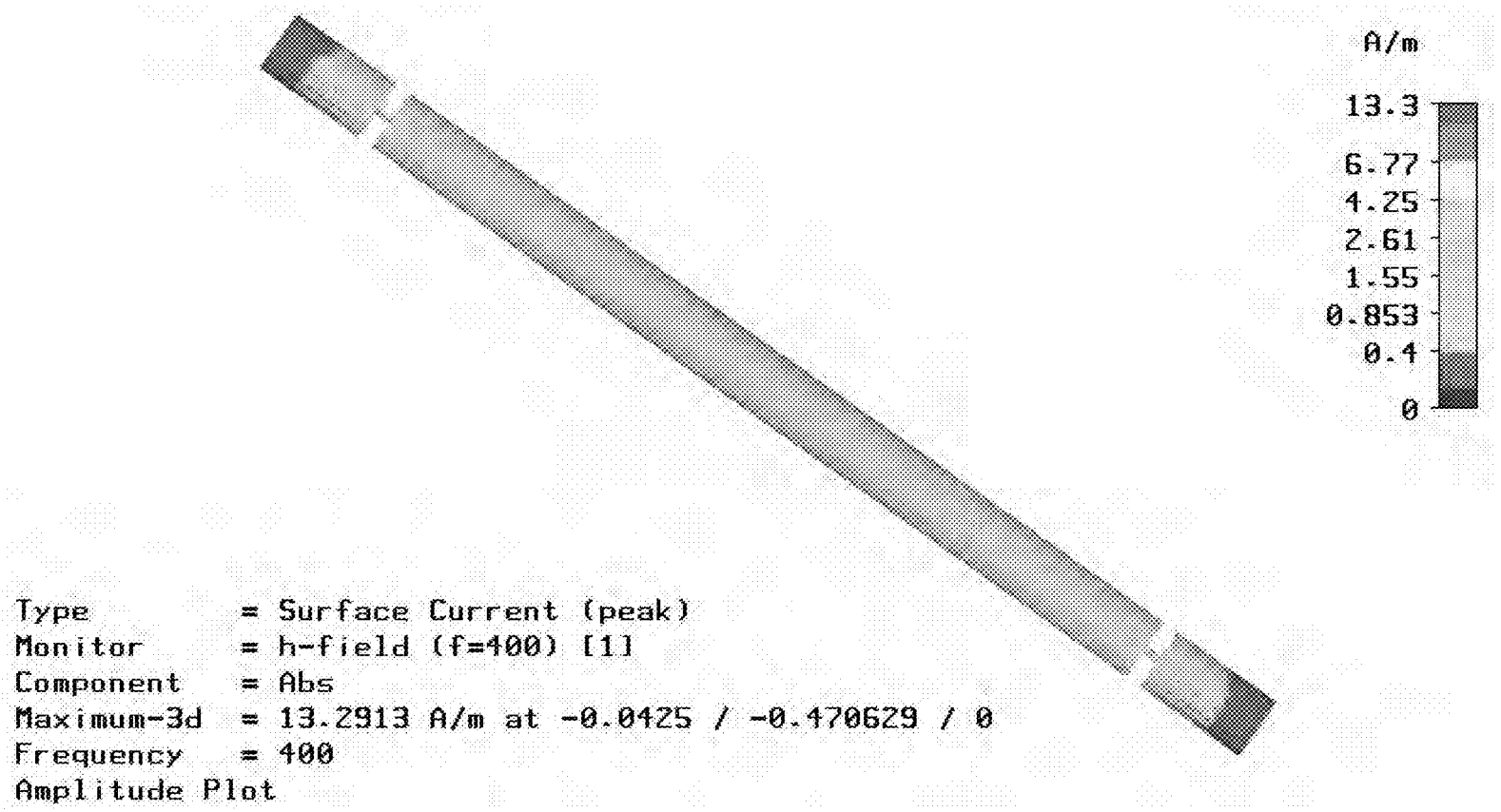
FIG. 50 is a MFD 2 surface current plot at 400 MHz.
Figure 51:
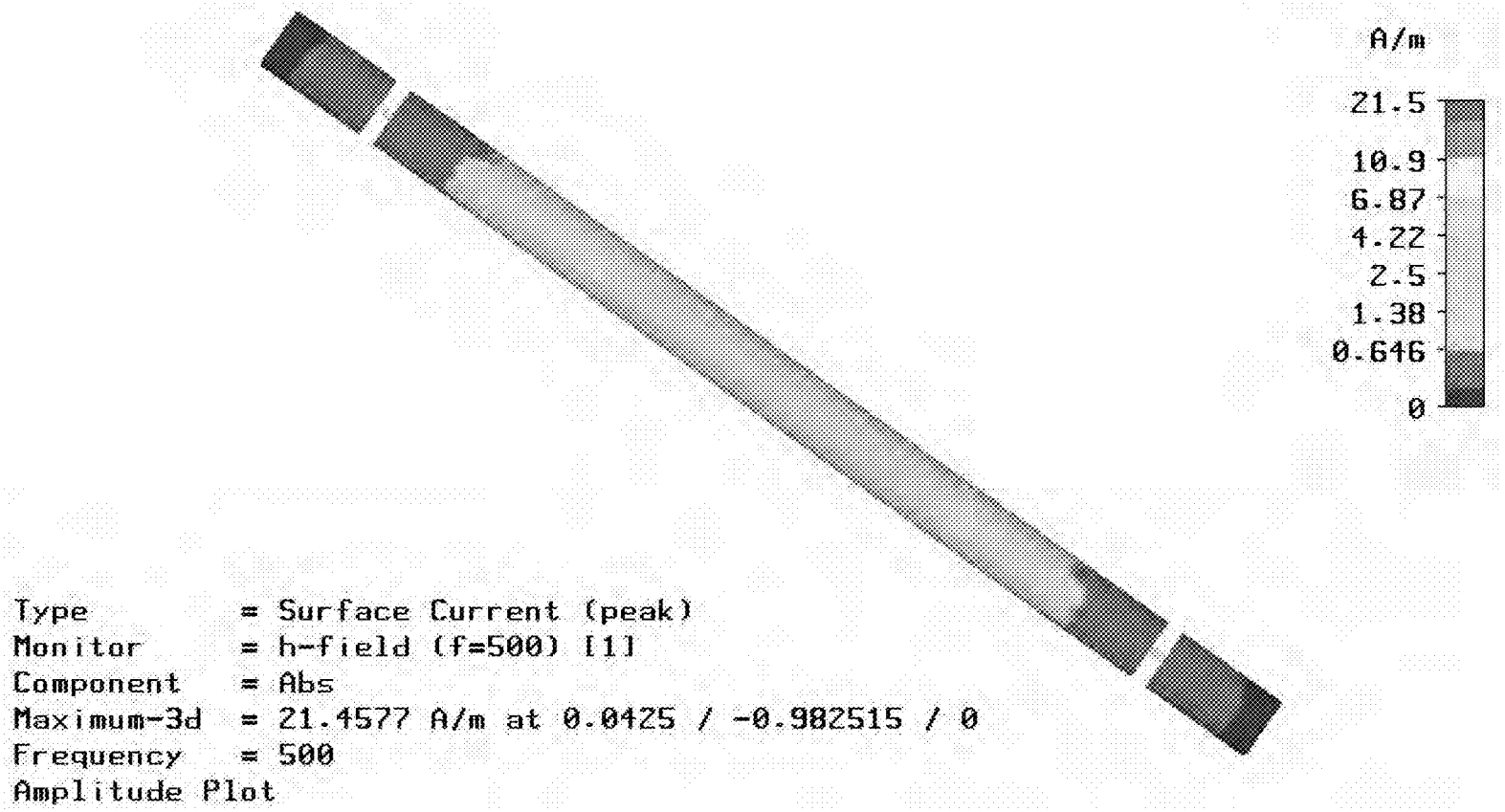
FIG. 51 is a MFD 2 surface current plot at 500 MHz.
Figure 52:
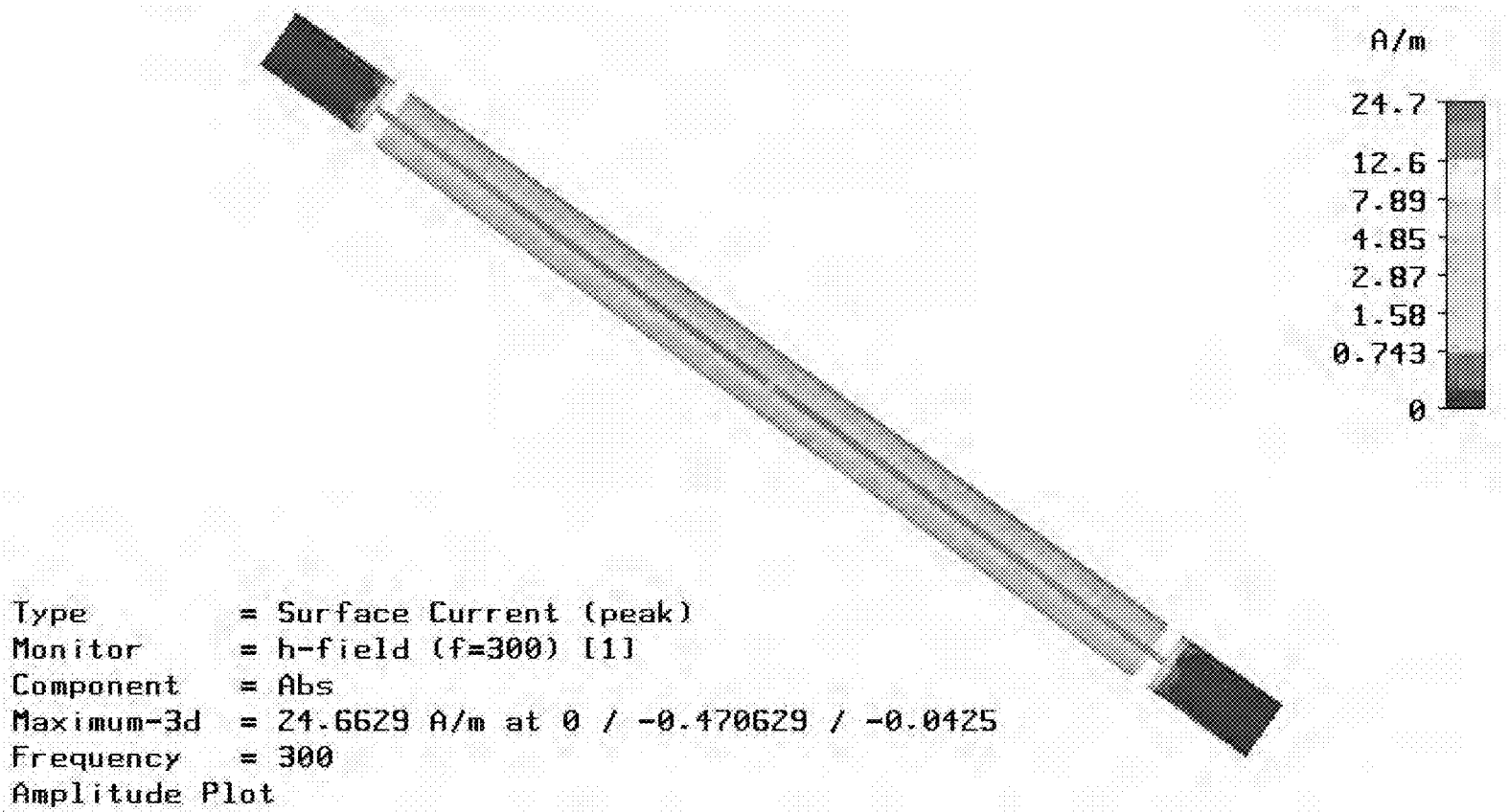
FIG. 52 is a MFD cross section current plot at 300 MHz.
Figure 53:
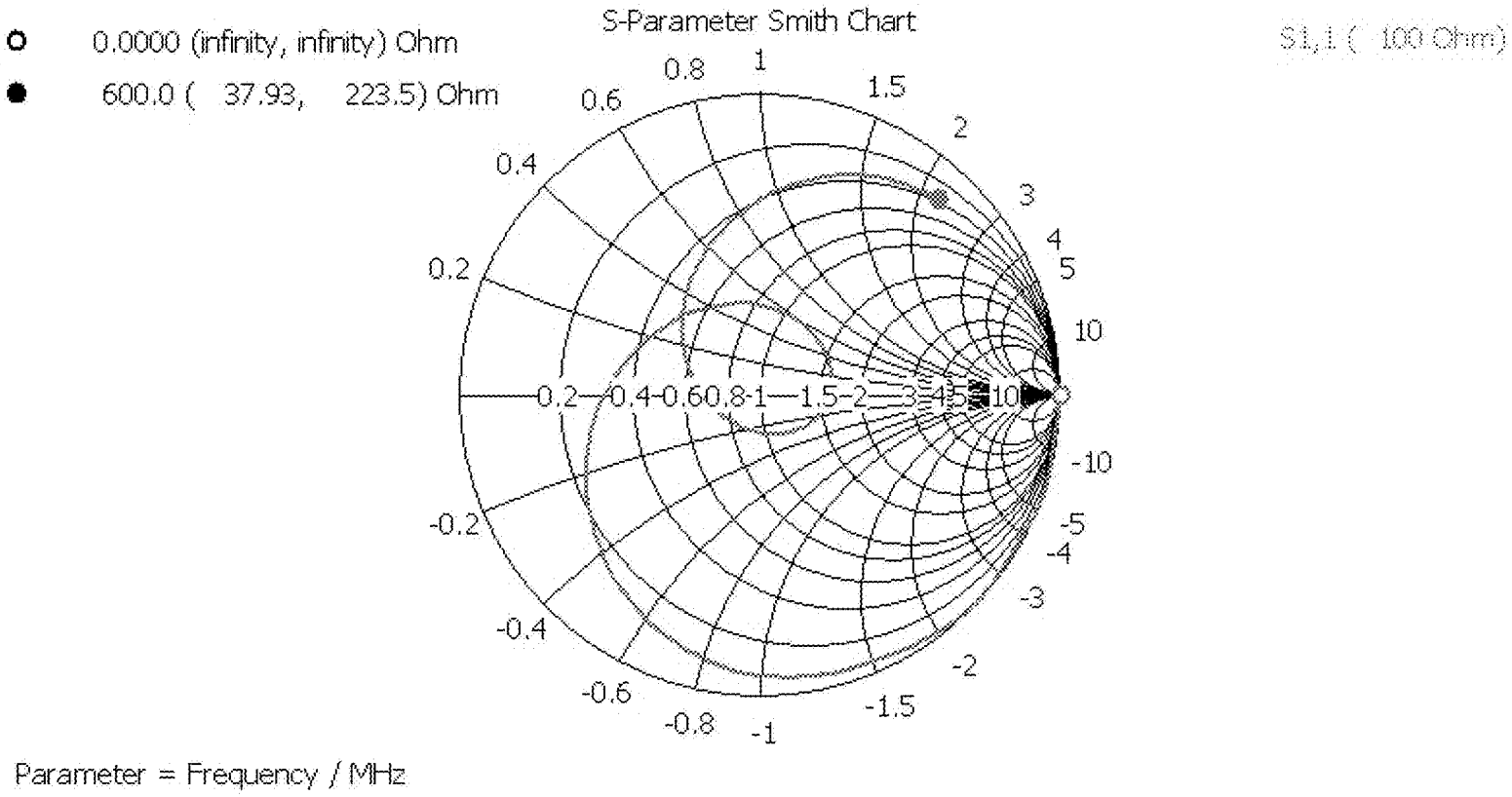
FIG. 53 is another MFD 2 input impedance Smith Chart referred to 100 ohms (also see FIG. 45).
Figure 54:
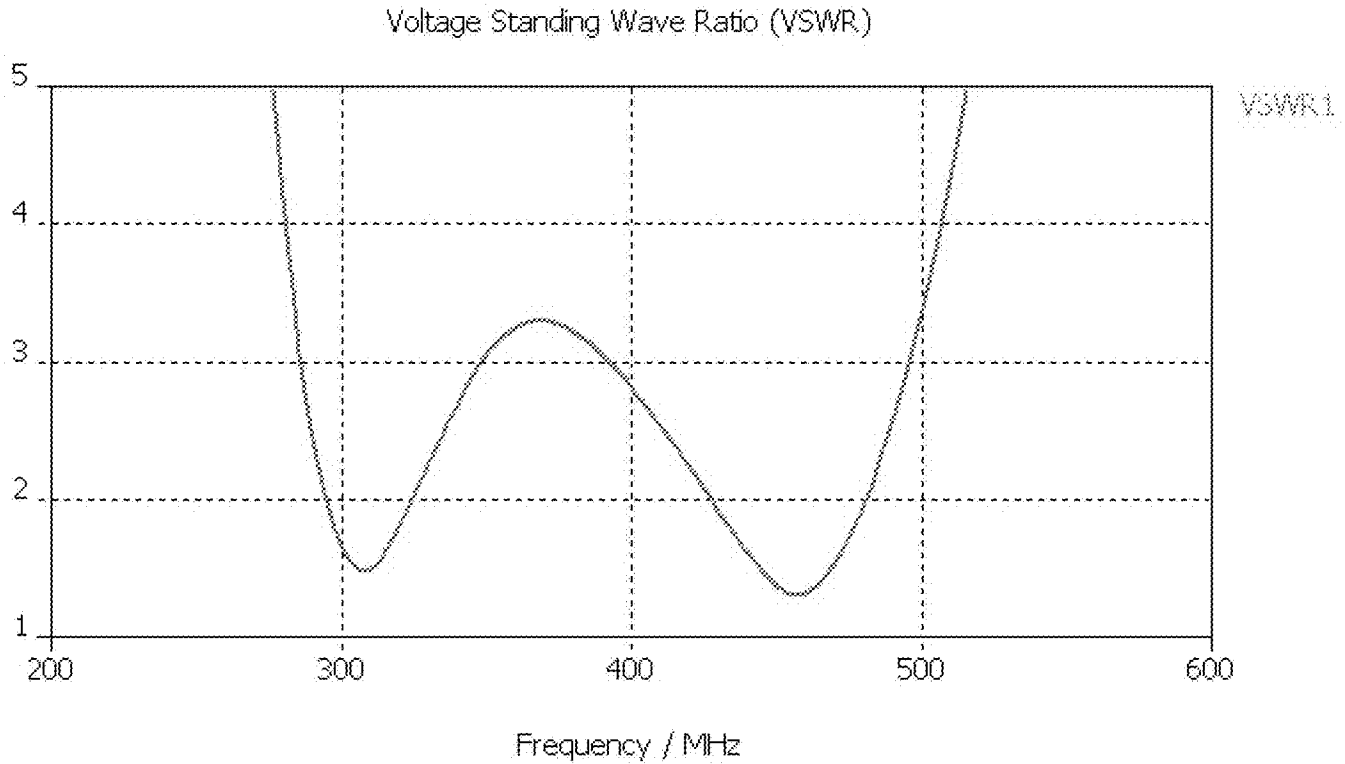
FIG. 54 is a voltage standing wave ratio chart for the MFD 2 at 100 Ohms.

FIG. 38 is a polar radiation pattern for a multi-feed dipole embodiment 2 at 100 MHz. This embodiment is smaller and has the top and bottom tube in smaller ratio sizes with respect to the MFD of FIG. 22. FIG. 39 is a polar radiation pattern for a multi-feed dipole embodiment 2 at 200 MHz. FIG. 40 is a polar radiation pattern for a multi-feed dipole embodiment 2 at 300 MHz. FIG. 41 is a polar radiation pattern for a multi-feed dipole embodiment 2 at 400 MHz. FIG. 42 is a polar radiation pattern for a multi-feed dipole embodiment 2 at 500 MHz. FIG. 43 is a cross section of the multi-feed embodiment 2. FIG. 44 is a side view of the multi-feed embodiment 2. FIG. 45 is a MFD 2 input impedance Smith Chart referred to 100 ohms. FIG. 46 is a MFD 2 input impedance Smith Chart referred to 50 ohms. FIG. 47 is a MFD 2 surface current plot at 100 MHz. FIG. 48 is a MFD 2 surface current plot at 200 MHz. FIG. 49 is a MFD 2 surface current plot at 300 MHz. FIG. 50 is a MFD 2 surface current plot at 400 MHz. FIG. 51 is a MFD 2 surface current plot at 500 MHz. FIG. 52 is a MFD cross section current plot at 300 MHz. FIG. 53 is another MFD 2 input impedance Smith Chart referred to 100 ohms (also see FIG. 45). FIG. 54 is a voltage standing wave ratio chart for the MFD 2 at 100 Ohms.

Figure 56:
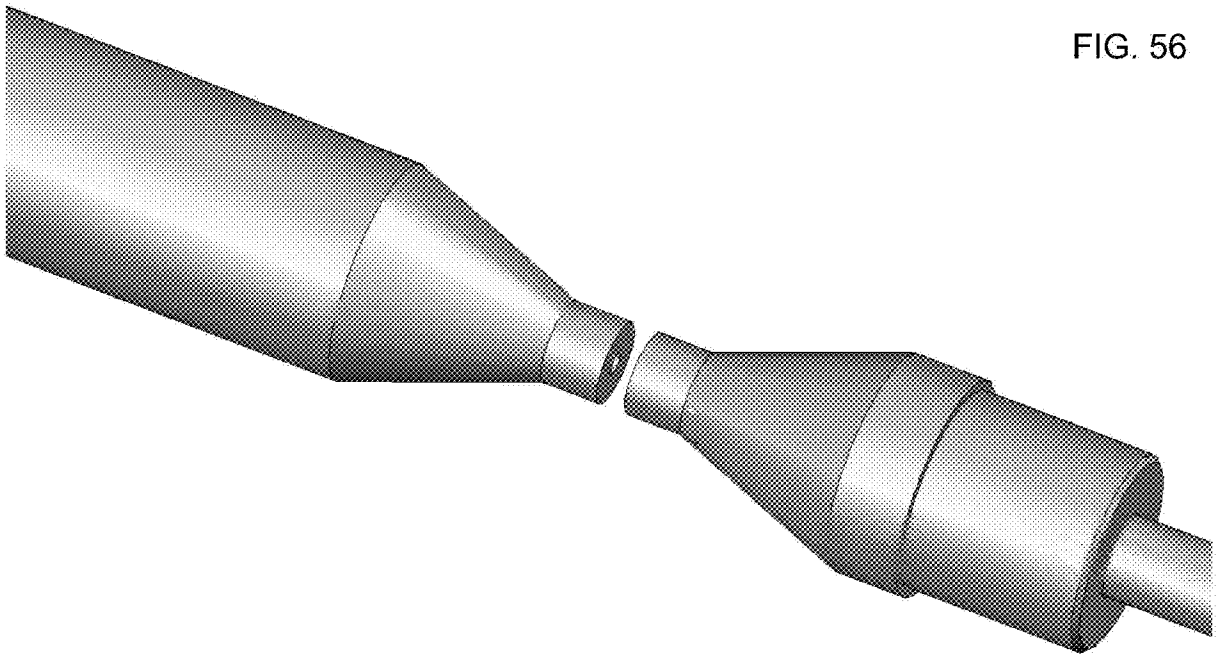
FIG. 56 shows the feed point, i.e., top pin (left side of figure) and bottom pin (here on the right side of the figure) with an indentation in the top pin for coupling with the center conductor of a coaxial transmission line, while the bottom pin is coupled with the outer conductor of the coaxial transmission line.

FIG. 56 shows the feed point, i.e., top pin (left side of figure) and bottom pin (here on the right side of the figure) with an indentation in the top pin for coupling with the center conductor of a coaxial transmission line, while the bottom pin is coupled with the outer conductor of the coaxial transmission line.

Figure 57:
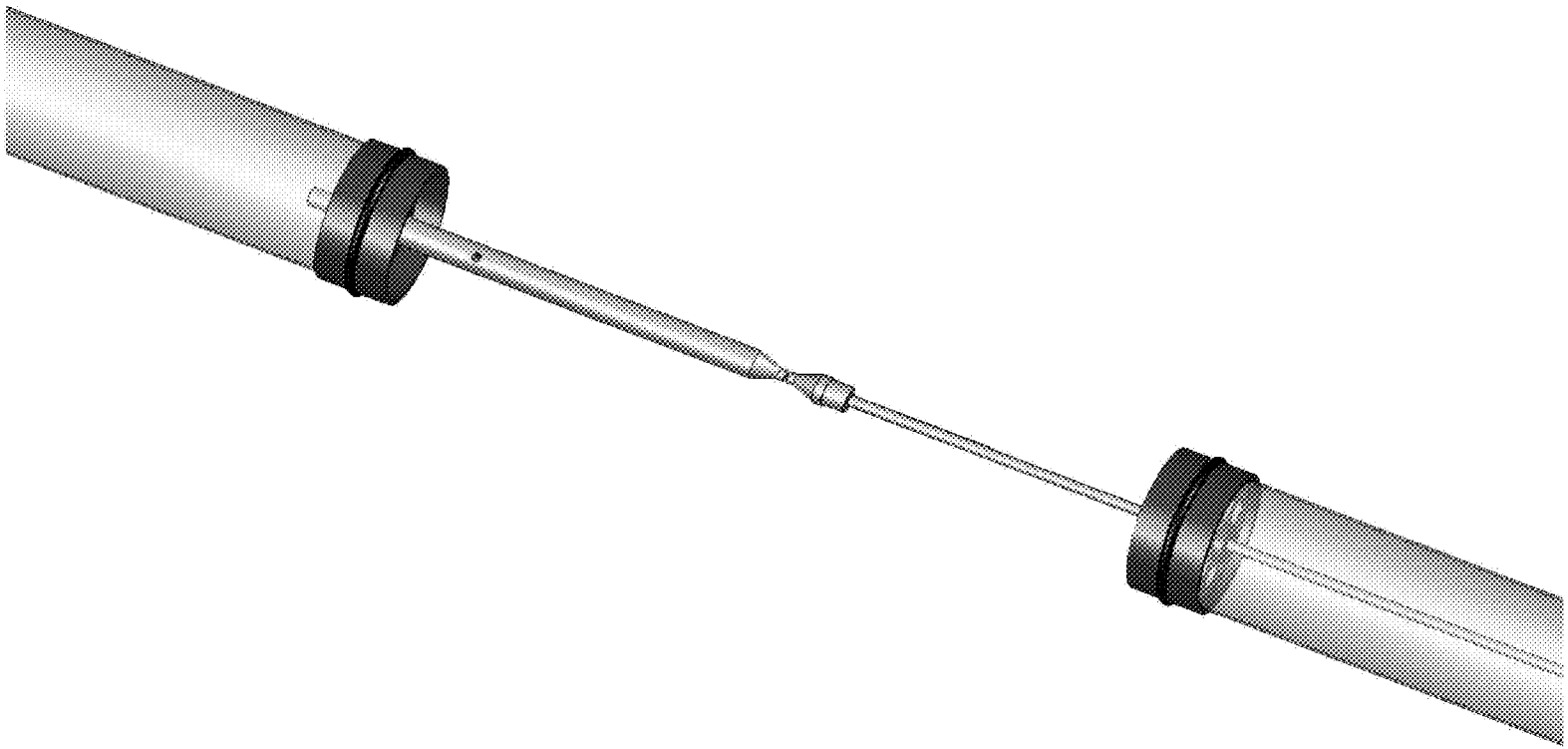
FIG. 57 shows a perspective view of the top pin and bottom pin with a coaxial transmission line coupling with the bottom pin and with the center tube not shown while the top and bottom tubes are shown as transparent.

FIG. 57 shows a perspective view of the top pin and bottom pin with a coaxial transmission line coupling with the bottom pin and with the center tube not shown while the top and bottom tubes are shown as transparent.

Figure 58:
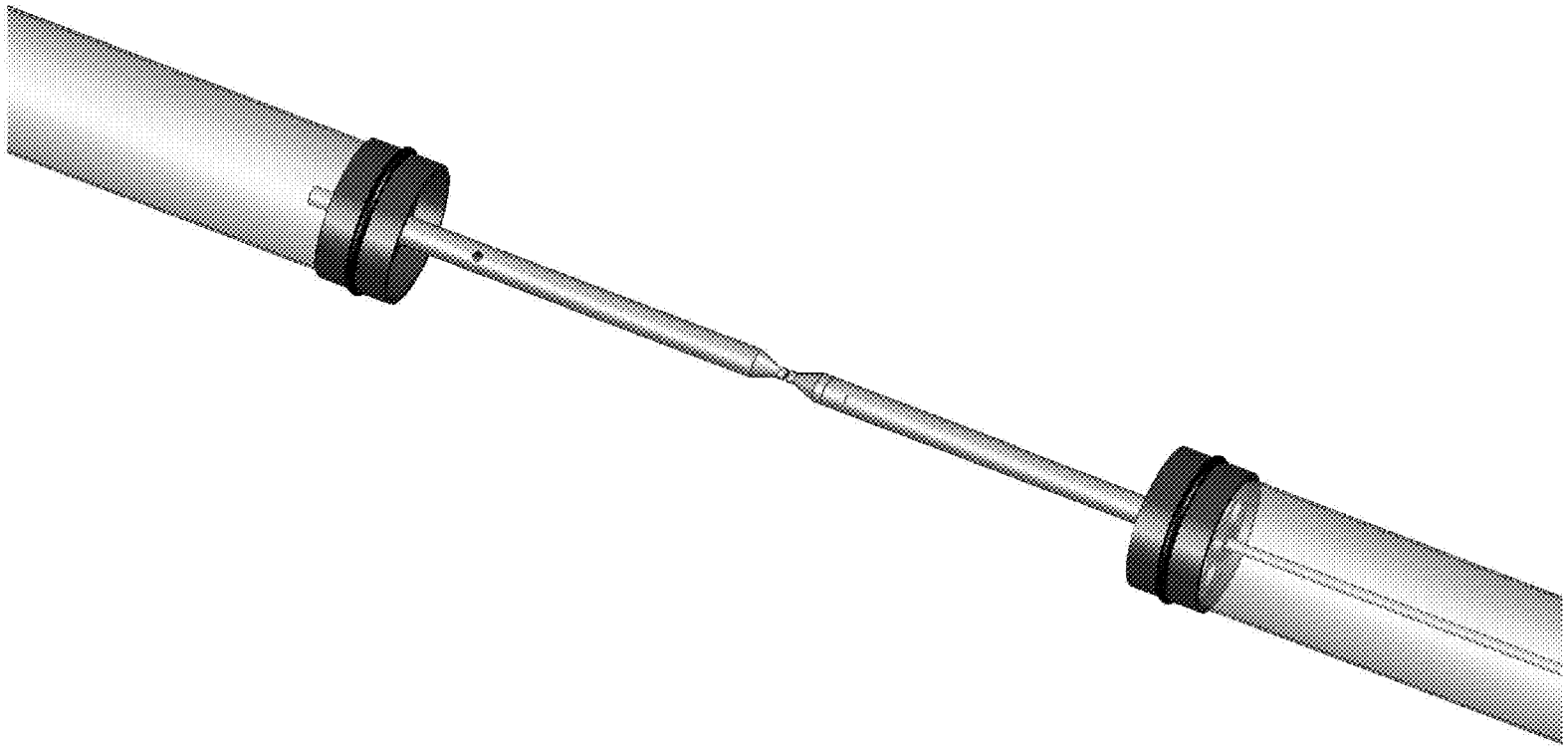
FIG. 58 shows FIG. 57 with the addition of the bottom pin tube surrounding the coaxial transmission line and coupled with the bottom pin.

FIG. 58 shows FIG. 57 with the addition of the bottom pin tube surrounding the coaxial transmission line and coupled with the bottom pin.

Figure 59:
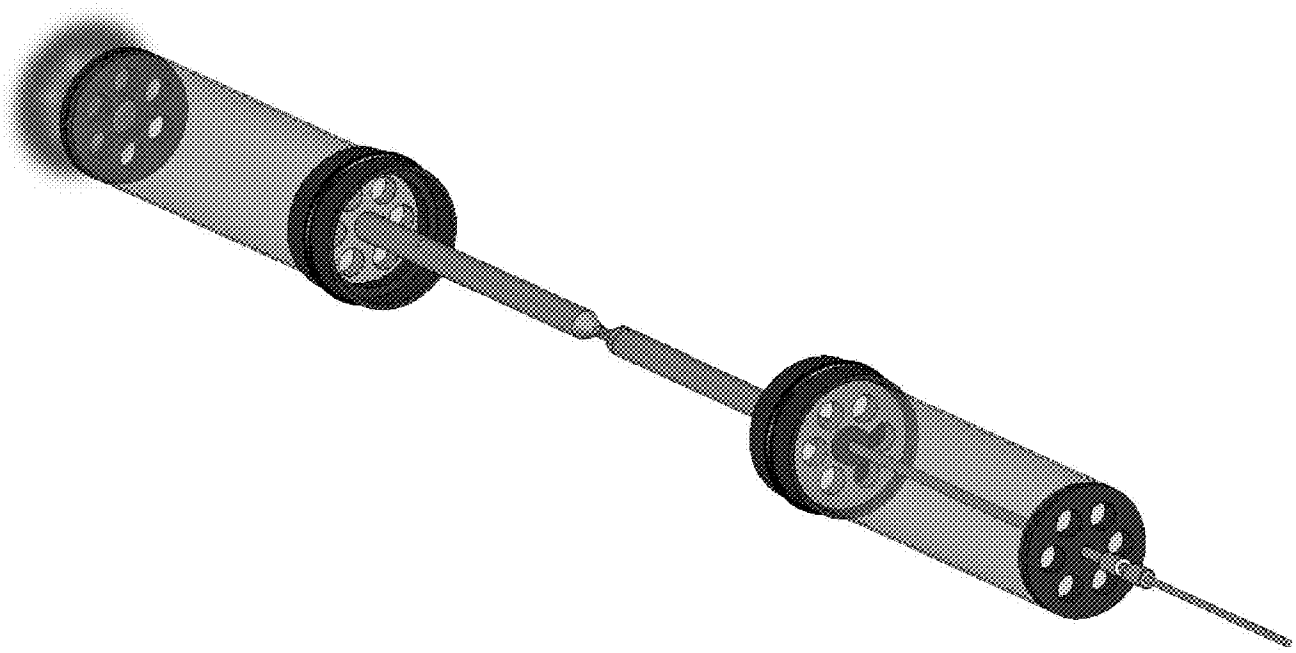
FIG. 59 shows an alternate perspective of FIG. 58 with the coaxial plug visible and a coaxial line coupled with the coax splice component.

FIG. 59 shows an alternate perspective of FIG. 58 with the coaxial plug visible and a coaxial line coupled with the coax splice component.

Figure 60:
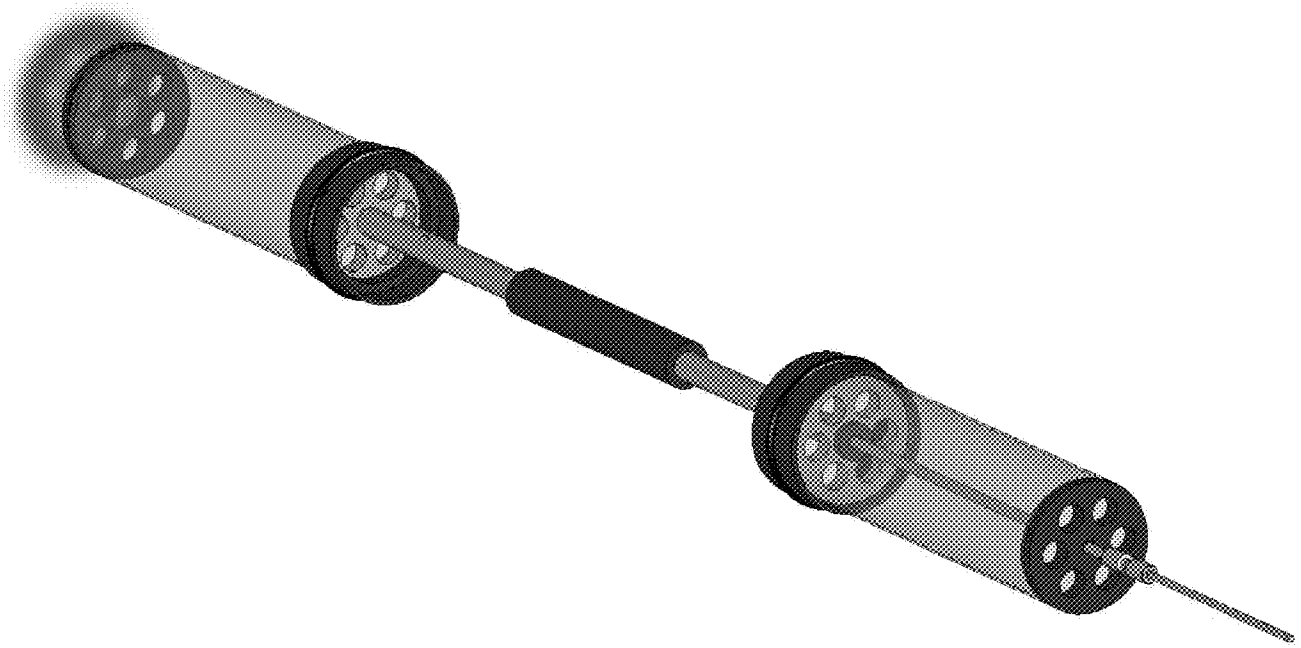
FIG. 60 shows an insulative connection sleeve surrounding the feed point and providing structure support to the top and bottom pin.

FIG. 60 shows an insulative connection sleeve surrounding the feed point and providing structure support to the top and bottom pin.

Figure 61:
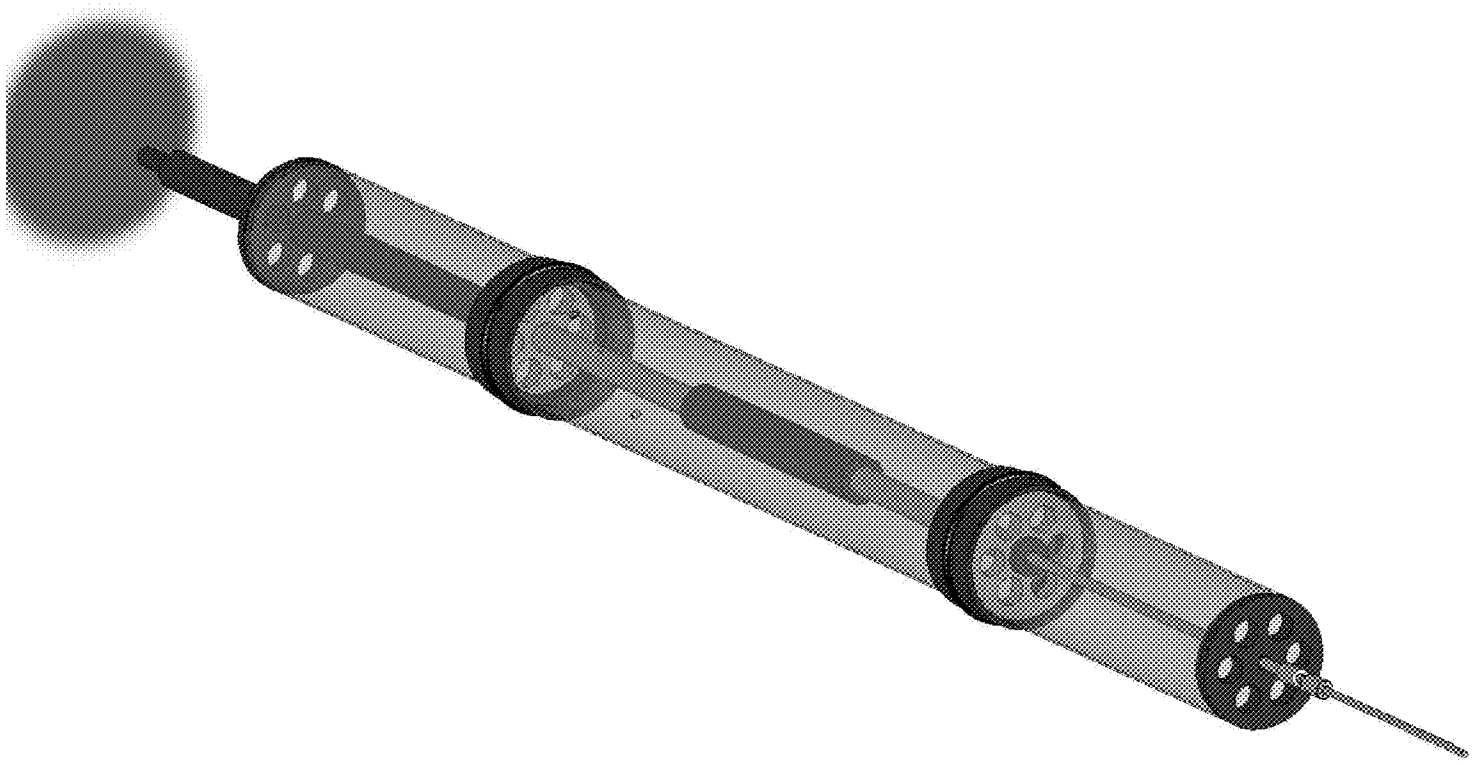
FIG. 61 shows the center tube as transparent and in addition shows the top mounting rod.

FIG. 61 shows the center tube as transparent and in addition shows the top mounting rod.

Figure 62:
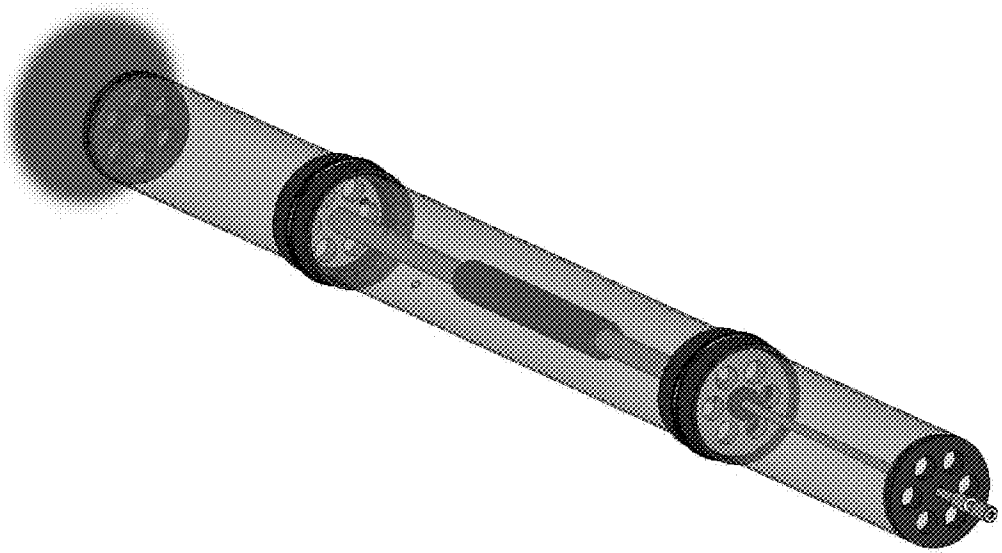
FIG. 62 shows an alternate view of FIG. 61 without the top mounting rod.

FIG. 62 shows an alternate view of FIG. 61 without the top mounting rod.

Figure 63:
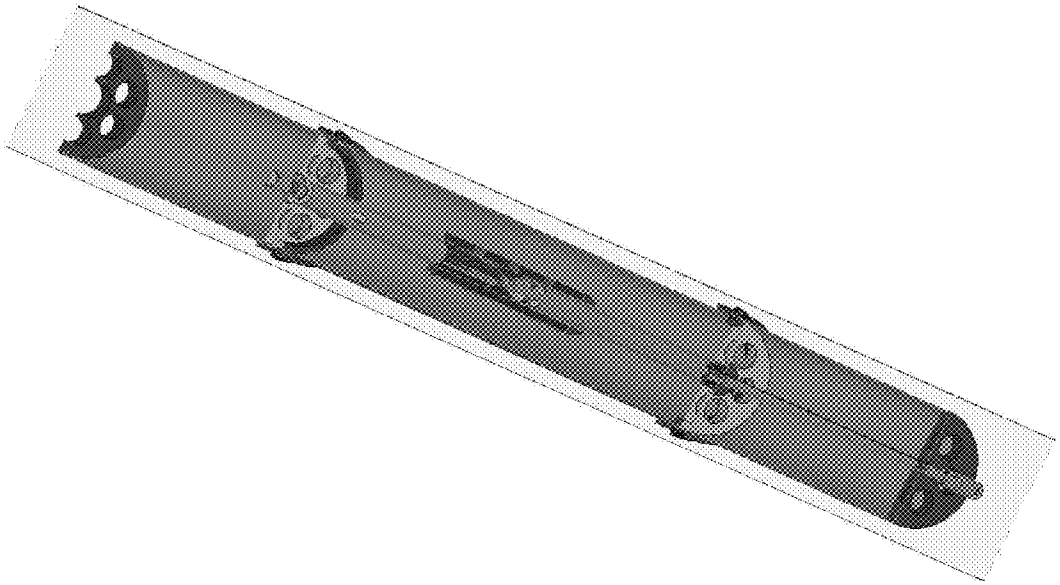
FIG. 63 shows a cross section of the MFD.

FIG. 63 shows a cross section of the MFD.

Figure 64:
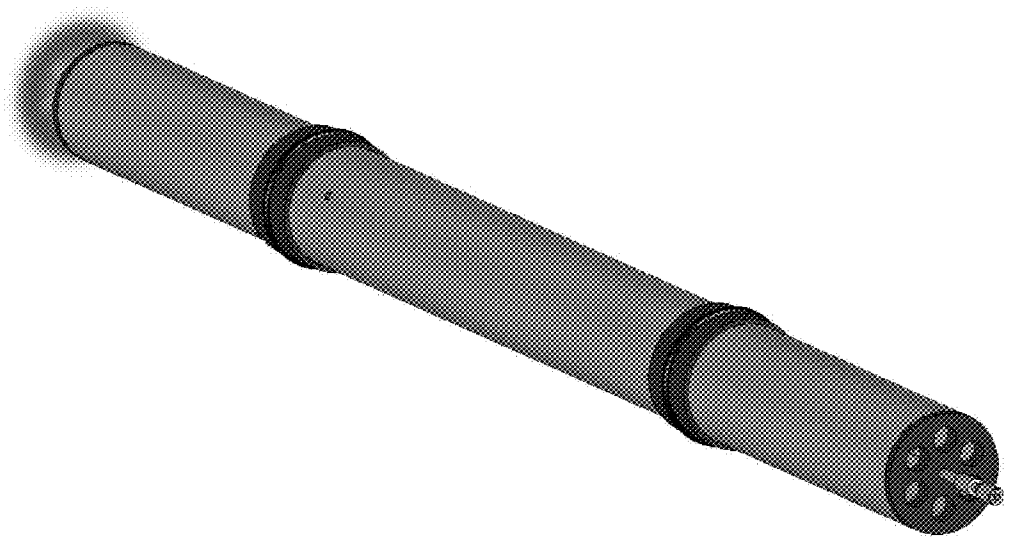
FIG. 64 shows a surface shaded version of the MFD with top, center and bottom tubes shown as opaque.

FIG. 64 shows a surface shaded version of the MFD with top, center and bottom tubes shown as opaque.

Figure 65:
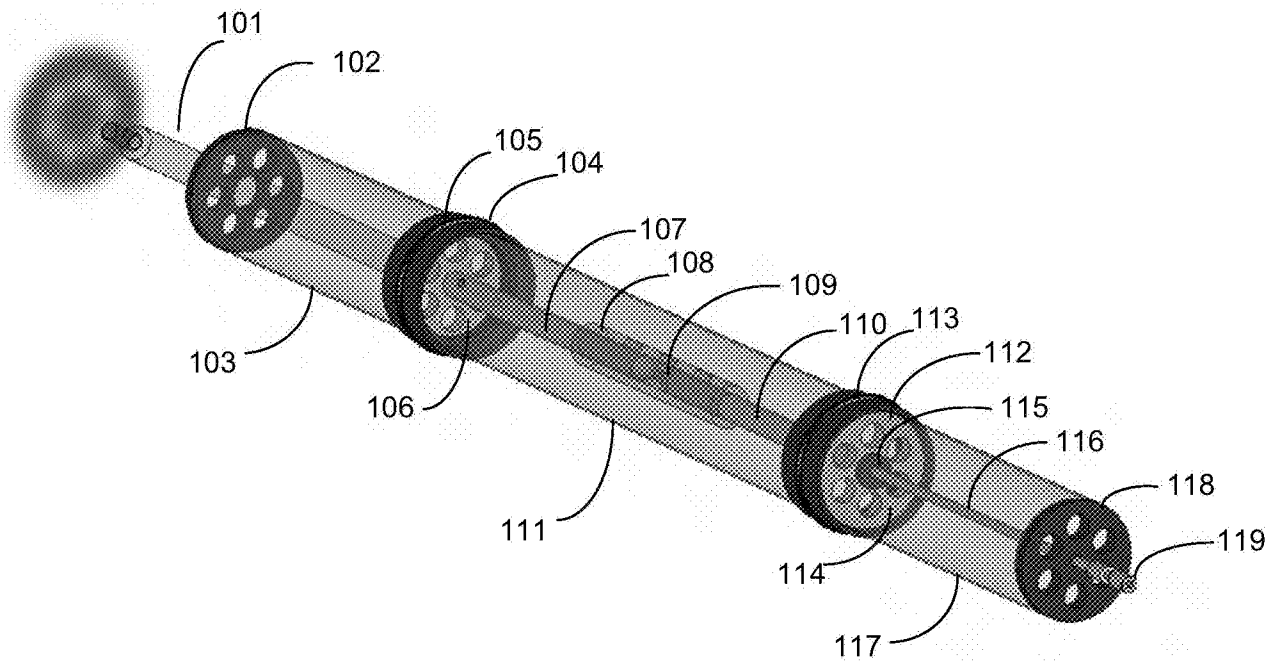
FIG. 65 shows an annotated version of the MFD with the top, center, bottom tubes and connection sleeve and top mounting rod as transparent.

FIG. 65 shows an annotated version of the MFD with the top, center, bottom tubes and connection sleeve and top mounting rod as transparent. Embodiments of the invention are generally constructed from three coaxial metallic tubes. The three coaxial metallic tubes are designated the top tube 103, center tube 111 and bottom tube 117 (See FIG. 65). The two outermost tubes, i.e., top tube 103 and bottom tube 117, are coupled with metal top pin 107 and metal bottom pin 109 housed in bottom pin tube 110. Bottom pin tube 110 is hollow and allows for coaxial cable 116 to travel within. Coaxial cable 116 (for example Micro-Coax UT-85 0.085" diameter coax) that acts to transfer signals to top pin 107 then to top tube 103 via a conductor, for example top pin plate 106 and to the bottom pin 109 (through bottom pin tube 110) to bottom tube 117 via a conductor, for example bottom pin plate 114. The inner most tube, i.e., center tube 111 is mounted to top tube 103 and bottom tube 117 via insulators such as top support cap 104 and bottom support cap 112 so as to parasitically radiate energy via induction from top tube 103 and bottom tube 117. Top pin 107 and bottom pin 109 along with bottom pin tube 110 are mounted via an insulator such as connection sleeve 108 to provide for a durable coupling. Any method of mounting the top, center and bottom tubes together wherein the top and bottom tubes are connected to the top and bottom pins respectively while the center tube is electrically isolated from the top and bottom tube is in keeping with the spirit of the invention. Top tube cap 102 is an insulator and has a centrally configured hole to allow for optional top mounting rod 101 to travel through the hole. Top support cap 104 may include two halves that are kept apart via top o-ring 105. Bottom support cap 112 likewise may include two halves that are kept apart via bottom o-ring 113. Coax cable 116 may be mounted through bottom pin plate 114 via coax plug 115. Bottom tube cap 118 is an insulator that allows for coaxial cable 116 to travel through it to coax splice 119. The coaxial cable 116 may be a quarter-wavelength section of 75-ohm coaxial cable for example while the coax feeding the antenna may be 50-ohm coaxial cable. Coaxial cable splice 119 may be coupled with or include ferrite beads (for example Fair-Rite 266-1000801 with 0.094" center hole) to eliminate current flow on the outer surface of the feed line to the antenna.

Figure 67:
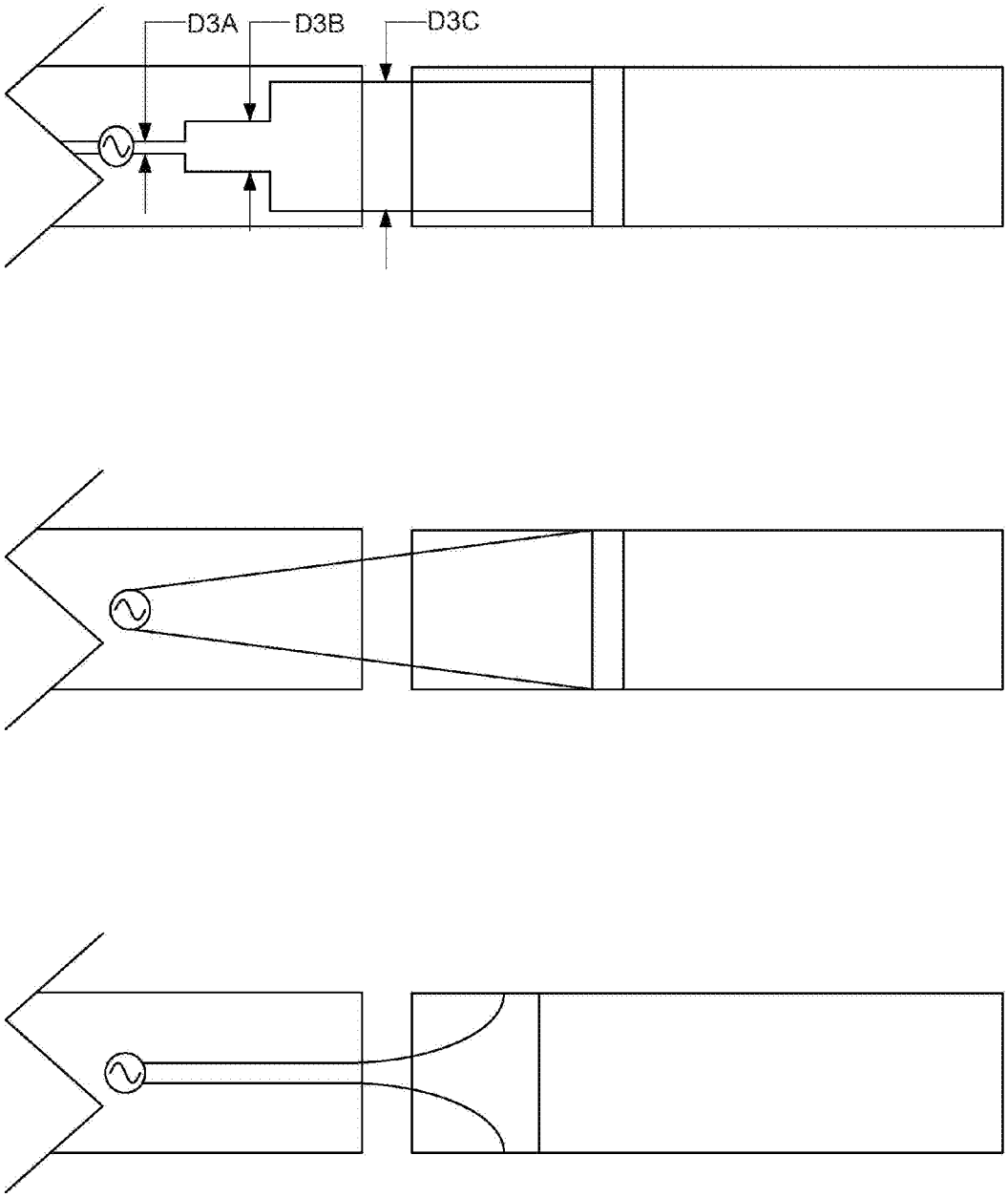
FIG. 67 shows variants of the pin shapes for altering the impedance of the MFD.

FIG. 66 shows a side drawing with annotations depicting the various dimensions of the MFD and on the bottom of the page a circuit equivalent of the MFD. FIG. 67 shows variants of the pin shapes for altering the impedance of the MFD. Embodiments of the invention utilize top and bottom tube diameters that are generally as thick as the center tube section. Variations of these dimensions including the distance S from which the top and bottom pin plates are offset within the top and bottom tubes is in keeping with the spirit of the invention. For example any dipole that has multiple feed points with a parasitic center tube is in keeping with the spirit of the invention regardless of the tube diameters or shapes. Furthermore, alteration of the depth of pin plate mounting within the top and bottom tube, and/or the shape of the pins that couple the feed point with the top and bottom tubes is in keeping with the spirit of the invention. The various dimensions are abbreviated as follows:

D1—diameter of upper and lower tube.

D2—diameter of center tube; generally, but not required to be the same as D1.

D3—The diameter of the inner feed rods. This diameter and the inner diameter of the center tube sets the impedance of the internal feedline (Za).

L1—length of the center tube.

G—width of gap between center tube and upper/lower tubes.

S—inset distance to the feed short. Increasing S adds a series feed inductance between the internal transmission line and the feed gap.

Loal—Length Over All.

Za—the characteristic impedance of the internal transmission line.

Zs—the characteristic impedance of the internal transmission line in the upper and lower sections; made different from Za by changing the diameter D3 in this section, if necessary for impedance matching.

ls—the electrical length of the shorted transmission line represented by the physical length S.

Zg—the impedance of the feedpoint across the gap.

Figure 68:
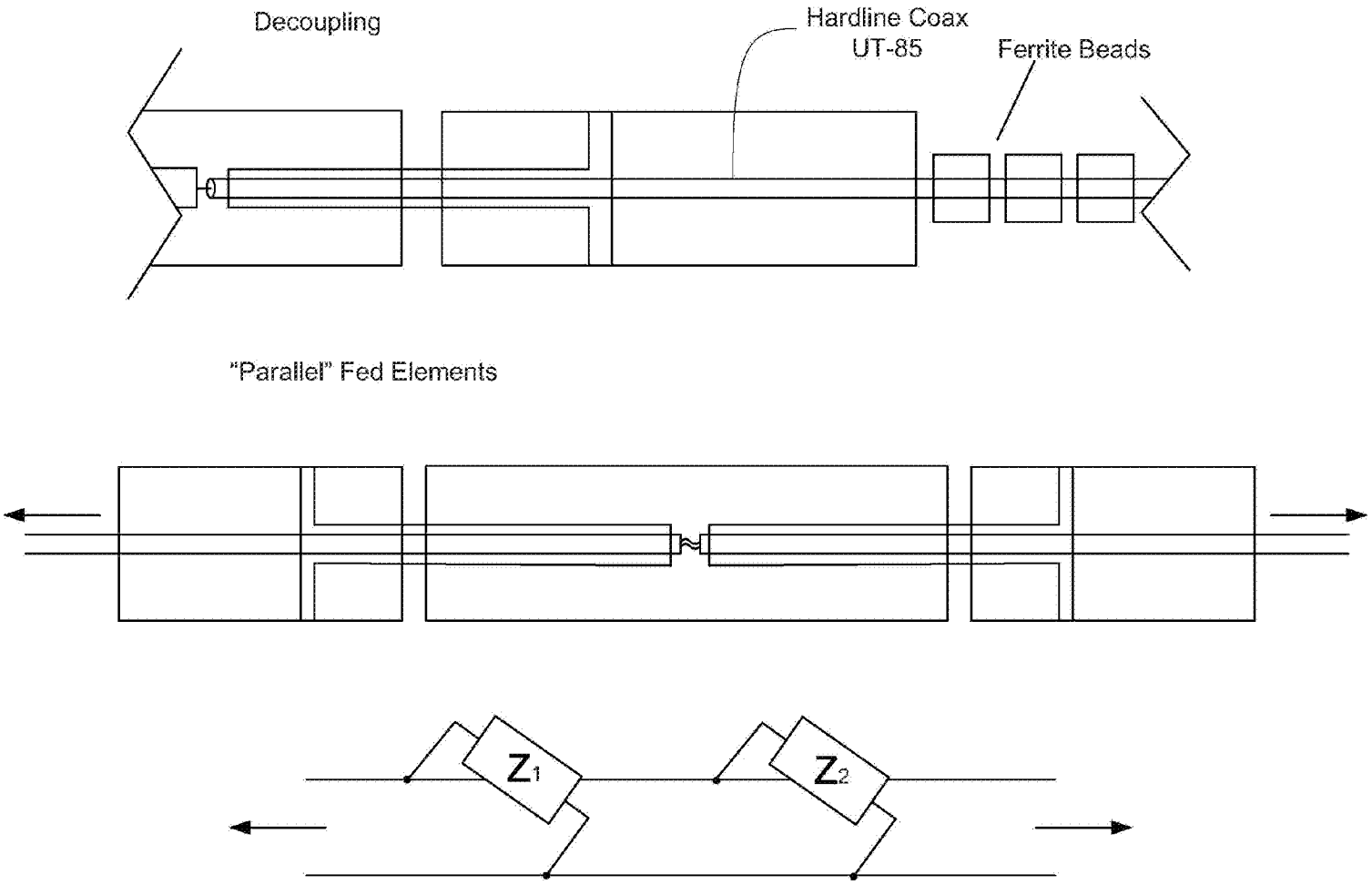
FIG. 68 shows decoupling of the MFD with ferrite beads and a parallel fed embodiment and circuit equivalent.

FIG. 68 shows decoupling of the MFD with ferrite beads and a parallel fed embodiment and circuit equivalent. UT-85 refers to the type of coaxial cable, a generic version of which is 0.085-in. diameter coaxial cable for example.

Referring to the upper drawing in FIG. 68 labelled "Decoupling", the primary means for decoupling the feedline from the antenna is a series of ferrite beads. The three beads shown present an impedance on the outer conductor of the coax, at the frequencies of normal operation of the antenna, of approximately 600 ohms. This is sufficient to prevent current flow on the outside of the coaxial line which would distort the pattern, or otherwise make the antenna operate in other than the intended mode. Additional decoupling is afforded by the inside of the lower tube. Current that "wraps around" from the end of the antenna travels back up the inside of the lower tube in order to reach the connection point of the coax. This presents an additional inductive reactance which aids the decoupling. Importantly, embodiments of the invention do not depend upon a shorted quarter-wave choke formed by this path in order to provide decoupling; this would be a narrowband structure and counter to the spirit of the invention.

Referring to the lower drawing in FIG. 68 labeled "Parallel Fed Elements", this depicts a method where the coaxial cable feeding embodiments of the invention cross-connects with another coaxial feedline which departs the antenna on the opposite side to continue to feed another antenna. This method allows multiple wideband elements to be connected on the same feedline, which may provide for a controlled radiation pattern, or wider bandwidth, or some other advantage. Collinear arrays of similar elements is a common practice for achieving higher antenna gain, and if such an array is designed for the high frequency end of the element operation, and the feed carefully designed, very wideband operation is maintained. Since element spacing is fixed, however, an array designed to increase gain will generally sacrifice some of its bandwidth of operation.

Figure 69:
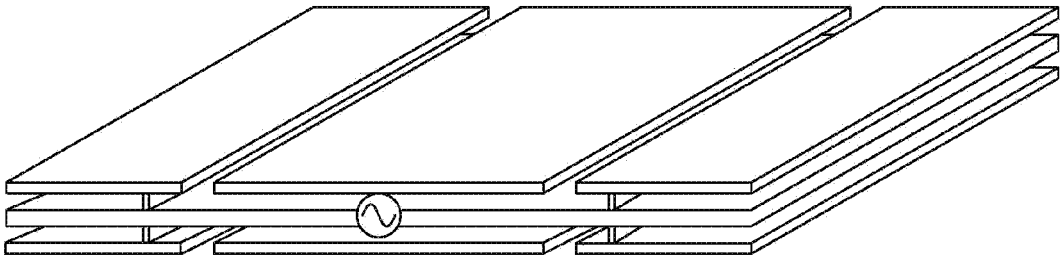
FIG. 69 shows a planar embodiment, i.e., a flattened tubular embodiment.

FIG. 69 shows a planar embodiment, i.e., a flattened tubular embodiment. See also FIGS. 75-84 for more detail regarding this embodiment.

Figure 70:
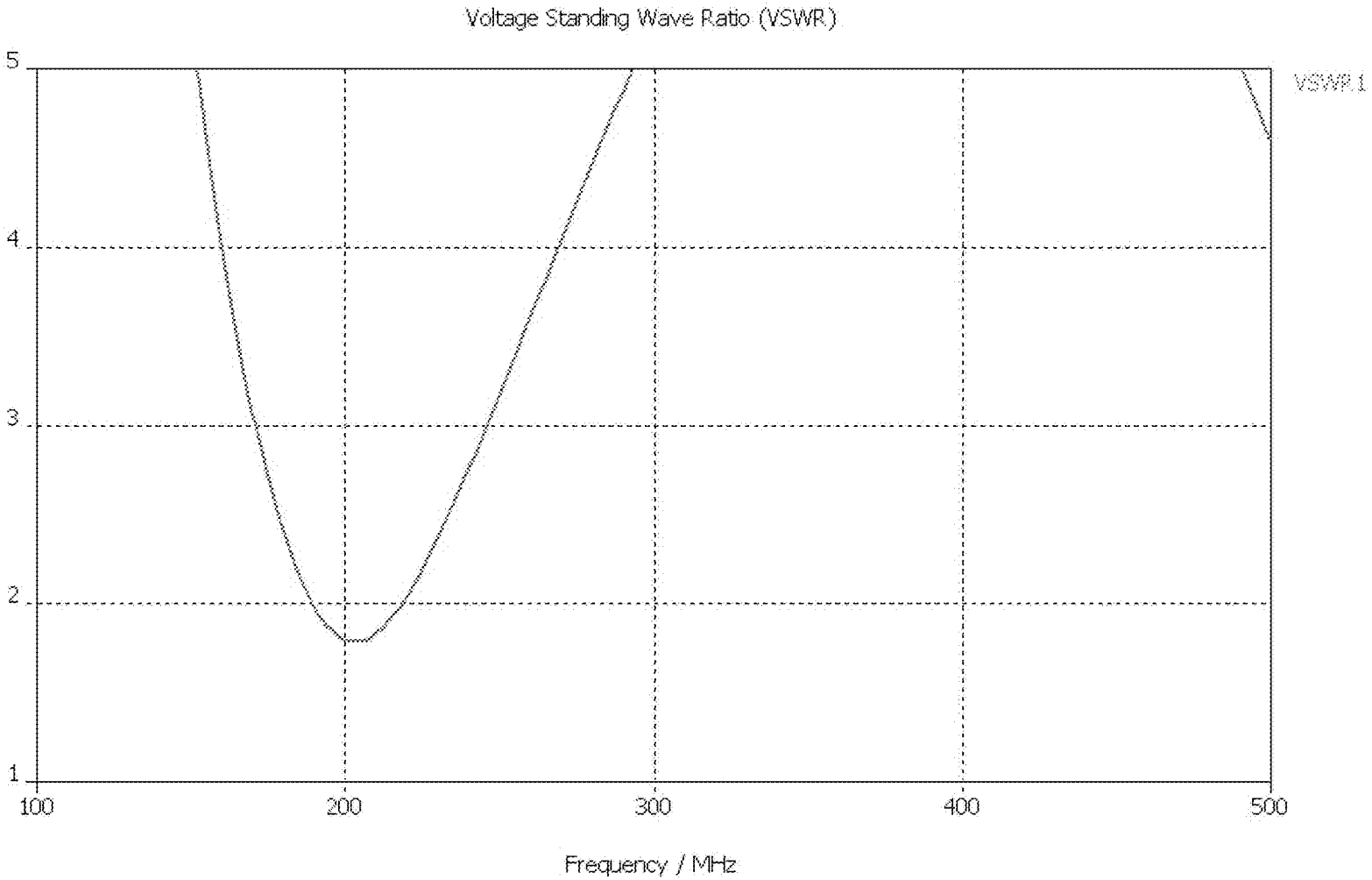
FIG. 70 shows a voltage standing wave ratio for a basic dipole at 100 Ohms.

FIG. 70 shows a voltage standing wave ratio for a basic dipole at 100 Ohms.

Figure 71:
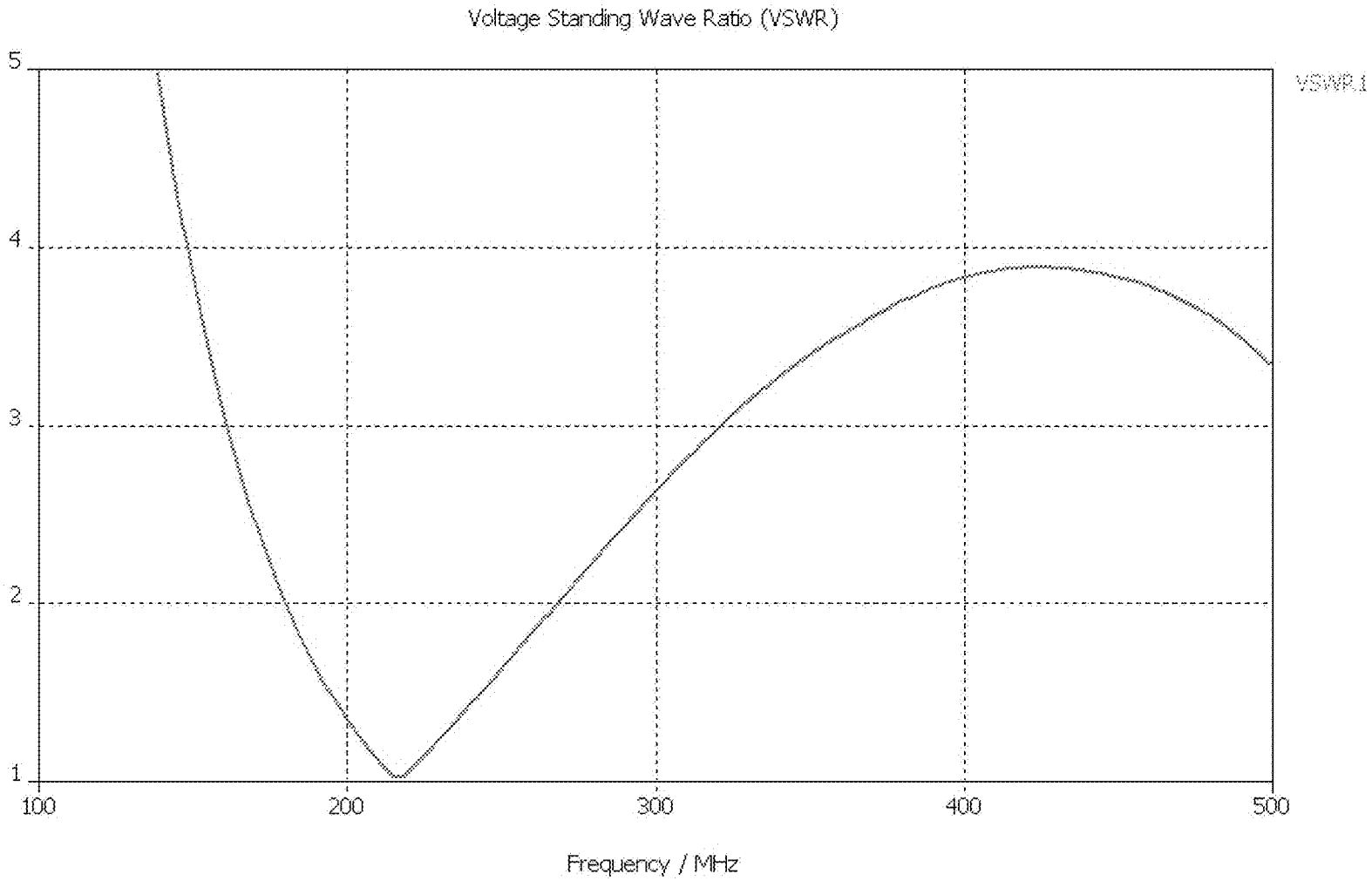
FIG. 71 shows a voltage standing wave ratio for a basic dipole at 50 Ohms.

FIG. 71 shows a voltage standing wave ratio for a basic dipole at 50 Ohms.

Figure 72:
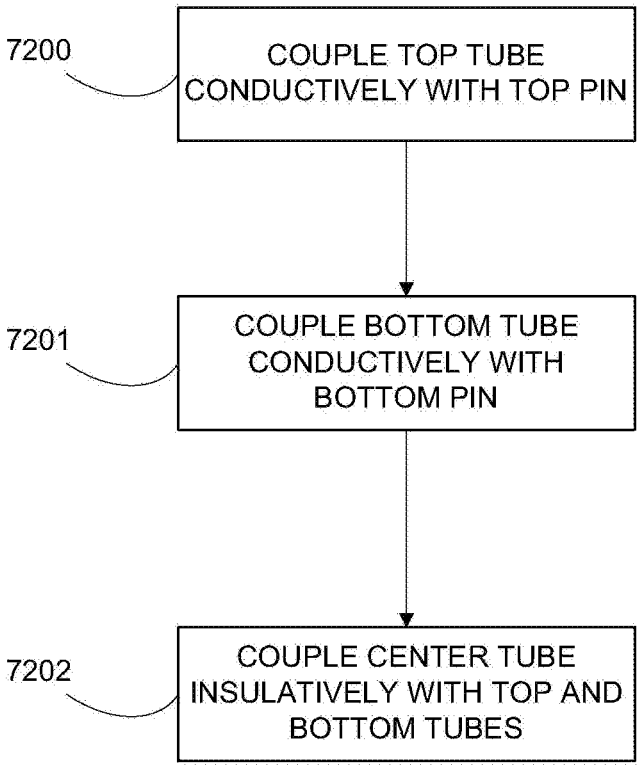
FIG. 72 shows a flow chart for enabling an embodiment of the invention.

FIG. 72 shows a flow chart for enabling an embodiment of the invention. The top tube is conductively coupled to the top pin at 7200. The bottom tube is conductively coupled to the bottom pin at 7201. The center tube is insulatively coupled to the top and bottom tubes at 7202. The center tube thus provides a parasitic component over which current flows in response to signals applied to the top and bottom tubes. Conductively coupled means any type of coupling that allows for current to flow. Insulatively coupled means any type of coupling that attempts to prevent current flow.

Figure 75:
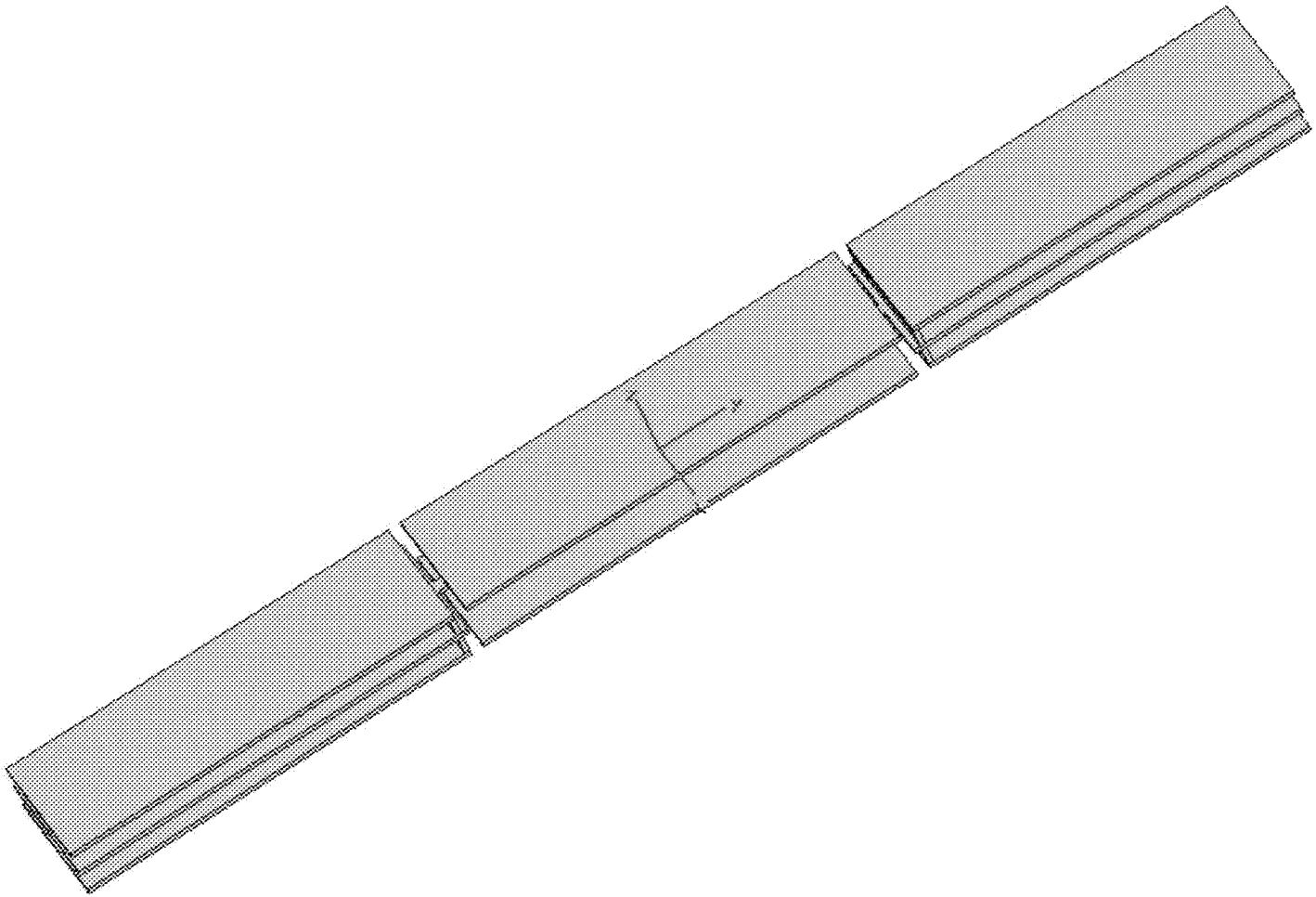
FIG. 75 shows an overview of the planar embodiment shown in FIG. 69.

FIG. 75 shows a detailed planar embodiment of FIG. 69. This embodiment of the MFD antenna efficiently fills a rectangular volume. The example embodiment shown in FIG. 75 fills a rectangular volume with a cross-section of approximately 50 mm by 22 mm, approximately one half-meter long. This embodiment for example may be constructed from an aluminum sheet with a thickness of less than, equal to or greater than 2 mm. The planar embodiment drawings do not show any dielectric spacers for clarity and ease of viewing.

Figure 76:
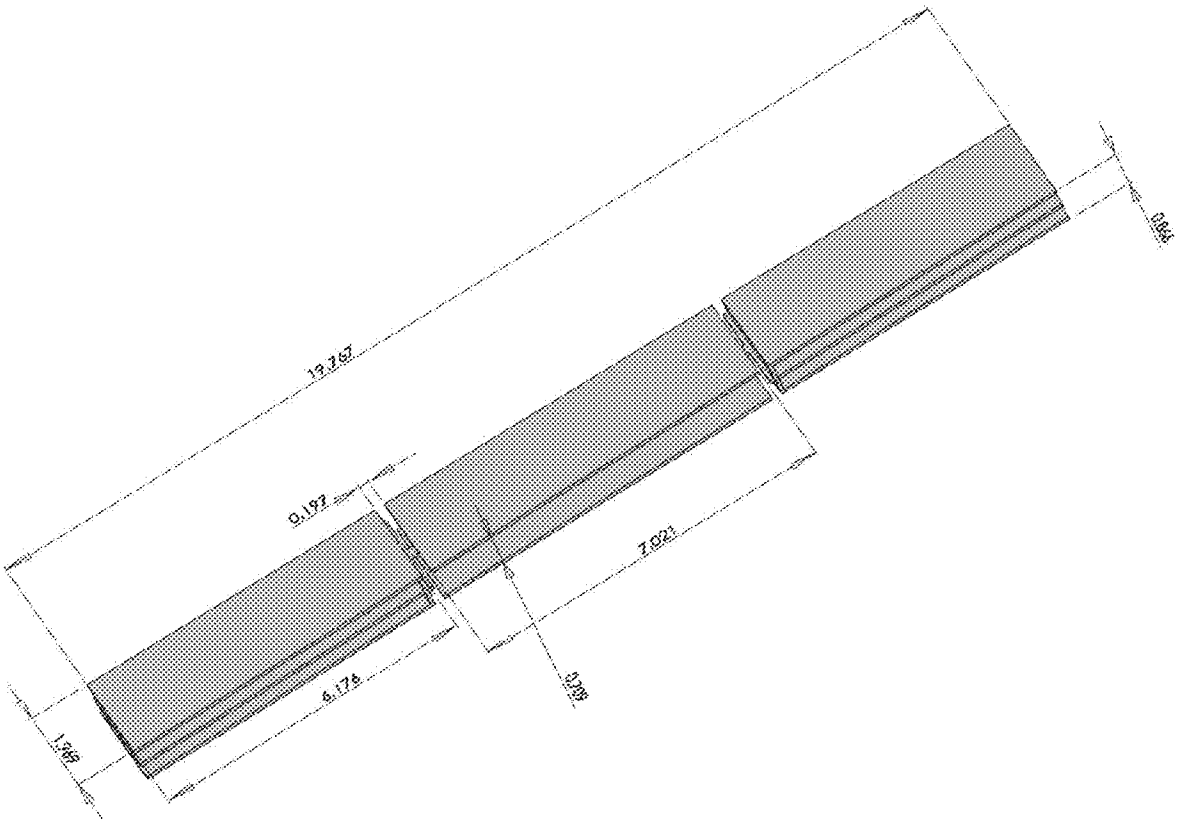
FIG. 76 shows a dimensioned (in millimeters) view of the planar embodiment shown in FIG. 75.

FIG. 76 shows a dimension view of the planar embodiment shown in FIG. 75. For the exemplary embodiment shown, this antenna provides a very wide pattern and impedance-bandwidth from approximately 220 MHz through 547 MHz with an SWR below 2.5:1. This operation covers a frequency ratio of over 2.4:1. The feedpoint impedance of this antenna with the exemplary dimension provided is thus optimized for a nominal value of 100 ohms. The principle of operation of this antenna is analogous to that of the tubular embodiment of the MFD antenna. Whereas the interior transmission line of the tubular embodiment may be of coaxial type, the interior transmission line of the planar version may be of a stripline type for example.

Figure 77:
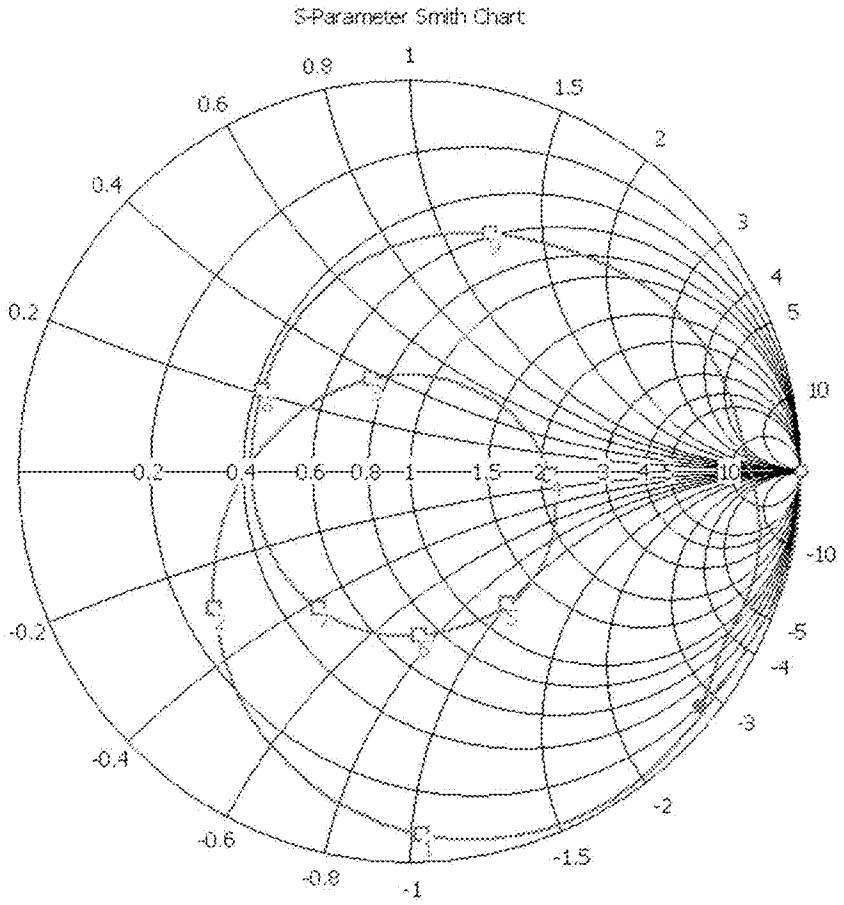
FIG. 77 shows a feed point impedance Smith Chart referred to 100 Ohms, as simulated for the planar embodiment.

FIG. 77 shows a feed point impedance Smith Chart referred to 100 Ohms.

Figure 78:
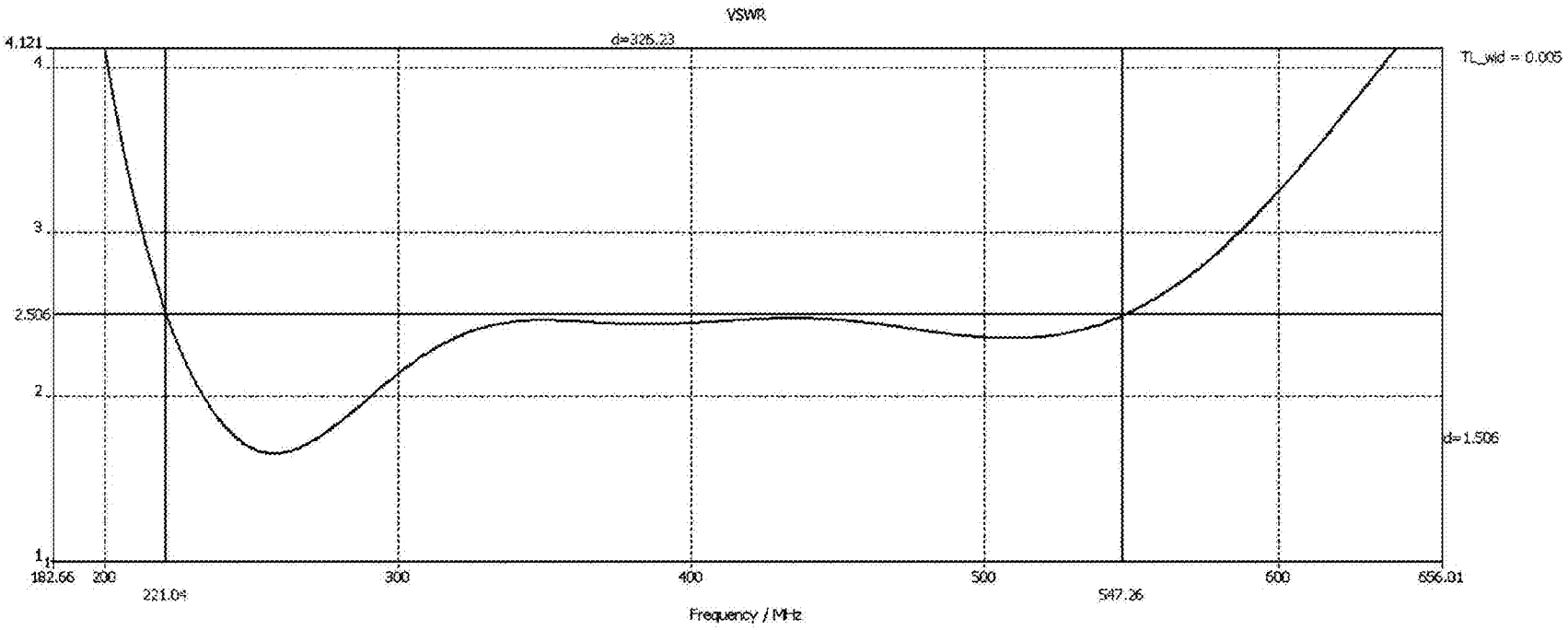
FIG. 78 shows a voltage standing wave ratio for the planar embodiment of FIG. 75.

FIG. 78 shows a voltage standing wave ratio for the planar embodiment of FIG. 75.

Figure 79:
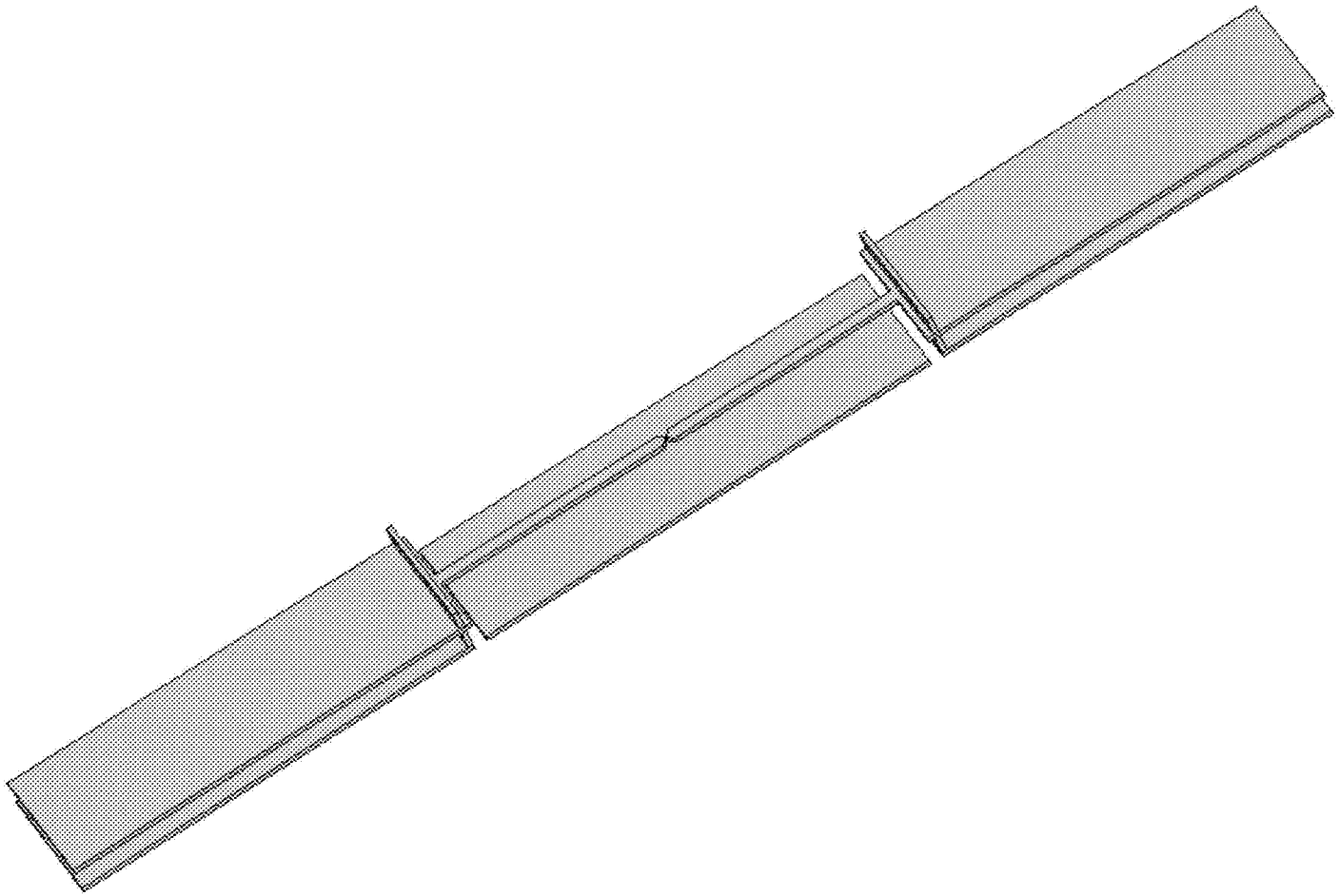
FIG. 79 shows the top plates removed from the embodiment of FIG. 75 to show feedpoint and shorts details.

FIG. 79 shows the top plates removed from the embodiment of FIG. 75 to show feedpoint and shorts details.

Figure 80:
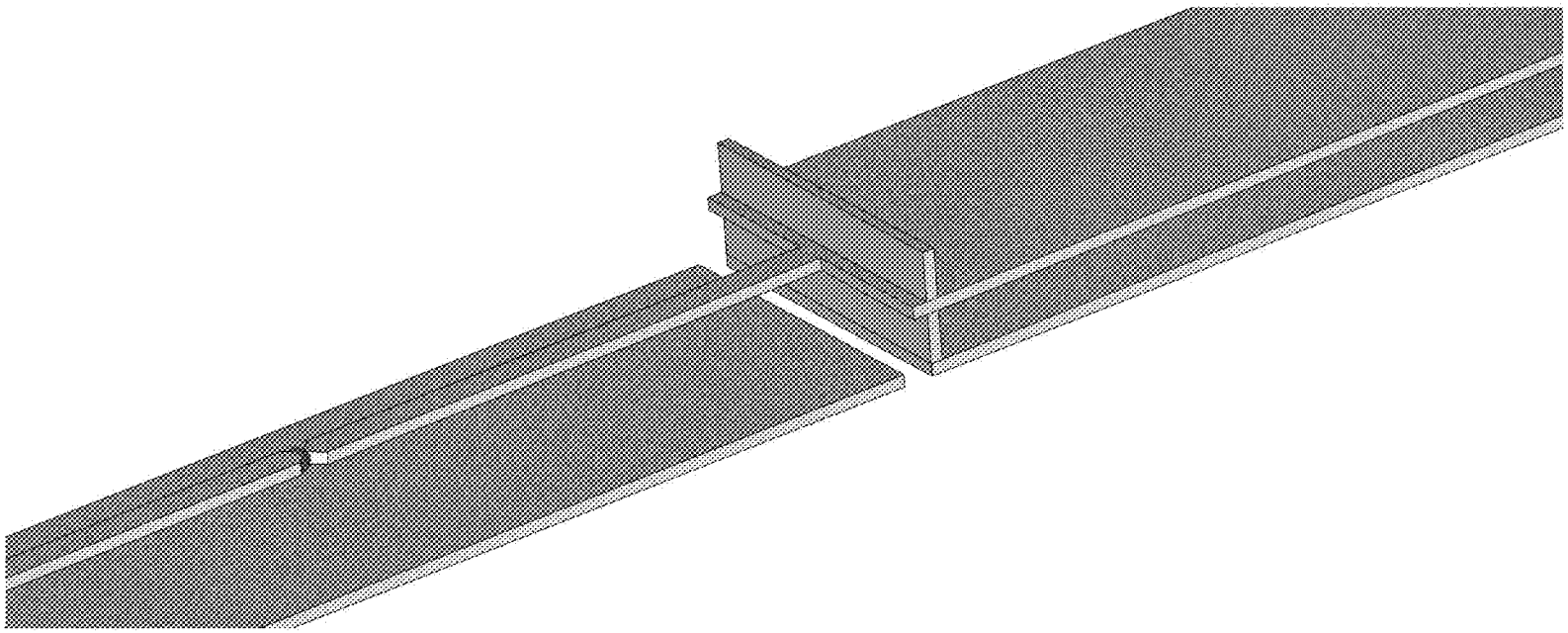
FIG. 80 shows a detailed closeup of FIG. 79.

FIG. 80 shows a detailed closeup of FIG. 79.

Figure 81:
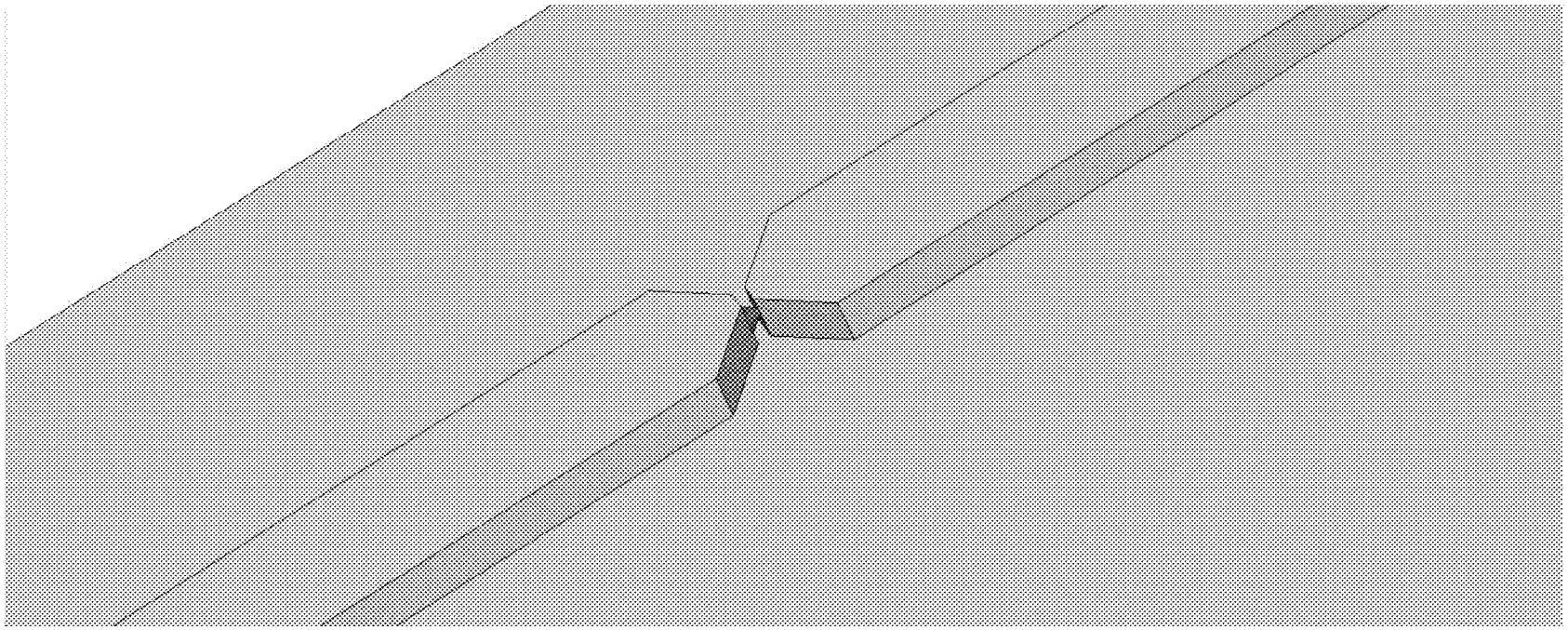
FIG. 81 shows feedpoint detail showing the feedpoint source used in simulation.

FIG. 81 shows feedpoint detail showing the source.

Figure 82:
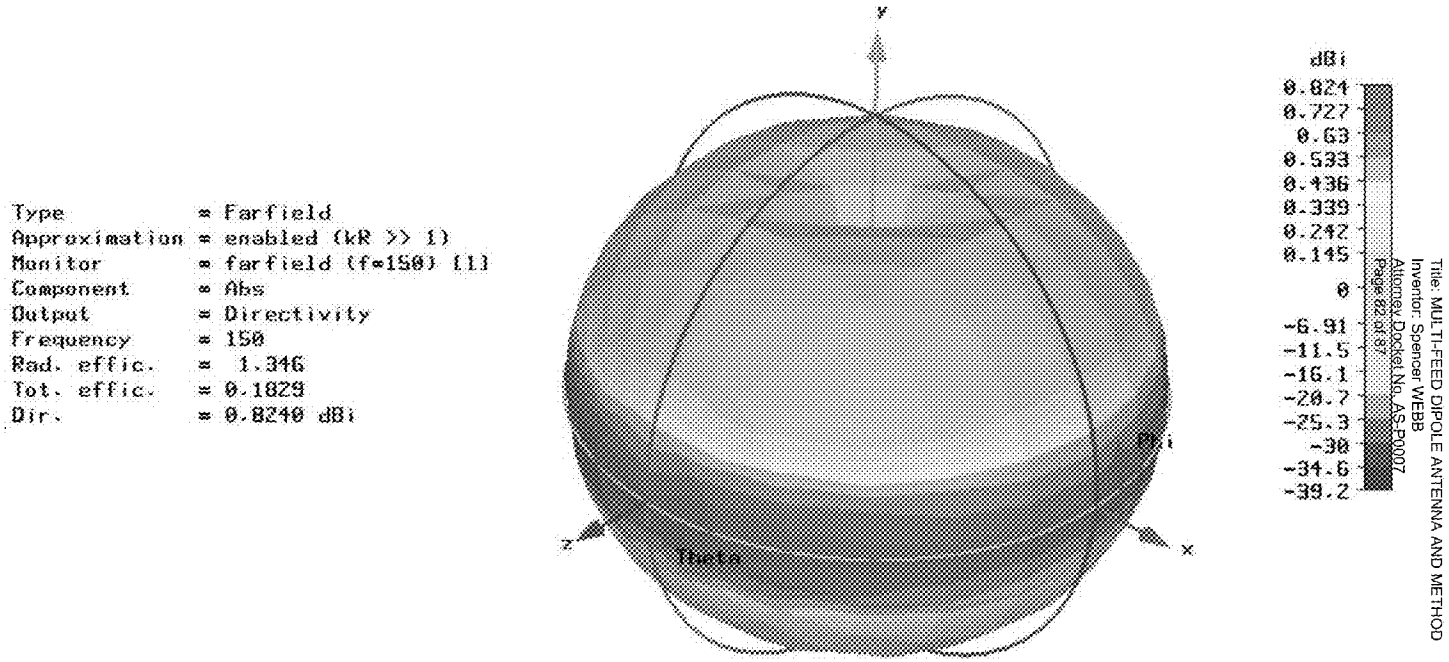
FIG. 82 shows a three-dimensional radiation pattern for the planar embodiment of FIG. 75 at 150 MHz.

FIG. 82 shows a three-dimensional radiation pattern for the planar embodiment of FIG. 75 at 150 MHz.

Figure 83:
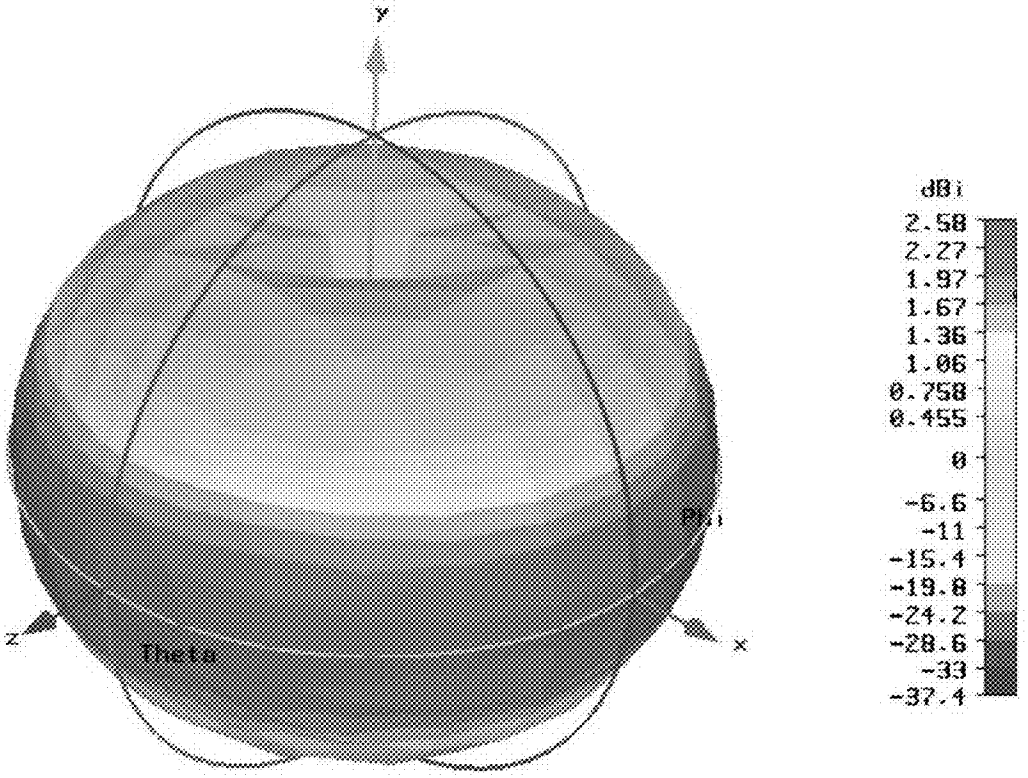
FIG. 83 shows a three-dimensional radiation pattern for the planar embodiment of FIG. 75 at 300 MHz.

FIG. 83 shows a three-dimensional radiation pattern for the planar embodiment of FIG. 75 at 300 MHz.

Figure 84:
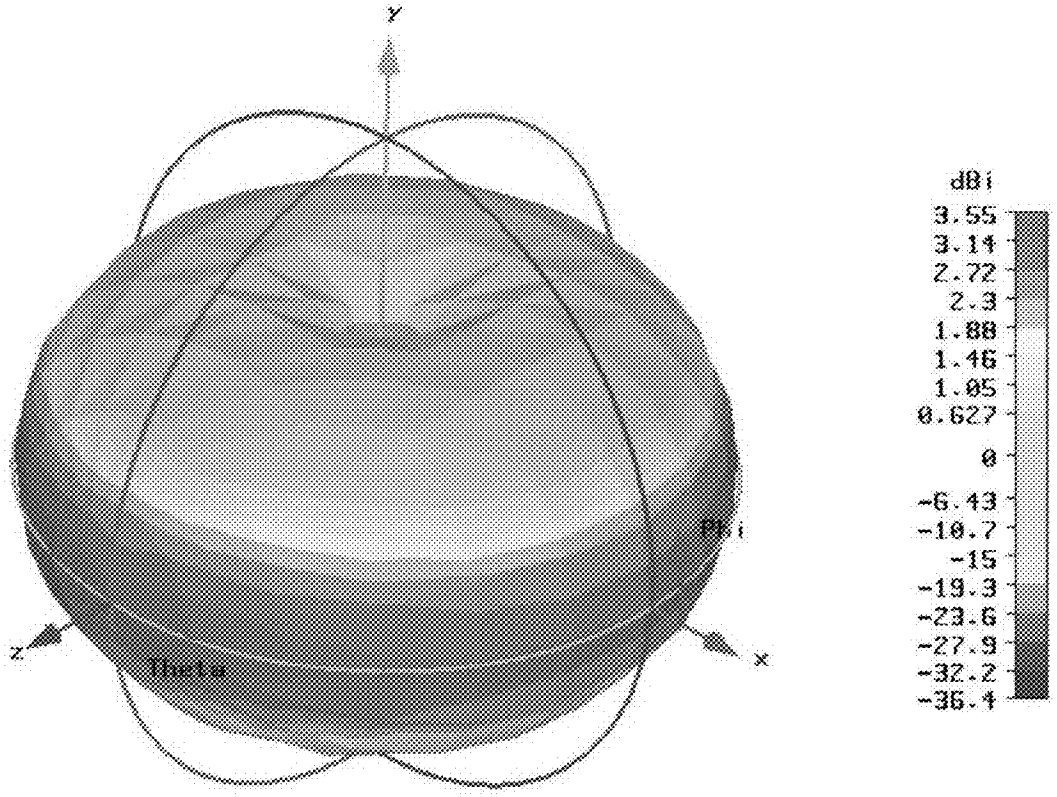
FIG. 84 shows a three-dimensional radiation pattern for the planar embodiment of FIG. 75 at 600 MHz.

FIG. 84 shows a three-dimensional radiation pattern for the planar embodiment of FIG. 75 at 600 MHz.

This example of the planar MFD antenna may also be constructed in a printed circuit board embodiment. In the printed circuit board (PCB) embodiment, the conductors may be implemented on different layers of a multilayer board. The connections between layers may be made by plated-through holes ("vias"), which correspond to the planar shorts shown in the FIG. 75. In a PCB embodiment an inner layer stripline transmission line may be utilized or alternatively a parallel transmission line may be brought out of the planar embodiment at right angles.

In addition, for use with cell phone towers, any type of reflector, for example such as a 90 degree angle reflector or reflector of any other angle or shape may be utilized in combination with embodiments of the antenna as described herein. In one embodiment, a reflector approximately a quarter wavelength away from any embodiment described herein may be utilized to form a directional antenna embodiment. FIG. 85 shows a front view of a corner reflector with the planar embodiment of FIG. 75. FIG. 86 shows a perspective view of a corner reflector with the planar embodiment of FIG. 75. FIG. 87 shows a top view of a corner reflector with the planar embodiment of FIG. 75.

Figure 55:
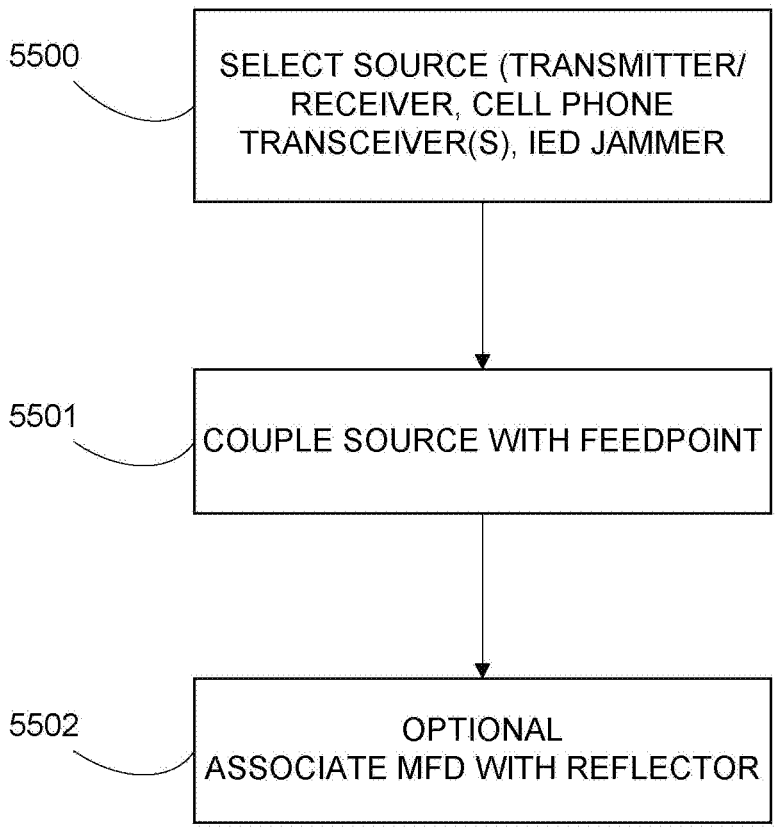
FIG. 55 is flowchart illustrating coupling the MFD to transmitters or receivers of various types and optionally associating the MFD with a reflector for directional use.

FIG. 55 is a flowchart illustrating coupling the MFD to transmitters or receivers (or transceivers) of various types and optionally associating the MFD with a reflector for directional use. The source for interfacing with an embodiment of the invention is selected at 5500. The source is coupled with the feedpoint of the embodiment at 5501. In one or more embodiments, multiple sources may be coupled to a particular MFD. Optionally, a reflector may be associated in proximity to the MFD to provide directional coverage for the antenna. For example a reflector approximately a quarter of a wavelength away may be utilized. One use for a wide band antenna as enabled herein relates to cellular radio systems. Cellular towers are very expensive to operate. Many different carriers wish to utilize the same tower, and generally use one antenna per sector per band. An antenna that can provide multiple bands of operation due to large bandwidth enables multiple carriers to share the same antenna. Further, radio services which are not now anticipated may be served by extant antennas, for example via embodiments of the invention, on towers without the need to employ personnel to climb the tower, install new antennas and feedlines and incur all the expenses related thereto. In one or more embodiments of the invention, coupling an embodiment of the invention with at least one cell phone transceiver enables more efficient utilization of tower antennas. For example, embodiments of the invention enable use of PCS and GSM services using the same antenna without the need to add a separate antenna on a tower. Another need for the present invention relates to high power transmitters that benefit from operation over large frequency bands. Presently, there is an important application that falls under this description: wideband jamming transmitters utilized to defeat remotely-controlled improvised explosive devices (IEDs). These jammers must operate over all known cellular telephone bands, as well as other bands where remote control devices operate. Embodiments of the invention provide for extremely wideband operation, and most importantly, do so with great efficiency since these embodiments do not utilize dielectric loading materials nor resistive materials that sacrifice power in the interest of wide impedance bandwidth. The present invention may be made of perfect electrical conductor (PEC), and still display its wideband characteristics.

While the invention herein disclosed has been described by means of specific embodiments and applications thereof, numerous modifications and variations could be made thereto by those skilled in the art without departing from the scope of the invention set forth in the claims.

What is claimed is:

1. A multi-feed dipole antenna comprising:

a top tube;

a bottom tube;

a top pin conductively connected to said top tube;

a bottom pin conductively connected to said bottom tube;

a feed point coupled with said top pin and said bottom pin;

a center tube insulatively coupled with said top tube and said bottom tube and positioned coaxially between said top tube and said bottom tube;

wherein said multi-feed dipole antenna is fed from both said top tube and said bottom tube via said top pin and said bottom pin respectively; and, wherein said top tube comprises two rectangular parallel plates and said bottom tube comprises two rectangular parallel plates and wherein said center tube comprises two rectangular plates and wherein said multi-feed dipole antenna is configured to fit in a rectangular volume.

2. The multi-feed dipole antenna of claim 1 wherein said top tube is conductively connected to said top pin via a top pin plate and wherein said bottom tube is conductively connected to said bottom pin via a bottom pin plate.

3. The multi-feed dipole antenna of claim 1 wherein said top tube, said bottom tube and said center tube are formed on a printed circuit board.

4. The multi-feed dipole antenna of claim 1 further comprising a reflector.

5. The multi-feed dipole antenna of claim 1 wherein said multi-feed dipole antenna is formed into an array using a plurality of multi-feed dipole antennas.

6. The multi-feed dipole antenna of claim 1 wherein said multi-feed dipole antenna is coupled with an IED jammer.

7. The multi-feed dipole antenna of claim 1 wherein said multi-feed dipole antenna is coupled with at least one cell phone transceiver.

8. The multi-feed dipole antenna of claim 1 wherein said multi-feed dipole antenna is coupled with a PCS and a GSM transceiver.

9. A multi-feed dipole antenna comprising:

a top tube;

a bottom tube;

a top pin conductively connected to said top tube via a top pin plate;

a bottom pin conductively connected to said bottom tube via a bottom pin plate;

a center tube insulatively coupled with said top tube and said bottom tube and positioned coaxially between said top tube and said bottom tube;

a feed point coupled with said top pin and said bottom pin;

wherein said multi-feed dipole antenna is fed from both said top tube and said bottom tube via said top pin and said bottom pin respectively at said feed point; and, wherein said top tube comprises two rectangular parallel plates and said bottom tube comprises two rectangular parallel plates and wherein said center tube comprises two rectangular plates and wherein said multi-feed dipole antenna is configured to fit in a rectangular volume.

10. A method for manufacturing a multi-feed dipole antenna comprising:

forming a top tube into two rectangular parallel plates; forming a bottom tube into two rectangular parallel plates; forming a center tube into two rectangular plates to allow said multi-feed dipole antenna to fit in a rectangular volume;

coupling said top tube conductively with a top pin; coupling said bottom tube conductively with a bottom pin; coupling said center tube insulatively with said top tube and said bottom tube; and, coupling a feed point with said top pin and said bottom pin;

providing a feed point coupled with said top pin and said bottom pin wherein said feed point is configured to feed said top tube and said bottom tube via said top pin and said bottom pin respectively.

11. The method of claim 9 further comprising:

conductively connecting said top tube to said top pin via a top pin plate; and, conductively connecting said bottom tube to said bottom pin via a bottom pin plate.

12. The method of claim 10 further comprising:

forming said top tube, said bottom tube and said center tube on a printed circuit board.

13. The method of claim 9 further comprising:

associating said multi-feed dipole antenna with a reflector.

14. The method of claim 9 further comprising:

forming said multi-feed dipole antenna into an array using a plurality of multi-feed dipole antennas.

15. The method of claim 9 further comprising:

coupling said multi-feed dipole antenna with an IED jammer.

16. The method of claim 9 further comprising:

coupling said multi-feed dipole antenna with at least one cell phone transceiver.

* * * * *